US009837016B2

(12) United States Patent
Kishi

(10) Patent No.: US 9,837,016 B2
(45) Date of Patent: Dec. 5, 2017

(54) DISPLAY DEVICE AND DRIVE METHOD THEREFOR

(71) Applicant: Sharp Kabushiki Kaisha, Osaka-shi, Osaka (JP)

(72) Inventor: Noritaka Kishi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 168 days.

(21) Appl. No.: 14/900,224

(22) PCT Filed: Jun. 20, 2014

(86) PCT No.: PCT/JP2014/066402
§ 371 (c)(1),
(2) Date: Dec. 21, 2015

(87) PCT Pub. No.: WO2014/208458
PCT Pub. Date: Dec. 31, 2014

(65) Prior Publication Data

US 2016/0155377 A1 Jun. 2, 2016

(30) Foreign Application Priority Data

Jun. 27, 2013 (JP) ..... 2013-134637

(51) Int. Cl.
*G09G 3/30* (2006.01)
*G09G 3/3208* (2016.01)
(Continued)

(52) U.S. Cl.
CPC ..... *G09G 3/3208* (2013.01); *G09G 3/3233* (2013.01); *G09G 3/3291* (2013.01);
(Continued)

(58) Field of Classification Search
CPC ..... G09G 3/3233; G09G 3/3208; G09G 3/32; G09G 3/006; G09G 2310/021;
(Continued)

(56) References Cited

U.S. PATENT DOCUMENTS 9,123,295 B2 * 9/2015 Jeong ..... G09G 3/3233
9,280,933 B2 * 3/2016 Chaji ..... G09G 3/3233
(Continued)

FOREIGN PATENT DOCUMENTS

JP 2003-195810 A 7/2003
JP 2005-031630 A 2/2005
(Continued)

*Primary Examiner* — Vijay Shankar
(74) *Attorney, Agent, or Firm* — Keating & Bennett, LLP

(57) ABSTRACT

A monitor line electrically connectable with sources of drive transistors and positive electrodes of electro-optical elements is provided. A drive method includes a step of detecting the characteristics of a drive transistor, a step of detecting the characteristics of an electro-optical element, a step of storing characteristics data obtained on the basis of a result of the detection of the characteristics, as correction data for correcting a video signal, and a step of correcting the video signal on the basis of the correction data. Here, the length of a selection period is set to be equal for a monitored row and an unmonitored row. In addition, a potential given to the monitor line for the detection of the characteristics of the drive transistors and a potential given to the monitor line for the detection of the characteristics of the electro-optical elements are made different.

25 Claims, 37 Drawing Sheets

(51) Int. Cl.
*G09G 3/3233* (2016.01)
*G09G 3/3291* (2016.01)

(52) U.S. Cl.
CPC ..... *G09G 2300/043* (2013.01); *G09G 2300/0842* (2013.01); *G09G 2310/0218* (2013.01); *G09G 2310/06* (2013.01); *G09G 2320/0295* (2013.01); *G09G 2320/043* (2013.01); *G09G 2320/0626* (2013.01); *G09G 2320/0666* (2013.01)

(58) Field of Classification Search
CPC ..... G09G 2310/08; G09G 2310/0218; G09G 2320/043; G09G 2320/045
See application file for complete search history.

(56) References Cited

U.S. PATENT DOCUMENTS

| | | | | |
|---|---|---|---|---|
| 9,530,349 | B2 * | 12/2016 | Chaji ..... | G09G 3/3233 |
| 2004/0113873 | A1 | 6/2004 | Shirasaki et al. | |
| 2005/0017934 | A1 | 1/2005 | Chung et al. | |
| 2006/0158402 | A1 | 7/2006 | Nathan et al. | |
| 2007/0200804 | A1 | 8/2007 | Kwon | |
| 2012/0138922 | A1 | 6/2012 | Yamazaki et al. | |

FOREIGN PATENT DOCUMENTS

| | | | |
|---|---|---|---|
| JP | 2007-128103 | A | 5/2007 |
| JP | 2007-233326 | A | 9/2007 |
| JP | 2008-523448 | A | 7/2008 |
| JP | 2012-134475 | A | 7/2012 |

* cited by examiner

FIG. 8

| | CHARACTERISTICS DETECTION OPERATION | NORMAL OPERATION |
|---|---|---|
| (k+1)-TH FRAME | FIRST ROW | SECOND TO n-TH ROWS |
| (k+2)-TH FRAME | SECOND ROW | FIRST AND THIRD TO n-TH ROWS |
| (k+3)-TH FRAME | THIRD ROW | FIRST TO SECOND AND FOURTH TO n-TH ROWS |
| ⋮ | ⋮ | ⋮ |
| (k+n)-TH FRAME | n-TH ROW | FIRST TO (n−1)-TH ROWS |

DISPLAY DEVICE AND DRIVE METHOD THEREFOR

TECHNICAL FIELD

The present disclosure relates to display devices and drive methods therefor, and more specifically to a display device provided with pixel circuits each including an electro-optical element such as an organic EL (Electro Luminescence) element, and to a drive method for the display device.

BACKGROUND ART

In the related art, examples of a display element provided in a display device include an electro-optical element whose brightness is controlled with applied voltage, and an electro-optical element whose brightness is controlled with current. Typical examples of the electro-optical element whose brightness is controlled with applied voltage include a liquid crystal display element. On the other hand, typical examples of the electro-optical element whose brightness is controlled with current include an organic EL element. The organic EL element is also called an OLED (Organic Light-Emitting Diode). An organic EL display device including an organic EL element, which is a self-illumination electro-optical element, can facilitate a reduction in profile, a reduction in power consumption, an increase in brightness, and so forth compared with a liquid crystal display device that requires a backlight, a color filter, and so forth. Accordingly, the development of organic EL display devices has actively promoted in recent years.

Known drive systems for organic EL display devices include a passive matrix system (also referred to as a simple matrix system) and an active matrix system. An organic EL display device that adopts the passive matrix system has a simple structure but is difficult to increase in size and definition. In contrast, an organic EL display device that adopts the active matrix system (hereinafter referred to as an "active-matrix organic EL display device") can easily achieve an increase in size and definition compared with an organic EL display device that adopts the passive matrix system.

An active-matrix organic EL display device has a plurality of pixel circuits formed thereon in a matrix. Each of the pixel circuits of the active-matrix organic EL display device typically includes an input transistor that selects a pixel, and a drive transistor that controls supply of current to the organic EL element. In the following, the current flowing from the drive transistor to the organic EL element may be referred to as the "drive current".

FIG. 38 is a circuit diagram illustrating the configuration of a typical pixel circuit 91 in the related art. The pixel circuit 91 is disposed at each of the intersections of a plurality of data lines S and a plurality of scanning lines G provided in a display unit. As illustrated in FIG. 38, the pixel circuit 91 includes two transistors T1 and T2, one capacitor Cst, and one organic EL element OLED. The transistor T1 is an input transistor, and the transistor T2 is a drive transistor.

The transistor T1 is disposed between the corresponding data line S and a gate terminal of the transistor T2. The transistor T1 has a gate terminal connected to the corresponding scanning line G, and a source terminal connected to the corresponding data line S. The transistor T2 is disposed in series with the organic EL element OLED. The transistor T2 has a drain terminal connected to a power supply line for supplying a high-level power supply voltage ELVDD, and a source terminal connected to an anode terminal of the organic EL element OLED. The power supply line for supplying the high-level power supply voltage ELVDD is hereinafter referred to as the "high-level power supply line", and the high-level power supply line is denoted by the same symbol as that of the high-level power supply voltage, namely, ELVDD. The capacitor Cst has an end connected to the gate terminal of the transistor T2, and another end connected to the source terminal of the transistor T2. A cathode terminal of the organic EL element OLED is connected to a power supply line for supplying a low-level power supply voltage ELVSS. The power supply line for supplying the low-level power supply voltage ELVSS is hereinafter referred to as the "low-level power supply line", and the low-level power supply line is denoted by the same symbol as that of the low-level power supply voltage, namely, ELVSS. Here, the node of the gate terminal of the transistor T2, the one end of the capacitor Cst, and a drain terminal of the transistor T1 is conveniently referred to as a "gate node VG". In general, one of the drain and the source having a higher potential is referred to as a drain. In the description of this specification, however, one of the drain and the source is defined as a drain and the other as a source. Thus, the source potential may be higher than the drain potential.

FIG. 39 is a timing chart describing the operation of the pixel circuit 91 illustrated in FIG. 38. The scanning line G is in an unselected state prior to time t1. Accordingly, prior to time t1, the transistor T1 is in the off state and the potential of the gate node VG is maintained at an initial level (for example, the level according to the writing in the immediately preceding frame). When time t1 is reached, the scanning line G is set to a selected state, and the transistor T1 is turned on. Accordingly, a data voltage Vdata corresponding to the brightness of a pixel (sub-pixel) formed by the pixel circuit 91 is supplied to the gate node VG via the data line S and the transistor T1. Thereafter, the potential of the gate node VG changes in accordance with the data voltage Vdata over a period until time t2. At this time, the capacitor Cst is charged to a gate-source voltage Vgs that is a difference between the potential of the gate node VG and the source potential of the transistor T2. When time t2 is reached, the scanning line G is set to the unselected state. Accordingly, the transistor T1 is turned off, and the gate-source voltage Vgs held on the capacitor Cst is defined. The transistor T2 supplies the drive current to the organic EL element OLED in accordance with the gate-source voltage Vgs held on the capacitor Cst. In consequence, the organic EL element OLED emits light at the brightness corresponding to the drive current.

Incidentally, an organic EL display device typically employs a thin-film transistor (TFT) as a drive transistor. In a thin-film transistor, however, variations in threshold voltage are likely to occur. Variations in threshold voltage occurring in a drive transistor provided in a display unit cause variations in brightness, resulting in a reduction in display quality. Accordingly, techniques for suppressing a reduction in the display quality of an organic EL display device have been proposed in the related art. For example, Japanese Unexamined Patent Application Publication No. 2005-31630 discloses a technique for compensating for variations in the threshold voltage of a drive transistor. Further, Japanese Unexamined Patent Application Publication No. 2003-195810 and Japanese Unexamined Patent Application Publication No. 2007-128103 disclose a technique for maintaining the current flow from a pixel circuit to an organic EL element OLED constant. In addition, Japanese Unexamined Patent Application Publication No. 2007-233326 discloses a technique for displaying an image with a uniform brightness regardless of the threshold voltage of a drive transistor or the mobility of electrons.

The techniques of the related art described above make it possible to supply a constant current to an organic EL element (light-emitting element) in accordance with the desired brightness (target brightness) even if variations in threshold voltage occur in a drive transistor provided in a display unit. However, the current efficiency of the organic EL element decreases with time. That is, even if a constant current is successfully supplied to the organic EL element, brightness gradually decreases with time. This leads to burn-in.

Therefore, if the degradation of the drive transistor and the degradation of the organic EL element are not compensated for, as illustrated in FIG. 40, a decrease in current due to the degradation of the drive transistor occurs and a decrease in brightness due to the degradation of the organic EL element occurs. Even if the degradation of the drive transistor is compensated for, as illustrated in FIG. 41, a decrease in brightness due to the degradation of the organic EL element occurs with the lapse of time. Accordingly, Japanese Unexamined Patent Application Publication (Translation of PCT Application) No. 2008-523448 discloses a technique for correcting data in accordance with the characteristics of the organic EL element OLED, in addition to a technique for correcting data in accordance with the characteristics of the drive transistor.

CITATION LIST

Patent Literature

PTL 1: Japanese Unexamined Patent Application Publication No. 2005-31630

PTL 2: Japanese Unexamined Patent Application Publication No. 2003-195810

PTL 3: Japanese Unexamined Patent Application Publication No. 2007-128103

PTL 4: Japanese Unexamined Patent Application Publication No. 2007-233326

PTL 5: Japanese Unexamined Patent Application Publication (Translation of PCT Application) No. 2008-523448

SUMMARY

Technical Problem

However, the technique disclosed in Japanese Unexamined Patent Application Publication (Translation of PCT Application) No. 2008-523448 allows detection of the characteristics of only one of the drive transistor or the organic EL element during a selection period. Thus, it is not possible to simultaneously compensate for both the degradation of the drive transistor and the degradation of the organic EL element. In addition, a long selection period is needed for the detection of the characteristics of both the drive transistor and the organic EL element. In the technique disclosed in Japanese Unexamined Patent Application Publication (Translation of PCT Application) No. 2008-523448, an increase in the selection period during which characteristics are detected makes the length of the time period for light emission differ between a row for which characteristics are detected and the other rows. As a result, display with the desired brightness is not achievable. In other words, shortening the selection period to achieve display with the desired brightness does not ensure a sufficient amount of time for detecting characteristics. As a result, the accuracy of detection of characteristics is reduced, and the degradation of the drive transistor and the degradation of the organic EL element are not sufficiently compensated for.

Accordingly, it is an object of the present invention to provide a drive method for a display device which enables sufficient compensation for the degradation of a circuit element while ensuring a sufficient amount of time for the detection of the characteristics of the circuit element. It is a further object of the present invention to provide a drive method for a display device which enables simultaneous compensation for both the degradation of a drive transistor and the degradation of a light-emitting element.

Solution to Problem

A first aspect of the embodiment provides a drive method for a display device having a pixel matrix of n rows and m columns constituted by n×m (where n and m are integers greater than or equal to 2) pixel circuits, each including an electro-optical element whose brightness is controlled with current and a drive transistor for controlling a current to be supplied to the electro-optical element, the drive method including a drive transistor characteristics detecting step of detecting characteristics of the drive transistor, a correction data storing step of causing a correction data storage unit prepared in advance to store, as correction data for correcting a video signal, characteristics data obtained on the basis of a detection result in the drive transistor characteristics detecting step, and a video signal correcting step of correcting the video signal on the basis of the correction data stored in the correction data storage unit, and generating a data signal to be supplied to the n×m pixel circuits, wherein the display device has, for each column in the pixel matrix, a monitor line electrically connectable with sources of the drive transistors and positive electrodes of the electro-optical elements, wherein processing of the drive transistor characteristics detecting step is performed for only one row in the pixel matrix per period of one frame, wherein, when a row for which the processing of the drive transistor characteristics detecting step is performed within each frame period is defined as a monitored row and a row other than the monitored row is defined as an unmonitored row, a period of one frame for the monitored row includes a drive transistor characteristics detection period during which the processing of the drive transistor characteristics detecting step is performed, and a light emission period during which the electro-optical elements are enabled to emit light, wherein, for the monitored row, the monitor line is electrically connected to the source of the drive transistor and the positive electrode of the electro-optical element throughout the drive transistor characteristics detection period and the light emission period, and wherein a potential given to the monitor line during the drive transistor characteristics detection period and a potential given to the monitor line during the light emission period are made different so that a current flows through only the drive transistor out of the drive transistor and the electro-optical element during the drive transistor characteristics detection period and so that a current flows through only the electro-optical element out of the drive transistor and the electro-optical element during the light emission period.

In a second aspect of the embodiment, in the first aspect of the embodiment, the drive method further includes an electro-optical element characteristics detecting step of detecting characteristics of the electro-optical element, processing of the electro-optical element characteristics detecting step is performed during the light emission period, and in the correction data storing step, characteristics data obtained on the basis of a detection result in the electro-optical element characteristics detecting step is further stored in the correction data storage unit as the correction data.

In a third aspect of the embodiment, in the second aspect of the embodiment, in the electro-optical element characteristics detecting step, a current flowing through the electro-optical element with a constant voltage being given to the electro-optical element is measured, so that the characteristics of the electro-optical element are detected.

In a fourth aspect of the embodiment, in the third aspect of the embodiment, in the electro-optical element characteristics detecting step, a length of a time period during which the constant voltage is given to the electro-optical element is adjusted in accordance with target brightness.

In a fifth aspect of the embodiment, in the fourth aspect of the embodiment, in the electro-optical element characteristics detecting step, the constant voltage, which has a plurality of levels within a range in which an integral value of light emission current for a period of one frame is equal to a value corresponding to target gradation, is given to the electro-optical element, so that a plurality of properties are detected as the characteristics of the electro-optical element.

In a sixth aspect of the embodiment, in the third aspect of the embodiment, the display device includes a current measurement circuit that measures a current of the monitor line, in the drive transistor characteristics detecting step, the current measurement circuit measures a current of the monitor line, so that characteristics of the drive transistor are detected, and in the electro-optical element characteristics detecting step, the current measurement circuit measures a current of the monitor line, so that characteristics of the electro-optical element are detected.

In a seventh aspect of the embodiment, in the second aspect of the embodiment, in the electro-optical element characteristics detecting step, a voltage across the positive electrode of the electro-optical element is measured with a constant current being given to the electro-optical element, so that the characteristics of the electro-optical element are detected.

In an eighth aspect of the embodiment, in the seventh aspect of the embodiment, in the electro-optical element characteristics detecting step, a length of a time period during which the constant current is given to the electro-optical element is adjusted in accordance with target brightness.

In a ninth aspect of the embodiment, in the eighth aspect of the embodiment, in the electro-optical element characteristics detecting step, the constant current, which has a plurality of levels within a range in which an integral value of light emission current for a period of one frame is equal to a value corresponding to target gradation, is given to the electro-optical element, so that a plurality of properties are detected as the characteristics of the electro-optical element.

In a tenth aspect of the embodiment, in the seventh aspect of the embodiment, the display device includes a current measurement circuit that measures a current of the monitor line, and a voltage measurement circuit that measures a voltage across the monitor line, in the drive transistor characteristics detecting step, the current measurement circuit measures a current of the monitor line, so that characteristics of the drive transistor are detected, and in the electro-optical element characteristics detecting step, the voltage measurement circuit measures a voltage across the monitor line, so that characteristics of the electro-optical element are detected.

In an eleventh aspect of the embodiment, in the second aspect of the embodiment, the processing of the electro-optical element characteristics detecting step is not performed on a pixel displayed in black or substantially in black within the pixel matrix of n rows and m columns.

In a twelfth aspect of the embodiment, in the second aspect of the embodiment, the drive method further includes a temperature detecting step of detecting a temperature, and a temperature change compensating step of subjecting the characteristics data to correction based on the temperature detected in the temperature detecting step, and in the correction data storing step, data obtained in processing of the temperature change compensating step is stored in the correction data storage unit as the correction data.

In a thirteenth aspect of the embodiment, in the first aspect of the embodiment, in the drive transistor characteristics detecting step, a current flowing between a drain and source of the drive transistor is measured with a voltage between a gate and source of the drive transistor being set to a predetermined magnitude, so that the characteristics of the drive transistor are detected.

In a fourteenth aspect of the embodiment, in the thirteenth aspect of the embodiment, in the drive transistor characteristics detecting step, a potential having a plurality of levels is given to the gate of the drive transistor, so that a plurality of properties are detected as the characteristics of the drive transistor.

In a fifteenth aspect of the embodiment, in the thirteenth aspect of the embodiment, the display device includes a current measurement circuit that measures a current of the monitor line, and in the drive transistor characteristics detecting step, the current measurement circuit measures a current of the monitor line, so that characteristics of the drive transistor are detected.

In a sixteenth aspect of the embodiment, in the fifteenth aspect of the embodiment, one current measurement circuit, which is the current measurement circuit, is disposed for every K monitor lines (K is an integer greater than or equal to 2 and less than or equal to m), and in each frame period, one of the K monitor lines is electrically connected to the current measurement circuit, and a monitor line not electrically connected to the current measurement circuit is brought into a high-impedance state.

In a seventeenth aspect of the embodiment, in the first aspect of the embodiment, each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg, the potential given to the monitor line during the drive transistor characteristics detection period is represented by Vm_TFT, and the potential given to the monitor line during the light emission period is represented by Vm_oled, a value of Vmg is defined so as to satisfy the following expressions:

$$Vmg > Vm_\mathrm{TFT} + Vth(T2), \text{ and}$$

$$Vmg < Vm_\mathrm{oled} + Vth(T2),$$

where Vth(T2) is a threshold voltage of a leading drive transistor.

In an eighteenth aspect of the embodiment, in the first aspect of the embodiment, each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg and the potential given to the monitor line during the drive transistor characteristics detection period is represented by Vm_TFT, a value of Vm_TFT is defined so as to satisfy the following expressions:

$$Vm_\mathrm{TFT} < Vmg - Vth(T2), \text{ and}$$

$$Vm_\mathrm{TFT} < ELVSS + Vth(\mathrm{oled}),$$

where Vth(T2) is a threshold voltage of the drive transistors, Vth(oled) is a light emission threshold voltage of the electro-optical element, and ELVSS is a potential at a negative electrode of the electro-optical element.

In a nineteenth aspect of the embodiment, in the first aspect of the embodiment, each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg and the potential given to the monitor line during the light emission period is represented by Vm_oled, a value of Vm_oled is defined so as to satisfy the following expressions:

$$Vm_\mathrm{oled} > Vmg - Vth(T2), \text{ and}$$

$$Vm_\mathrm{oled} > ELVSS + Vth(\mathrm{oled}),$$

where Vth(T2) is a threshold voltage of the drive transistors, Vth(oled) is a light emission threshold voltage of the electro-optical element, and ELVSS is a potential at a negative electrode of the electro-optical element.

In a twentieth aspect of the embodiment, in the first aspect of the embodiment, each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg, the potential given to the monitor line during the drive transistor characteristics detection period is represented by Vm_TFT, and the potential given to the monitor line during the light emission period is represented by Vm_oled, values of Vmg, Vm_TFT, and Vm_oled are defined so as to satisfy the following relationships:

$$Vm_\mathrm{TFT} < Vmg - Vth(T2),$$

$$Vm_\mathrm{TFT} < ELVSS + Vth(\mathrm{oled}),$$

$$Vm_\mathrm{oled} > Vmg - Vth(T2), \text{ and}$$

$$Vm_\mathrm{oled} > ELVSS + Vth(\mathrm{oled}),$$

where Vth(T2) is a threshold voltage of the drive transistors, Vth(oled) is a light emission threshold voltage of the electro-optical element, and ELVSS is a potential at a negative electrode of the electro-optical element.

In a twenty-first aspect of the embodiment, in the first aspect of the embodiment, a length of the drive transistor characteristics detection period and a length of the light emission period are adjusted in accordance with target brightness.

In a twenty-second aspect of the embodiment, in the first aspect of the embodiment, in each frame period, the drive transistor characteristics detection period precedes the light emission period.

In a twenty-third aspect of the embodiment, in the first aspect of the embodiment, each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and a length of the selection period is equal for the monitored row and the unmonitored row.

In a twenty-fourth aspect of the embodiment, in the first aspect of the embodiment, the drive method further includes a monitored region storing step of storing, in a monitored region storage unit prepared in advance, information that identifies a region in which the processing of the drive transistor characteristics detecting step was performed last when power to the display device was turned off, and the processing of the drive transistor characteristics detecting step is performed, starting with a region at or near the region obtained on the basis of the information stored in the monitored region storage unit, after power to the display device is turned on.

A twenty-fifth aspect of the embodiment provides a display device having pixel matrix of n rows and m columns constituted by n×m (where n and m are integers greater than or equal to 2) pixel circuits, each including an electro-optical element whose brightness is controlled with current and a drive transistor for controlling a current to be supplied to the electro-optical element, the display device including a pixel circuit driving unit that drives the n×m pixel circuits while performing a drive transistor characteristics detection process of detecting characteristics of the drive transistor, a correction data storage unit that stores characteristics data obtained on the basis of a detection result in the drive transistor characteristics detection process, as correction data for correcting a video signal, a video signal correction unit that corrects the video signal on the basis of the correction data stored in the correction data storage unit, and that generates a data signal to be supplied to the n×m pixel circuits, and a monitor line provided for each column in the pixel matrix, the monitor line being configured to be electrically connectable with sources of the drive transistors and positive electrodes of the electro-optical elements, wherein, when a row for which the drive transistor characteristics detection process is performed within each frame period is defined as a monitored row and a row other than the monitored row is defined as an unmonitored row, a period of one frame for the monitored row includes a drive transistor characteristics detection period during which the drive transistor characteristics detection process is performed, and a light emission period during which the electro-optical elements are enabled to emit light, and wherein the pixel circuit driving unit performs the drive transistor characteristics detection process for only one row in the pixel matrix per period of one frame, maintains a state where, for the monitored row, the monitor line is electrically connected to the source of the drive transistor and the positive electrode of the electro-optical element throughout the drive transistor characteristics detection period and the light emission period, and gives different potentials to the monitor line during the drive transistor characteristics detection period and during the light emission period so as to cause a current to flow through only the drive transistor out of the drive transistor and the electro-optical element during the drive transistor characteristics detection period and so as to cause a current to flow through only the electro-optical element out of the drive transistor and the electro-optical element during the light emission period.

Advantageous Effects of Invention

According to the first aspect of the embodiment, in a display device having pixel circuits each including an electro-optical element whose brightness is controlled with current (for example, an organic EL element) and a drive transistor for controlling a current to be supplied to the electro-optical element, the characteristics of the drive transistor are detected for one row per period of one frame. Then, a video signal is corrected by using correction data obtained by taking into account the detection result. A data signal based on the video signal corrected in the way described above is supplied to each of the pixel circuits. Thus, a drive current having a magnitude that allows the degradation of the drive transistor to be compensated for is supplied to the electro-optical element. In addition, the on/off state of the drive transistor is switched by changing the potential of a monitor line. For this reason, there is no need to provide a period for changing the gate potential of the drive transistor between a drive transistor characteristics detection period and a light emission period in order to switch the on/off state of the drive transistor. Accordingly, it is possible to ensure a sufficient length of a monitoring period. Therefore, it is possible to sufficiently compensate for the degradation of the drive transistor while ensuring a sufficient amount of time for the detection of the characteristics of the drive transistor.

According to the second aspect of the embodiment, the characteristics of an electro-optical element are detected, and a video signal is corrected by taking into account the detection result. Thus, a drive current having a magnitude that allows the degradation of the electro-optical element to be compensated for is supplied to the electro-optical element. Therefore, it is possible to sufficiently compensate for both the degradation of a drive transistor and the degradation of an electro-optical element while ensuring a sufficient amount of time for the detection of the characteristics of the drive transistor and the characteristics of the electro-optical element.

According to the third aspect of the embodiment, it is possible to reduce the amount of measurement time for detecting the characteristics of an electro-optical element.

According to the fourth aspect of the embodiment, it is possible to cause an electro-optical element to emit light at the desired brightness while detecting the characteristics of the electro-optical element.

According to the fifth aspect of the embodiment, a plurality of properties are detectable as the characteristics of an electro-optical element. Accordingly, it is possible to more effectively compensate for the degradation of the electro-optical element.

According to the sixth aspect of the embodiment, it is possible to detect the characteristics of both drive transistors and electro-optical elements included in each column, by using a single monitor line.

According to the seventh aspect of the embodiment, a constant current is supplied to an electro-optical element whose characteristics are to be detected. Accordingly, the amount of time during which a constant current is supplied to an electro-optical element is adjusted, making it possible to cause the electro-optical element to emit light at the desired brightness.

According to the eighth aspect of the embodiment, it is possible to cause an electro-optical element to emit light at the desired brightness while detecting the characteristics of the electro-optical element.

According to the ninth aspect of the embodiment, a plurality of properties are detectable as the characteristics of an electro-optical element. Accordingly, it is possible to more effectively compensate for the degradation of the electro-optical element.

According to the tenth aspect of the embodiment, it is possible to detect the characteristics of both drive transistors and electro-optical elements included in each column, by using a single monitor line.

According to the eleventh aspect of the embodiment, unwanted light emission of an electro-optical element is prevented.

According to the twelfth aspect of the embodiment, a video signal is corrected by using correction data that takes into account a temperature change. Accordingly, it is possible to sufficiently compensate for both the degradation of a drive transistor and the degradation of an electro-optical element regardless of a change in temperature.

According to the thirteenth aspect of the embodiment, it is possible to comparatively easily detect the characteristics of a drive transistor.

According to the fourteenth aspect of the embodiment, a plurality of properties are detectable as the characteristics of a drive transistor. Accordingly, it is possible to more effectively compensate for the degradation of the drive transistor.

According to the fifteenth aspect of the embodiment, it is possible to detect the characteristics of drive transistors included in each column, by using a single monitor line.

According to the sixteenth aspect of the embodiment, a single current measurement circuit is sharable by a plurality of monitor lines. Accordingly, it is possible to compensate for the degradation of drive transistors while suppressing an increase in circuit area.

According to the seventeenth aspect of the embodiment, it is ensured that a drive transistor is in an on state during the drive transistor characteristics detection period, and it is ensured that an electro-optical element is in an on state during the light emission period.

According to the eighteenth aspect of the embodiment, it is ensured that a drive transistor is in an on state and an electro-optical element is in an off state during the drive transistor characteristics detection period.

According to the nineteenth aspect of the embodiment, it is ensured that a drive transistor is in an off state and an electro-optical element is in an on state during the light emission period.

According to the twentieth aspect of the embodiment, it is ensured that a drive transistor is in an on state and an electro-optical element is in an off state during the drive transistor characteristics detection period. It is also ensured that a drive transistor is in an off state and an electro-optical element is in an on state during the light emission period.

According to the twenty-first aspect of the embodiment, it is possible to lengthen the drive transistor characteristics detection period in accordance with the target brightness. This makes it possible to measure current more times in order to detect the characteristics of a drive transistor. Accordingly, the S/N ratio of the detected current is increased, resulting in an improvement in the accuracy of detection of the characteristics of the drive transistor.

According to the twenty-second aspect of the embodiment, a drive transistor is prevented from being in an off state during the drive transistor characteristics detection period.

According to the twenty-third aspect of the embodiment, it is possible to ensure a sufficient length of the monitoring period without increasing the complexity of the configuration of a driving circuit of the display device.

According to the twenty-fourth aspect of the embodiment, a difference is prevented from occurring in the number of times the characteristics of a drive transistor are detected between, for example, an upper row and a lower row. This enables uniform compensation for the degradation of drive transistors across the entire screen surface, and effectively prevents the occurrence of variations in brightness.

According to the twenty-fifth aspect of the embodiment, a display device can achieve advantages similar to those of the first aspect of the present invention.

BRIEF DESCRIPTION OF DRAWINGS

FIG. 8 is a diagram describing the transitions of the operation for the respective rows according to the first embodiment.

FIG. 40 is a diagram describing the case where neither the degradation of a drive transistor nor the degradation of an organic EL element is compensated for.

FIG. 41 is a diagram describing the case where only the degradation of a drive transistor is compensated for.

DESCRIPTION OF EMBODIMENTS

Embodiments of the present invention will be described hereinafter with reference to the accompanying drawings. In the following, it is assumed that m and n are integers greater than or equal to 2, i is an integer greater than or equal to 1 and less than or equal to n, and j is an integer greater than or equal to 1 and less than or equal to m. In the following, furthermore, the characteristics of a drive transistor provided in a pixel circuit are referred to as "TFT characteristics", and the characteristics of an organic EL element provided in a pixel circuit are referred to as "OLED characteristics".

1. First Embodiment

1.1 Overall Configuration

Figure 2:
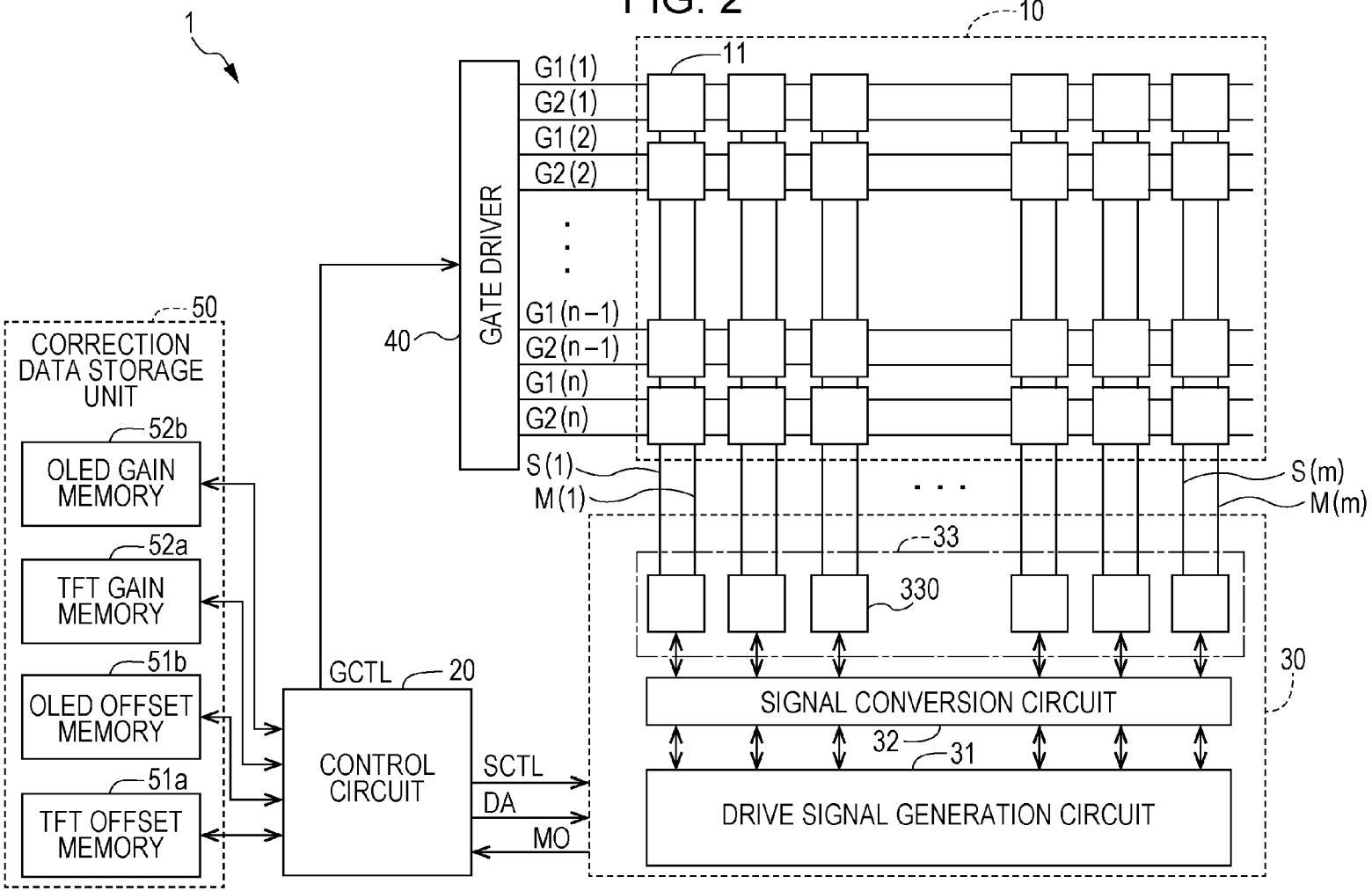
FIG. 2 is a block diagram illustrating the overall configuration of an organic EL display device according to the first embodiment.

FIG. 2 is a block diagram illustrating the overall configuration of an active-matrix organic EL display device 1 according to a first embodiment of the present invention. The organic EL display device 1 includes a display unit 10, a control circuit 20, a source driver (data line driving circuit) 30, a gate driver (scanning line driving circuit) 40, and a correction data storage unit 50. In this embodiment, the source driver 30 and the gate driver 40 implement a pixel circuit driving unit. Either or both of the source driver 30 and the gate driver 40 may be configured to be integrated with the display unit 10 into a single unit.

The display unit 10 has disposed thereon m data lines S(1) to S(m) and n scanning lines G1(1) to G1(*n*) intersecting the m data lines S(1) to S(m). In the following, a direction in which data lines extend is referred to as a Y direction, and a direction in which scanning lines extend is referred to as an X direction. Constituent elements arranged in the Y direction may be referred to as "columns", and constituent elements arranged in the X direction may be referred to as "rows". The display unit 10 also has disposed thereon m monitor lines M(1) to M(m) so as to correspond to the m data lines S(1) to S(m) in a one-to-one fashion. The monitor lines M(1) to M(m) are parallel to the data lines S(1) to S(m). The display unit 10 also has disposed thereon n monitor control lines G2(1) to G2(*n*) so as to correspond to the n scanning lines G1(1) to G1(*n*) in a one-to-one fashion. The monitor control lines G2(1) to G2(*n*) are parallel to the scanning lines G1(1) to G1(*n*). The display unit 10 further includes n×m pixel circuits 11 so as to correspond to the intersections of the n scanning lines G1(1) to G1(*n*) and the m data lines S(1) to S(m). The n×m pixel circuits 11 are provided in the manner described above, resulting in a pixel matrix of n rows and m columns being formed on the display unit 10. The display unit 10 also has disposed thereon a high-level power supply line for supplying a high-level power supply voltage and a low-level power supply line for supplying a low-level power supply voltage.

In the following, a data line or data lines are denoted simply by symbol S if the m data lines S(1) to S(m) do not need to be identified from one another. Also, a monitor line or monitor lines are denoted simply by symbol M if the m monitor lines M(1) to M(m) do not need to be identified from one another, a scanning line or scanning lines are denoted simply by symbol G1 if the n scanning lines G1(1) to G1(*n*) do not need to be identified from one another, and a monitor control line or monitor control lines are denoted simply by symbol G2 if the n monitor control lines G2(1) to G2(*n*) do not need to be identified from one another.

The control circuit 20 gives a data signal DA and a source control signal SCTL to the source driver 30 to control the operation of the source driver 30, and transmits a gate control signal GCTL to the gate driver 40 to control the operation of the gate driver 40. The source control signal SCTL includes, for example, a source start pulse, a source clock, and a latch strobe signal. The gate control signal GCTL includes, for example, a gate start pulse and a gate clock. The control circuit 20 receives monitor data MO given from the source driver 30, and updates correction data stored in the correction data storage unit 50. The monitor data MO is data measured to determine TFT characteristics and OLED characteristics.

Figure 3:
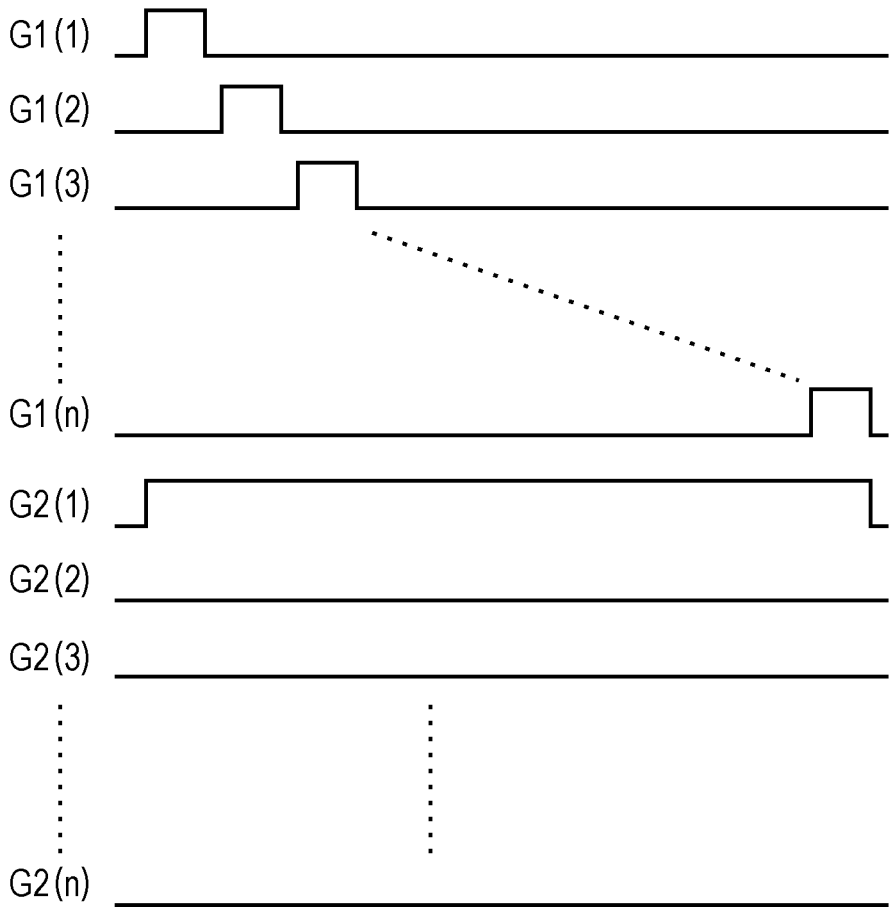
FIG. 3 is a timing chart describing the operation of a gate driver according to the first embodiment.
Figure 4:
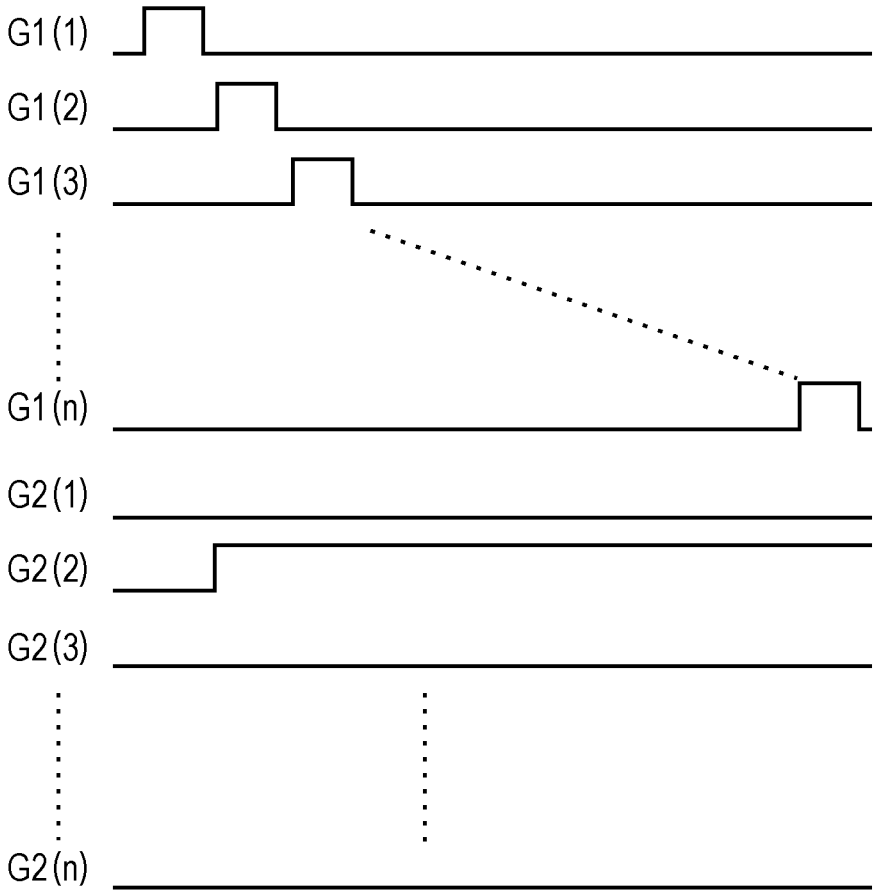
FIG. 4 is a timing chart describing the operation of the gate driver according to the first embodiment.
Figure 5:
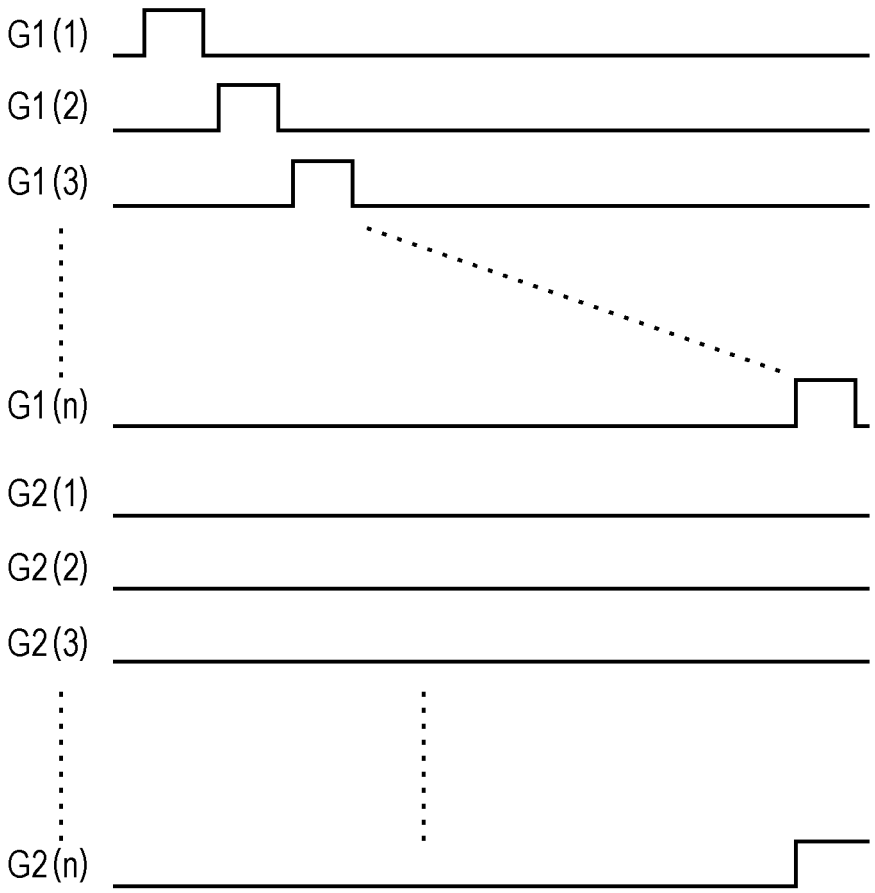
FIG. 5 is a timing chart describing the operation of the gate driver according to the first embodiment.

The gate driver 40 is connected to the n scanning lines G1(1) to G1(*n*) and the n monitor control lines G2(1) to G2(*n*). The gate driver 40 is constituted by shift registers, a logic circuit, and so forth. In the organic EL display device 1 according to this embodiment, a video signal sent from outside (data on which the data signal DA is based) is subjected to correction in accordance with the TFT characteristics and the OLED characteristics. In this regard, TFT characteristics and OLED characteristics for one row within each frame are detected. That is, when the TFT characteristics and the OLED characteristics for the first row within a certain frame are detected, the TFT characteristics and the OLED characteristics for the second row within a subsequent frame are detected and subsequently the TFT characteristics and the OLED characteristics for the third row within a further subsequent frame are detected. In the way described above, the TFT characteristics and the OLED characteristics for n rows are detected over a period of n frames. Here, if a frame in which the TFT characteristics and the OLED characteristics for the first row are detected is defined as the (k+1)-th frame, the n scanning lines G1(1) to G1(*n*) and the n monitor control lines G2(1) to G2(*n*) are driven in a manner illustrated in FIG. 3 for the (k+1)-th frame, driven in a manner illustrated in FIG. 4 for the (k+2)-th frame, and driven in a manner illustrated in FIG. 5 for the (k+n)-th frame. In FIG. 3 to FIG. 5, the high-level state represents the active state. A period during which the scanning line G1 is in the active state is referred to as a "selection period". The selection period is a period for allowing an organic EL element provided in a pixel circuit 11 to prepare to emit light. In the following, when the focus is on an arbitrary frame, a row for which the TFT characteristics and the OLED characteristics are being detected is referred to as the "monitored row", and the rows other than the monitored row are referred to as the "unmonitored rows". As can be seen from FIG. 3 to FIG. 5, the length of the selection period is the same for both the monitored row and the unmonitored rows. In each frame, the monitor control lines G2 corresponding to the unmonitored rows are maintained in an inactive state. The monitor control line G2 corresponding to the monitored row is set to the active state at the time when the selection period begins, and is maintained in the active state until after a period of substantially one frame from the time when the selection period begins. In this embodiment, the gate driver 40 is configured such that the n scanning lines G1(1) to G1(*n*) and the n monitor control lines G2(1) to G2(*n*) are driven in the way described above.

The source driver 30 is connected to the m data lines S(1) to S(m) and the m monitor lines M(1) to M(m). The source driver 30 is constituted by a drive signal generation circuit 31, a signal conversion circuit 32, and an output unit 33 having m output circuits 330. Each of the m output circuits 330 in the output unit 33 is connected to the corresponding data line S among the m data lines S(1) to S(m) and to the corresponding monitor line M among the m monitor lines M(1) to M(m). Since the output circuits 330 are connected to the data lines S and the monitor lines M in the manner described above, the source driver 30 can be functionally separated into a data line driving unit 30*a* and a monitor line driving unit 30*b* (see FIG. 17).

The drive signal generation circuit 31 includes shift registers, a sampling circuit, and latch circuits. In the drive signal generation circuit 31, the shift registers sequentially transfer source start pulses from the input ends to the output ends in synchronization with source clocks. In accordance with the transfer of the source start pulses, sampling pulses corresponding to the respective data lines S are output from the shift registers. The sampling circuit sequentially stores data signals DA for one row in accordance with the timing of sampling pulses. The latch circuits capture and hold the data signals DA for one row, which are stored in the sampling circuit, in accordance with latch strobe signals.

The signal conversion circuit 32 includes a D/A converter and an A/D converter. The data signals DA for one row held in the latch circuits in the drive signal generation circuit 31 in the way described above are converted into analog voltages by the D/A converter in the signal conversion circuit 32. The analog voltages obtained as a result of the conversion are given to the output circuits 330 in the output unit 33. Further, monitor data MO is given to the signal conversion circuit 32 from the output circuits 330. The monitor data MO is converted from analog voltages to digital signals by the A/D converter in the signal conversion circuit 32. The monitor data MO converted into digital signals is given to the control circuit 20 via the drive signal generation circuit 31. Further, the D/A converter in the signal conversion circuit 32 converts a signal that is one of source control signals SCTL and that is used to control the potentials of the monitor lines M into analog voltages, and the analog voltages are given to the output circuits 330 in the output unit 33 as monitor line control voltages Vm.

Figure 6:
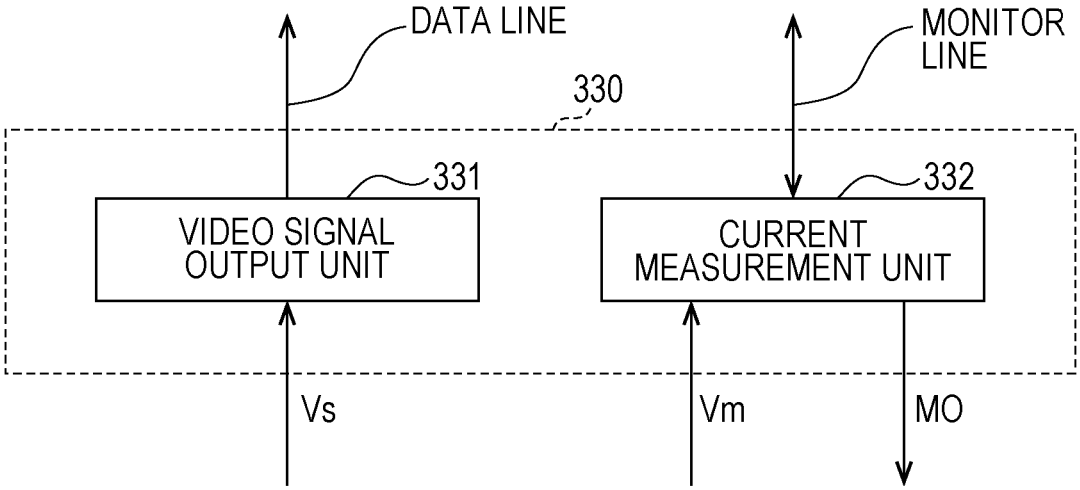
FIG. 6 is a block diagram illustrating the schematic configuration of an output circuit in an output unit according to the first embodiment.

FIG. 6 is a block diagram illustrating the schematic configuration of each of the output circuits 330 in the output unit 33. As illustrated in FIG. 6, the output circuit 330 includes a video signal output unit 331 and a current measurement circuit 332. The video signal output unit 331 includes a buffer such as a voltage follower, and an analog voltage Vs given from the signal conversion circuit 32 is applied via the buffer to the corresponding data line S as a data voltage. The current measurement circuit 332 has a function of supplying the monitor line control voltage Vm given from the signal conversion circuit 32 to the corresponding monitor line M, and also has a function of measuring the current flowing through the monitor line M. Data obtained as a result of the measurement using the current measurement circuit 332 is given to the signal conversion circuit 32 as monitor data MO. The detailed configuration of the current measurement circuit 332 will be described below (see FIG. 7).

The correction data storage unit 50 includes a TFT offset memory 51*a*, an OLED offset memory 51*b*, a TFT gain memory 52*a*, and an OLED gain memory 52*b*. These four memories may physically form a single memory, or may be physically different memories. The correction data storage unit 50 stores correction data used for the correction of a video signal sent from outside. More specifically, the TFT offset memory 51*a* stores offset values based on the result of detection of TFT characteristics as correction data. The OLED offset memory 51*b* stores offset values based on the result of detection of OLED characteristics as correction data. The TFT gain memory 52*a* stores gain values based on the result of detection of TFT characteristics as correction data. The OLED gain memory 52*b* stores degradation correction coefficients based on the result of detection of OLED characteristics as correction data. Typically, a number of offset values equal to the number of pixels in the display unit 10 and a number of gain values equal to the number of pixels in the display unit 10 are respectively stored in the TFT offset memory 51*a* and the TFT gain memory 52*a* as correction data based on the result of detection of TFT characteristics. In addition, typically, a number of offset values equal to the number of pixels in the display unit 10 and a number of degradation correction coefficients equal to the number of pixels in the display unit 10 are respectively stored in the OLED offset memory 51*b* and the OLED gain memory 52*b* as correction data based on the result of detection of OLED characteristics. A single value may be stored in each memory for every plurality of pixels.

The control circuit 20 updates the offset values in the TFT offset memory 51*a*, the offset values in the OLED offset memory 51*b*, the gain values in the TFT gain memory 52*a*, and the degradation correction coefficients in the OLED gain memory 52*b* on the basis of the monitor data MO given from the source driver 30. Further, the control circuit 20 reads the offset values in the TFT offset memory 51*a*, the offset values in the OLED offset memory 51*b*, the gain values in the TFT gain memory 52*a*, and the degradation correction coefficients in the OLED gain memory 52*b*, and corrects a video signal. Data obtained as a result of the correction is sent to the source driver 30 as a data signal DA.

1.2 Configuration of Pixel Circuit and Current Measurement Circuit

<1.2.1 Pixel Circuit>

Figure 7:
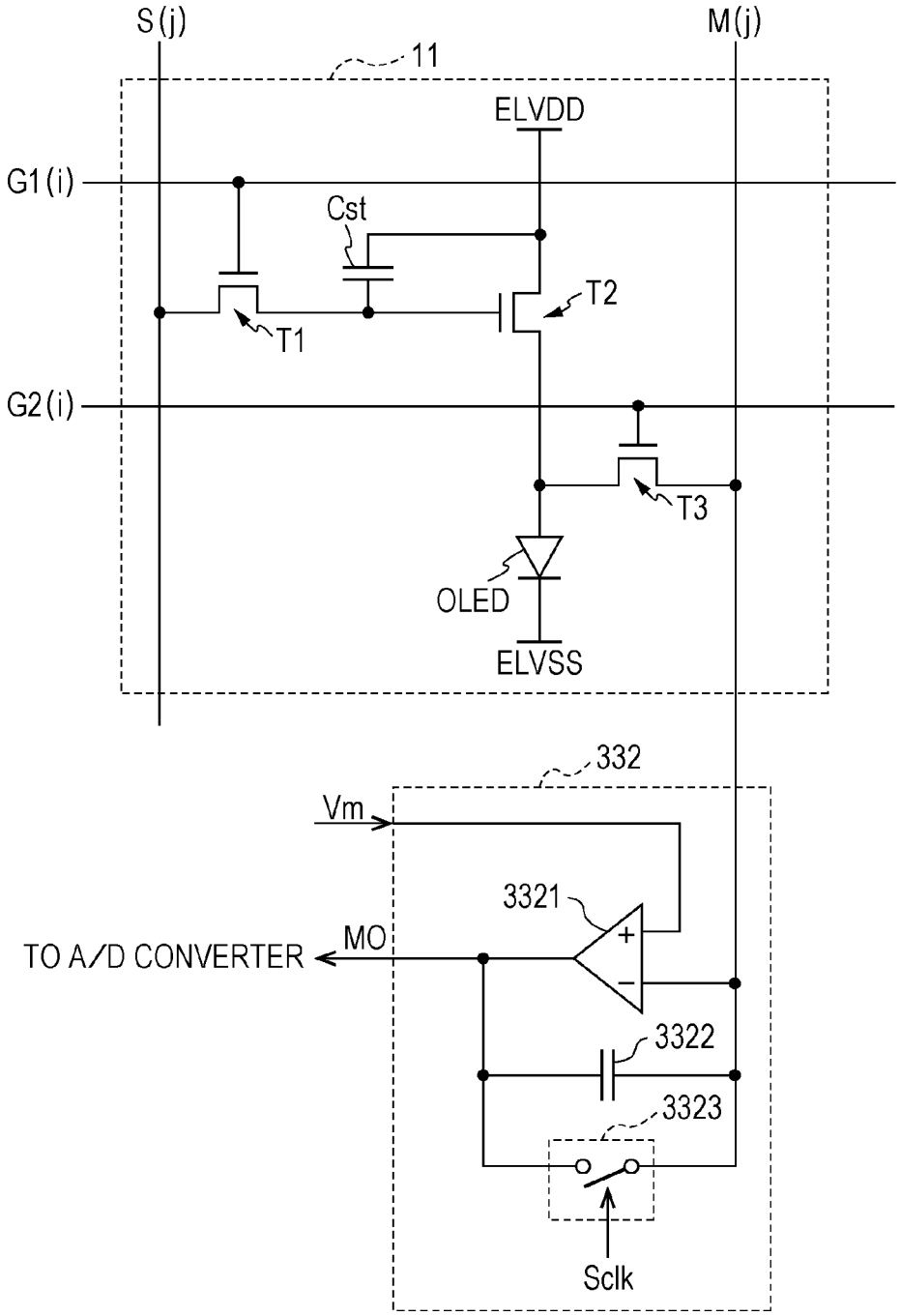
FIG. 7 is a circuit diagram illustrating the configuration of a pixel circuit and a current measurement circuit according to the first embodiment.

FIG. 7 is a circuit diagram illustrating the configuration of a pixel circuit 11 and a current measurement circuit 332. The pixel circuit 11 illustrated in FIG. 7 is the pixel circuit 11 in the i-th row and j-th column. The illustrated pixel circuit 11 includes one organic EL element OLED, three transistors T1 to T3, and one capacitor Cst. The transistor T1 functions as an input transistor that selects a pixel, the transistor T2 functions as a drive transistor that controls supply of current to the organic EL element OLED, and the transistor T3 functions as a monitor control transistor that controls whether or not to detect TFT characteristics or OLED characteristics.

The transistor T1 is disposed between the data line S(j) and a gate terminal of the transistor T2. The transistor T1 has a gate terminal connected to the scanning line G1(*i*), and a source terminal connected to the data line S(j). The transistor T2 is disposed in series with the organic EL element OLED. The gate terminal of the transistor T2 is connected to a drain terminal of the transistor T1. Further, the transistor T2 has a drain terminal connected to a high-level power supply line ELVDD, and a source terminal connected to an anode terminal of the organic EL element OLED. The transistor T3 has a gate terminal connected to the monitor control line G2(*i*), a drain terminal connected to the anode terminal of the organic EL element OLED, and a source terminal connected to the monitor line M(j). The capacitor Cst has an end connected to the gate terminal of the transistor T2, and another end connected to the drain terminal of the transistor T2. A cathode terminal of the organic EL element OLED is connected to a low-level power supply line ELVSS.

Figure 38:
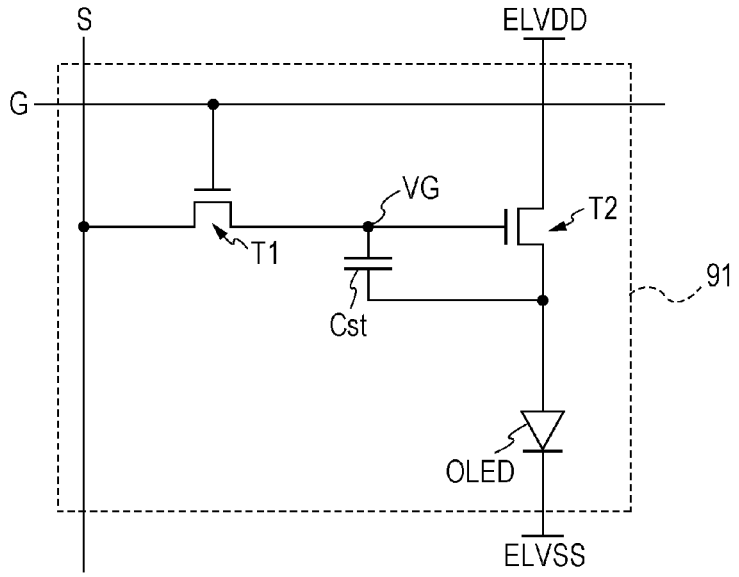
FIG. 38 is a circuit diagram illustrating the configuration of a typical pixel circuit in the related art.
Figure 39:
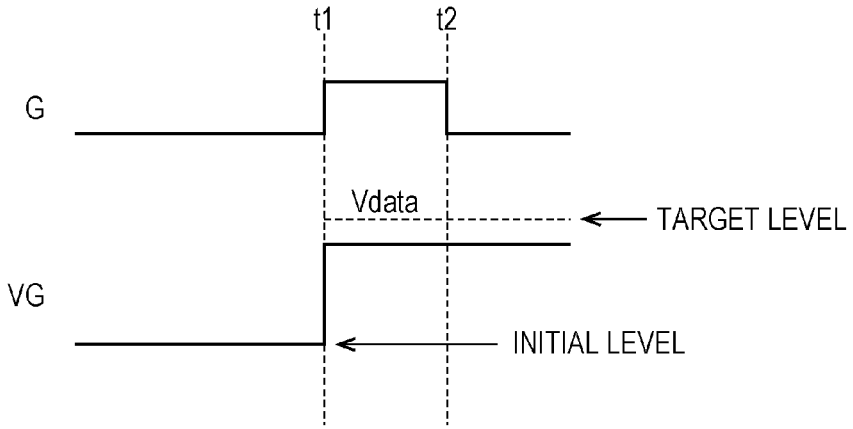
FIG. 39 is a timing chart describing the operation of the pixel circuit illustrated in FIG. 38.
Figure 40:
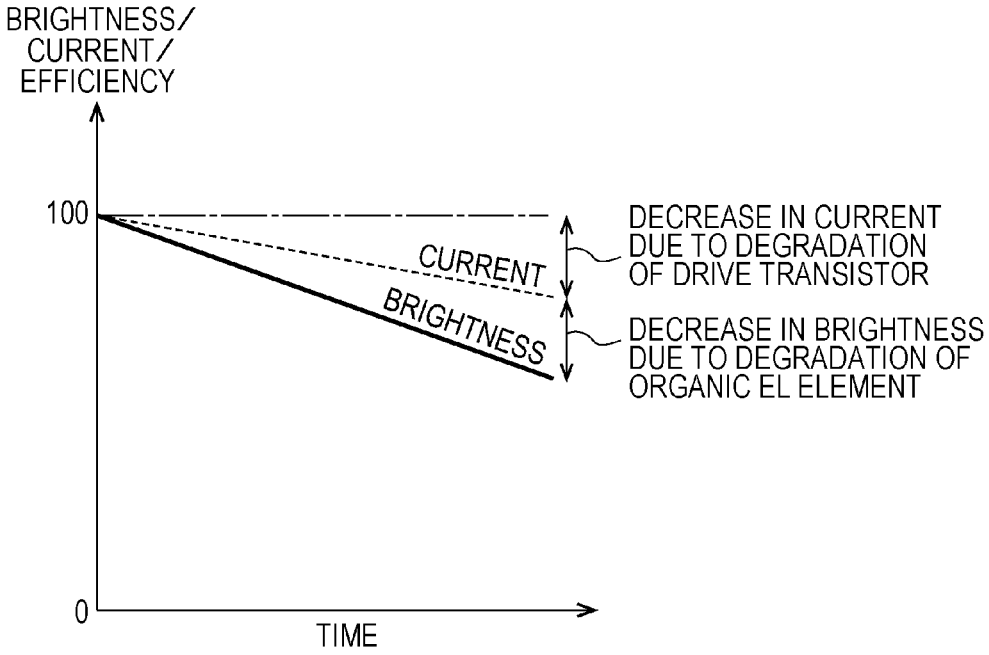
Figure 41:
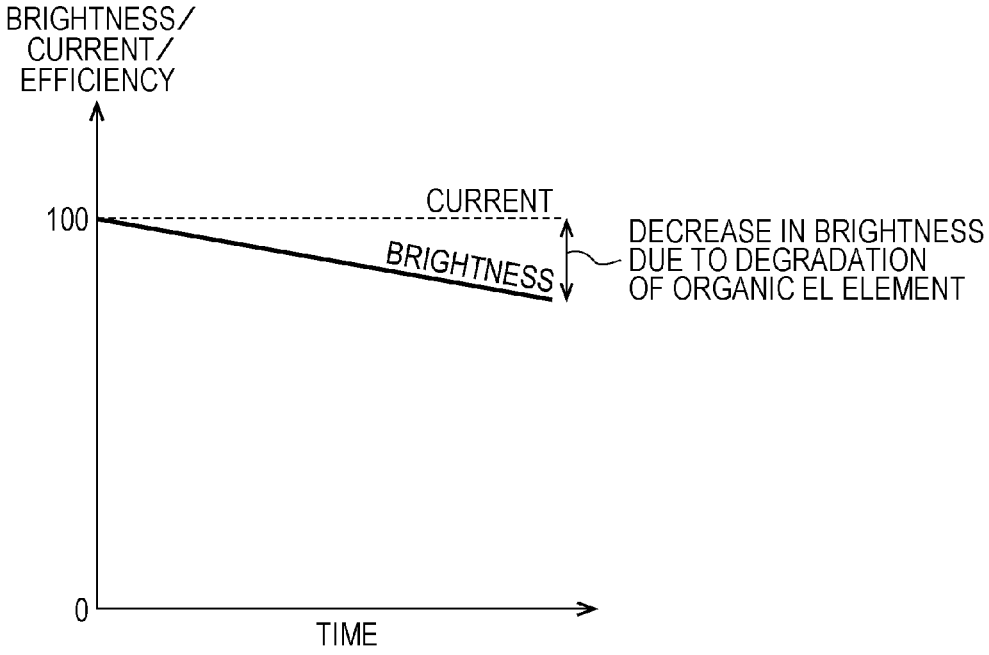

In the configuration illustrated in FIG. 38, the capacitor Cst is disposed between the gate and source of the transistor T2. In this embodiment, in contrast, the capacitor Cst is disposed between the gate and drain of the transistor T2. The reason for this is as follows. In this embodiment, control is performed so that the potential of the monitor line M(j) is varied during a period of one frame while the transistor T3 is kept in the on state. If the capacitor Cst is disposed between the gate and source of the transistor T2, the gate potential of the transistor T2 also varies in accordance with the variation of the potential of the monitor line M(j). Then, the on/off state of the transistor T2 may not be as desired. In this embodiment, accordingly, as illustrated in FIG. 7, the capacitor Cst is disposed between the gate and drain of the transistor T2 so as to prevent the gate potential of the transistor T2 from varying in accordance with the variation of the potential of the monitor line M(j).

<1.2.2 Regarding Transistors in Pixel Circuits>

In this embodiment, all the transistors T1 to T3 in the pixel circuits 11 are of an n-channel type. In this embodiment, furthermore, the transistors T1 to T3 are each implemented as an oxide TFT (a thin-film transistor that employs an oxide semiconductor as a channel layer).

An oxide semiconductor layer included in an oxide TFT will be described hereinafter. The oxide semiconductor layer is, for example, an In—Ga—Zn—O-based semiconductor layer. The oxide semiconductor layer includes, for example, an In—Ga—Zn—O-based semiconductor. The In—Ga—Zn—O-based semiconductor is a ternary oxide of In (indium), Ga (gallium), and Zn (zinc). The ratio (composition ratio) of In to Ga to Zn is not particularly limited. For example, In:Ga:Zn=2:2:1, In:Ga:Zn=1:1:1, In:Ga:Zn=1:1:2, or the like may be employed.

A TFT having an In—Ga—Zn—O-based semiconductor layer has high mobility (mobility that is more than 20 times as high as an amorphous silicon TFT) and low leakage current (leakage current less than one-hundredth of that of an amorphous silicon TFT), and is thus suitable for use as a drive TFT (the transistor T2) and a switching TFT (the transistor T1) in a pixel circuit. The use of a TFT having an In—Ga—Zn—O-based semiconductor layer can significantly reduce the power consumption of a display device.

The In—Ga—Zn—O-based semiconductor may be amorphous, or may include a crystalline portion and have crystallinity. Preferred examples of a crystalline In—Ga—Zn—O-based semiconductor include a crystalline In—Ga—Zn—O-based semiconductor with a c-axis aligned substantially perpendicularly to a surface of the layer. The crystal structure of such an In—Ga—Zn—O-based semiconductor is disclosed in, for example, Japanese Unexamined Patent Application Publication No. 2012-134475.

The oxide semiconductor layer may include any other oxide semiconductor instead of an In—Ga—Zn—O-based semiconductor. The oxide semiconductor layer may include, for example, a Zn—O-based semiconductor (ZnO), an In—Zn—O-based semiconductor (IZO (registered trademark)), a Zn—Ti—O-based semiconductor (ZTO), a Cd—Ge—O-based semiconductor, a Cd—Pb—O-based semiconductor, a CdO (cadnium oxide), a Mg—Zn—O-based semiconductor, an In—Sn—Zn—O-based semiconductor (for example, $In_2O_3$—$SnO_2$—ZnO), an In—Ga—Sn—O-based semiconductor, or the like.

<1.2.3 Current Measurement Circuit>

The detailed configuration of the current measurement circuit 332 will be described with reference to FIG. 7. The current measurement circuit 332 includes an operational amplifier 3321, a capacitor 3322, and a switch 3323. The operational amplifier 3321 has an inverting input terminal connected to the monitor line M(j), and a noninverting input terminal to which the monitor line control voltage Vm is given. The capacitor 3322 and the switch 3323 are disposed between an output terminal of the operational amplifier 3321 and the monitor line M(j). As described above, the current measurement circuit 332 is constituted by an integrating circuit. In this configuration, first, the switch 3323 is brought into the on state by a control clock signal Sclk. This provides a short-circuit between the output terminal and the inverting input terminal of the operational amplifier 3321, making the potential of the output terminal of the operational amplifier 3321 and the potential of the monitor line M(j) equal to the potential of the monitor line control voltage Vm. For the detection of the current, the switch 3323 is brought into the off state by the control clock signal Sclk. Accordingly, the presence of the capacitor 3322 results in the potential of the output terminal of the operational amplifier 3321 changing in accordance with the magnitude of the current flowing through the monitor line M(j). The output of the operational amplifier 3321 is sent to the A/D converter in the signal conversion circuit 32 as monitor data MO.

<1.3 Drive Method>

Next, a drive method according to this embodiment will be described. As described above, in this embodiment, TFT characteristics and OLED characteristics for one row within each frame are detected. In each frame, an operation for detecting TFT characteristics and OLED characteristics (hereinafter referred to as the "characteristics detection operation") is performed for the monitored row, whereas a normal operation is performed for the unmonitored rows. That is, if a frame in which the TFT characteristics and the OLED characteristics for the first row are detected is defined as the (k+1)-th frame, the operation for the respective rows transitions in a manner illustrated in FIG. 8. Further, once the TFT characteristics and the OLED characteristics are detected, the correction data in the correction data storage unit 50 is updated using the detection result. Then, a video signal is corrected by using the correction data stored in the correction data storage unit 50.

<1.3.1 Operation of Pixel Circuit>

<1.3.1.1 Normal Operation>

Figure 9:
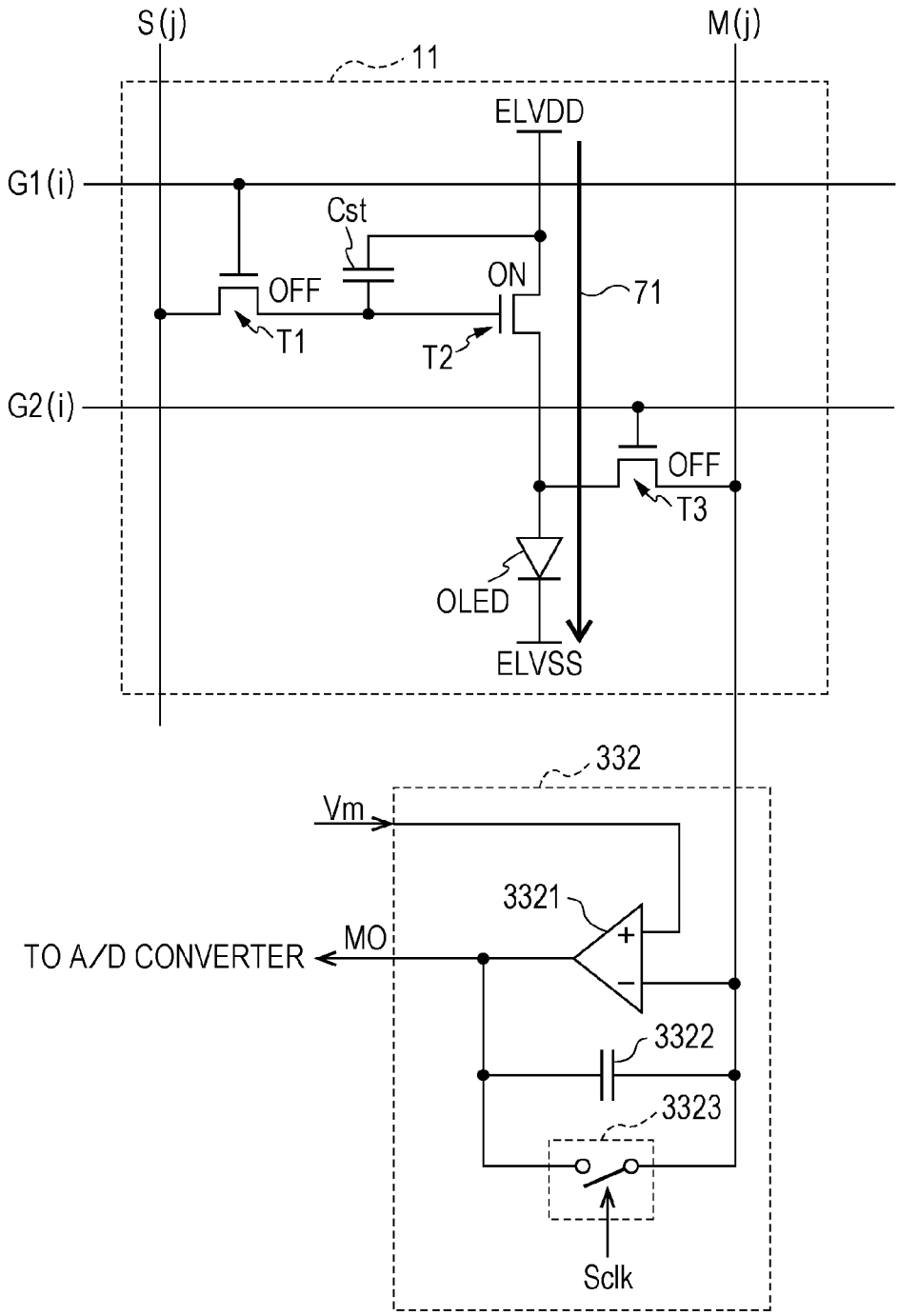
FIG. 9 is a diagram describing the current flow when a normal operation is performed according to the first embodiment.

In each frame, the normal operation is performed for the unmonitored rows. In each of the pixel circuits 11 included in the unmonitored rows, the transistor T1 is maintained in the off state after the writing based on the data voltage corresponding to the target brightness has been performed within the selection period. Through the writing based on the data voltage, the transistor T2 is brought into the on state. The transistor T3 is maintained in the off state. Therefore, the drive current is supplied to the organic EL element OLED via the transistor T2, as indicated by an arrow denoted by symbol 71 in FIG. 9. Accordingly, the organic EL element OLED emits light at the brightness corresponding to the drive current.

<1.3.1.2 Characteristics Detection Operation>

Figure 10:
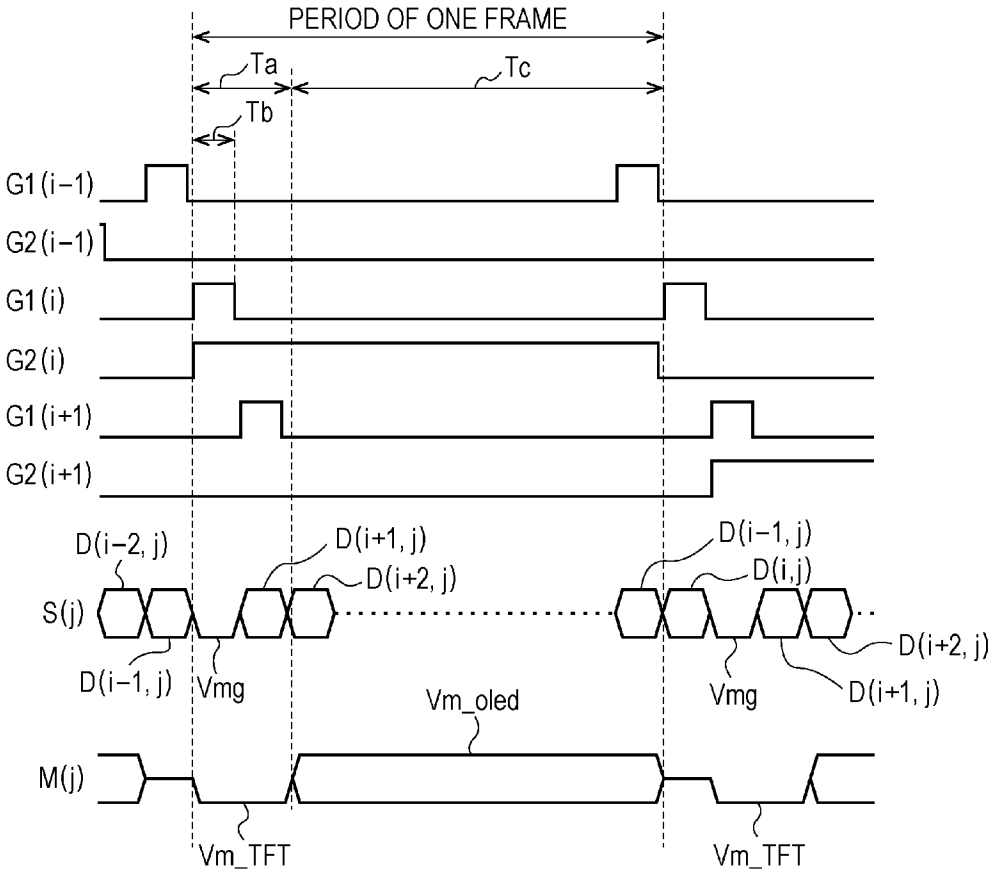
FIG. 10 is a timing chart describing the operation of a pixel circuit (a pixel circuit in the i-th row and j-th column) included in a monitored row according to the first embodiment.

In each frame, the characteristics detection operation is performed for the monitored row. FIG. 10 is a timing chart describing the operation of a pixel circuit 11 (assumed to be the pixel circuit 11 in the i-th row and j-th column) included in the monitored row. In FIG. 10, the "period of one frame" is expressed using, as a reference, the point in time when the selection period for the i-th row begins within a frame in which the i-th row is the monitored row. For the monitored row, as illustrated in FIG. 10, the period of one frame includes a period for detecting TFT characteristics (hereinafter referred to as the "TFT characteristics detection period") Ta, and a period for causing the organic EL element OLED to emit light (hereinafter referred to as the "light emission period") Tc. The first half of the TFT characteristics detection period Ta is a selection period Tb. The length of the selection period Tb is equal for the unmonitored rows and the monitored row.

In the first half (the selection period Tb) of the TFT characteristics detection period Ta, the scanning line G1(*i*) and the monitor control line G2(*i*) are set to the active state. Accordingly, the transistor T1 and the transistor T3 are brought into the on state. During this period, furthermore, a potential Vmg is given to the data line S(j), and a potential Vm_TFT is given to the monitor line M(j). A potential Vm_oled is given to the monitor line M(j) during the light emission period Tc described below.

Here, if a threshold voltage of the transistor T2 determined based on the offset values stored in the TFT offset memory 51*a* is represented by Vth(T2), the value of the potential Vmg, the value of the potential Vm_TFT, and the value of the potential Vm_oled are set so that Expressions (1) and (2) below hold.

$$Vm_\mathrm{TFT}+V\mathrm{th}(T2)<Vmg \quad (1)$$

$$Vmg<Vm_\mathrm{oled}+V\mathrm{th}(T2) \quad (2)$$

In addition, if a light emission threshold voltage of the organic EL element OLED determined based on the offset values stored in the OLED offset memory 51*b* is represented by Vth(oled), the value of the potential Vm_TFT is set so that Expression (3) below holds.

$$Vm_\mathrm{TFT}<ELVSS+V\mathrm{th}(\mathrm{oled}) \quad (3)$$

Furthermore, if a breakdown voltage of the organic EL element OLED is represented by Vbr(oled), the value of the potential Vm_TFT is set so that Expression (4) below holds.

$$Vm_\mathrm{TFT}>ELVSS-V\mathrm{br}(\mathrm{oled}) \quad (4)$$

As described above, in the first half (the selection period Tb) of the TFT characteristics detection period Ta, the potential Vmg satisfying Expressions (1) and (2) above is given to the data line S(j), and the potential Vm_TFT satisfying Expressions (1), (3), and (4) above is given to the monitor line M(j). From Expression (1) above, the transistor T2 is set to the on state during this period. Further, from Expressions (3) and (4) above, no current flows through the organic EL element OLED during this period.

In the second half of the TFT characteristics detection period Ta, the scanning line G1(*i*) is set to the inactive state. Accordingly, the transistor T1 is brought into the off state. On the other hand, the transistor T2 is maintained in the on state since the capacitor Cst is charged during the selection period Tb. The transistor T3 is also maintained in the on state since the monitor control line G2(*i*) is maintained in the active state. The potential Vm_TFT satisfying Expressions (1), (3), and (4) above is given to the monitor line M(j).

Figure 11:
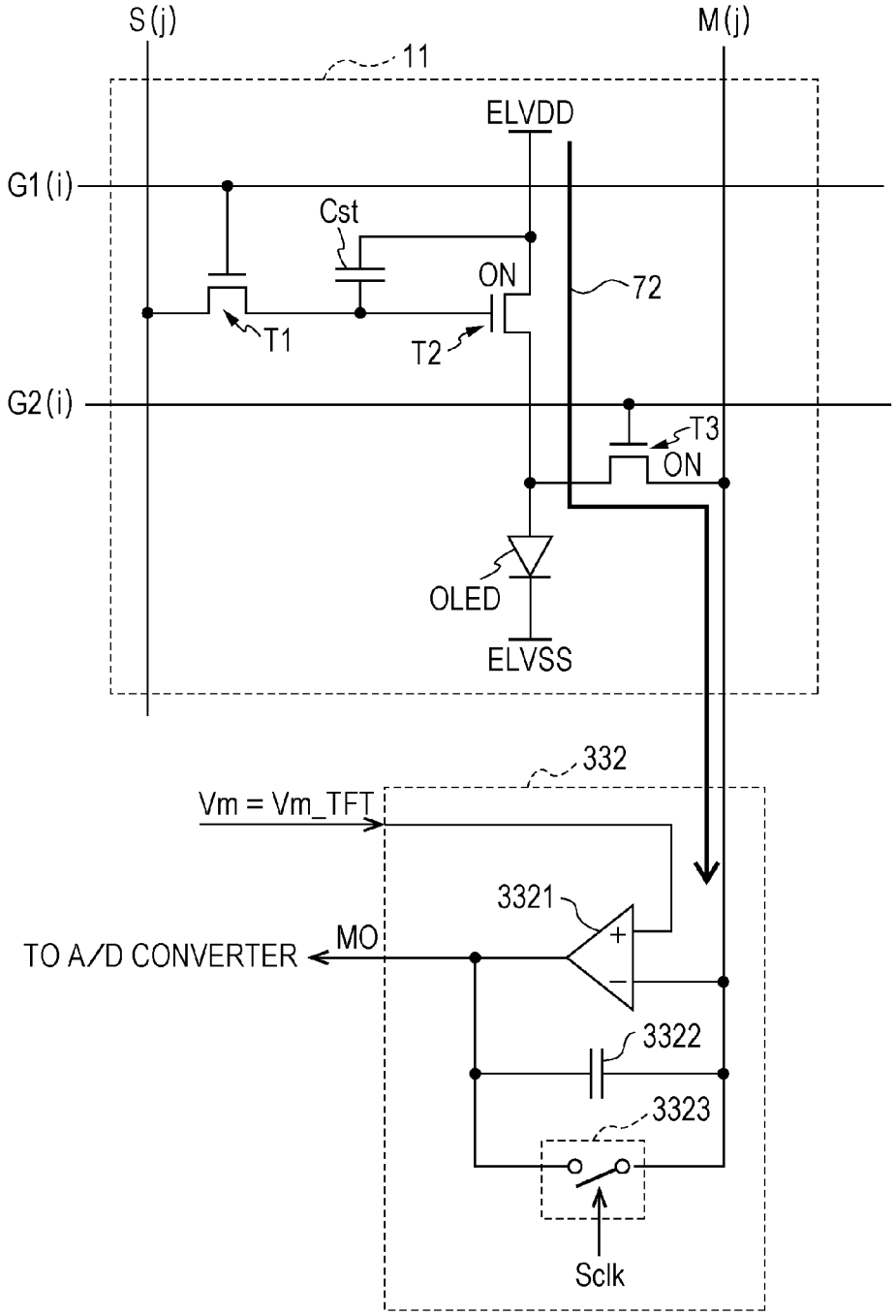
FIG. 11 is a diagram describing the current flow during a TFT characteristics detection period according to the first embodiment.

Therefore, during the TFT characteristics detection period Ta, the current flowing through the transistor T2 is output to the monitor line M(j) through the transistor T3, as indicated by an arrow denoted by symbol 72 in FIG. 11. Accordingly, the current (sink current) output to the monitor line M(j) is measured by the current measurement circuit 332. In the way described above, the magnitude of the current flowing between the drain and source of the transistor T2 is measured with the voltage between the gate and source of the transistor T2 being set to a predetermined magnitude (Vmg−Vm_TFT), and the TFT characteristics are detected.

Figure 12:
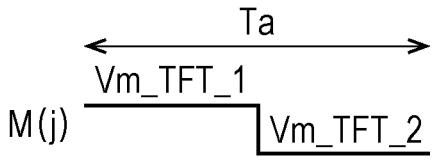
FIG. 12 is a diagram describing potentials applied to a monitor line during the TFT characteristics detection period according to the first embodiment.

Incidentally, in this embodiment, as illustrated in FIG. 12, two types of potentials (a first reference potential Vm_TFT_1 and a second reference potential Vm_TFT_2) are applied to the monitor line M(j) during the TFT characteristics detection period Ta. Accordingly, the TFT characteristics based on the first reference potential Vm_TFT_1 and the TFT characteristics based on the second reference potential Vm_TFT_2 are detected.

During the light emission period Tc, the scanning line G1(*i*) is maintained in the inactive state and the monitor control line G2(*i*) is maintained in the active state. During this period, accordingly, the transistor T1 is maintained in the off state and the transistor T3 is maintained in the on state. In addition, as described above, the potential Vm_oled is given to the monitor line M(j) during this period.

Here, the value of the potential Vm_oled is set so that Expression (2) above and Expression (5) below hold.

$$ELVSS+V\mathrm{th}(\mathrm{oled})<Vm_\mathrm{oled} \quad (5)$$

In addition, if a breakdown voltage of the transistor T2 is represented by Vbr(T2), the value of the potential Vm_oled is set so that Expression (6) below holds.

$$Vm_oled < Vmg + Vbr(T2) \quad (6)$$

As described above, the potential Vm_oled satisfying Expressions (2), (5), and (6) above is given to the monitor line M(j) during the light emission period Tc. From Expressions (2) and (6) above, the transistor T2 is brought into the off state during this period. Further, from Expression (5) above, a current flows through the organic EL element OLED during this period.

Figure 13:
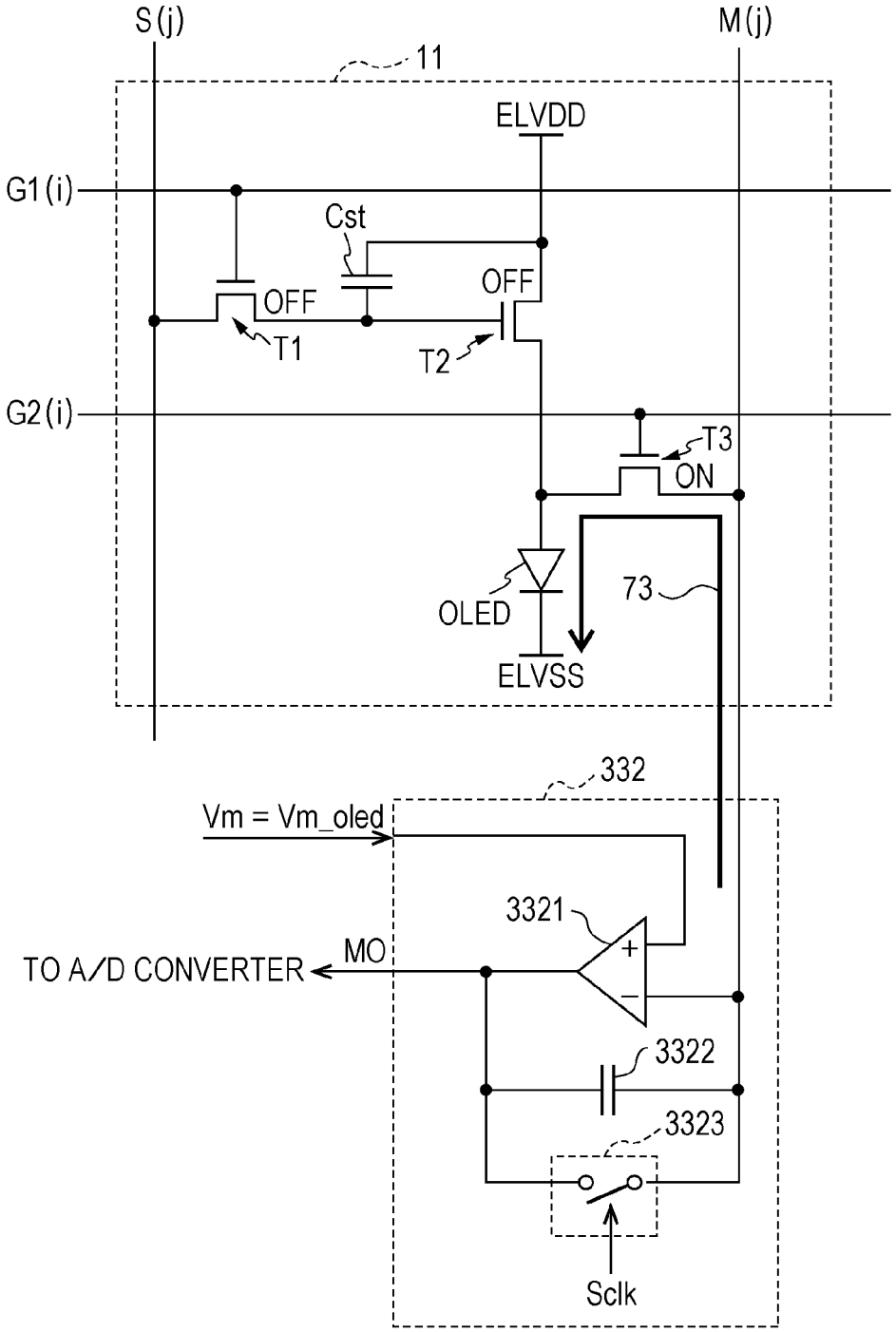
FIG. 13 is a diagram describing the current flow during a light emission period according to the first embodiment.

Therefore, during the light emission period Tc, the current flows from the monitor line M(j) to the organic EL element OLED as indicated by an arrow denoted by symbol 73 in FIG. 13, and the organic EL element OLED emits light. In this state, the current flowing through the monitor line M(j) is measured by the current measurement circuit 332. In the way described above, the magnitude of the current flowing through the organic EL element OLED is measured with the voltage between the anode (positive electrode) and cathode (negative electrode) of the organic EL element OLED being set to a predetermined magnitude (Vm_oled−ELVSS), and the OLED characteristics are detected.

The value of the potential Vmg, the value of the potential Vm_TFT, and the value of the potential Vm_oled are determined in accordance with Expressions (1) to (6) above and also by taking into account, for example, the measurable range of the current measurement circuit 332 which is adopted.

Figure 14:
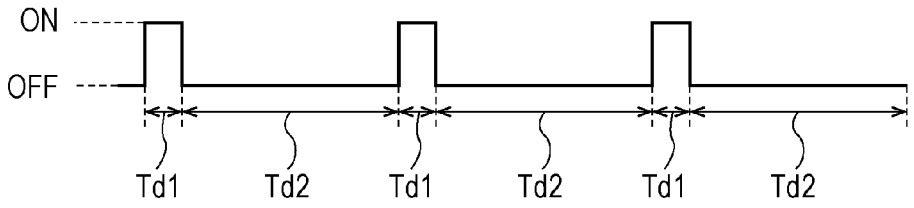
FIG. 14 is a diagram describing a change in the on/off state of a switch in the current measurement circuit according to the first embodiment.

A change in the on/off state of the switch 3323 in the current measurement circuit 332 will now be described with reference to FIG. 14. When the switch 3323 is switched from the off state to the on state, the charge accumulated in the capacitor 3322 is discharged. That is, the charge in the capacitor 3322 is zero during periods indicated by symbol Td1 in FIG. 14. When the switch 3323 is switched from the on state to the off state, the charging to the capacitor 3322 is started. Then, the circuit in the current measurement circuit 332 operates as an integrating circuit. The switch 3323 is maintained in the on state within a period during which the current flowing through the monitor line M is to be measured. In the example illustrated in FIG. 14, the total value of the current flow during periods indicated by symbol Td2 can be determined.

Figure 15:
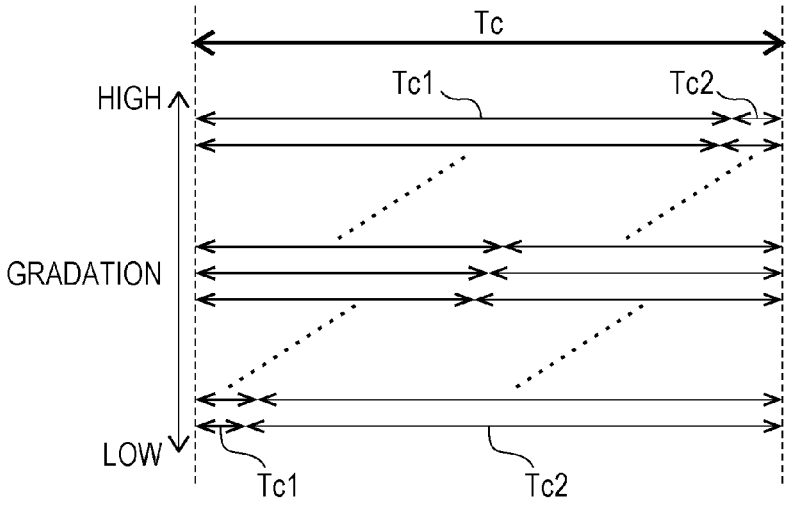
FIG. 15 is a diagram describing the adjustment of the time period for light emission of an organic EL element according to the first embodiment.

Incidentally, during the light emission period Tc, a current is supplied to the organic EL elements OLED for the monitored row on the basis of a constant voltage. In this embodiment, accordingly, the length of the time period during which an organic EL element OLED emits light is adjusted to achieve the desired gradation display. Specifically, the higher the gradation, the longer the time period for light emission is set to be, and the lower the gradation, the shorter the time period for light emission is set to be. That is, as illustrated in FIG. 15, a period Tc1 during which the illumination state is actually maintained is set to be longer for higher gradation, and a period Tc2 during which the non-illumination state is maintained is set to be shorter for lower gradation. In this case, the lengths of the periods Tc1 and Tc2 are adjusted on the basis of the degradation correction coefficients stored in the OLED gain memory 52*b*. As described above, for the detection of the OLED characteristics in the monitored row, the states (illumination state/non-illumination state) of the organic EL elements OLED are switched in a time-controlled manner. In order to bring the organic EL element OLED into the non-illumination state, it may be sufficient that the potential (the monitor line control voltage Vm) of the monitor line M(j) be set so that the voltage to be applied to the organic EL element OLED is smaller than the light emission threshold voltage Vth (oled). For example, it may be sufficient that the potential of the monitor line M(j) be equal to the potential of the low-level power supply voltage ELVSS. As described above, the length of the time period during which the organic EL element OLED emits light is adjusted so that the integral value of light emission current within a period of one frame becomes equal to the value corresponding to the desired gradation. In other words, the length of the time period during which the constant voltage is given to the organic EL element OLED is adjusted in accordance with the target brightness. Note that the value of the voltage may be changed during the light emission period Tc so that properties at a plurality of operating points (current-voltage characteristics) are measured so long as the integral value of light emission current within a period of one frame becomes equal to the value corresponding to the desired gradation.

It is preferable that OLED characteristics not be detected when the target gradation is equal to or close to gradation corresponding to black display or similar gradation. That is, it is preferable that OLED characteristics not be detected for a pixel displayed in black or substantially in black within a pixel matrix of n rows and m columns. This can prevent unwanted light emission. Since the organic EL element OLED does not degrade while not emitting light, there is no need to detect characteristics.

In addition, the same row over a plurality of frames may be used as the monitored row. In the way described above, a characteristics detection process is performed repeatedly for a single row, thereby achieving the advantage of improvements in S/N ratio.

<1.3.2 Update of Correction Data in Correction Data Storage Unit>

Figure 16:
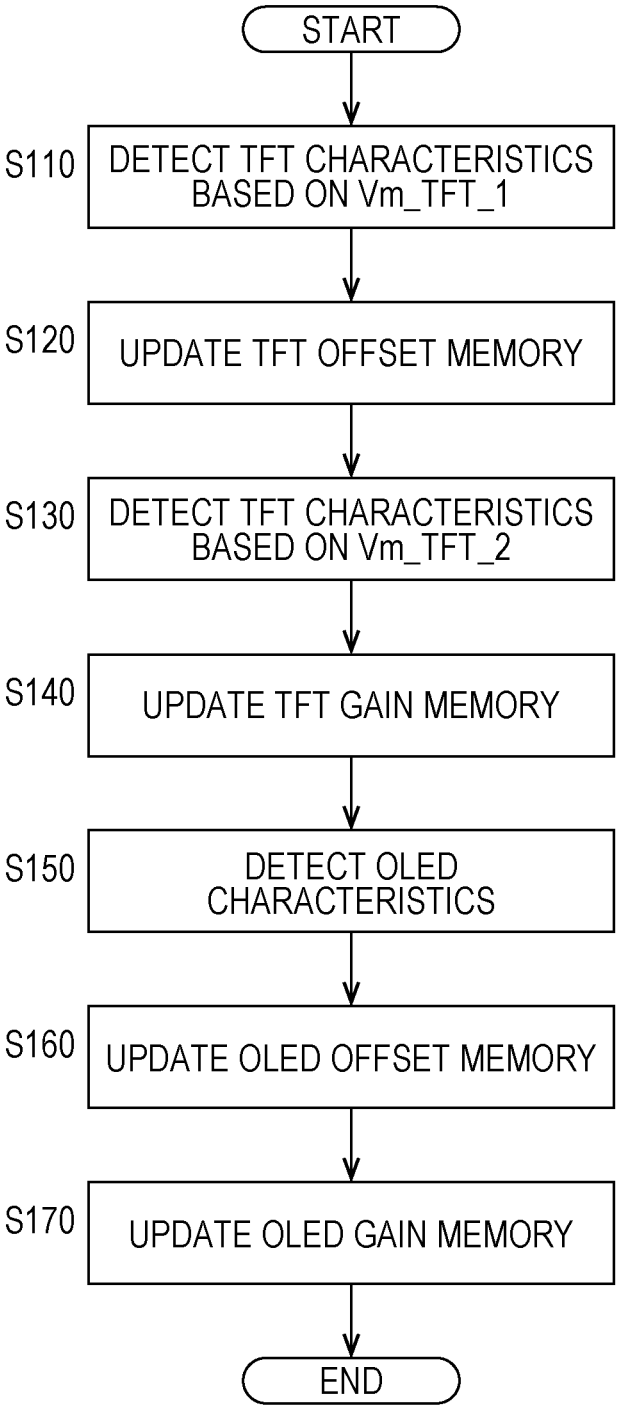
FIG. 16 is a flowchart describing a procedure for updating correction data in a correction data storage unit according to the first embodiment.

Next, how the correction data stored in the correction data storage unit 50 (the offset values stored in TFT offset memory 51*a*, the offset values stored in the OLED offset memory 51*b*, the gain values stored in the TFT gain memory 52*a*, and the degradation correction coefficients stored in the OLED gain memory 52*b*) is updated will be described. FIG. 16 is a flowchart describing a procedure for updating the correction data in the correction data storage unit 50. Here, the focus is on correction data corresponding to one pixel.

When the TFT characteristics detection period Ta is reached, the TFT characteristics are detected with the first reference potential Vm_TFT_1 being given to the monitor line M (step S110). Through step S110, an offset value for correcting a video signal is determined. Then, the offset value determined in step S110 is stored in the TFT offset memory 51*a* as a new offset value (step S120). Thereafter, the TFT characteristics are detected with the second reference potential Vm_TFT_2 being given to the monitor line M (step S130). Through step S130, a gain value for correcting the video signal is determined. Then, the gain value determined in step S130 is stored in the TFT gain memory 52*a* as a new gain value (step S140). Thereafter, the OLED characteristics are detected during the light emission period Tc (step S150). Through step S150, an offset value and a degradation correction coefficient for correcting the video signal are determined. Then, the offset value determined in step S150 is stored in the OLED offset memory 51*b* as a new offset value (step S160). Further, the degradation correction coefficient determined in step S150 is stored in the OLED gain memory 52*b* as a new degradation correction coefficient (step S170). In the way described above, correction data corresponding to one pixel is updated. In this embodiment, TFT characteristics and OLED characteristics for one row within each frame are detected. Thus, m offset values in the TFT offset memory 51*a*, *m* gain values in the TFT gain memory 52*a*, *m* offset values in the OLED offset memory 51*b*, and m degradation correction coefficients in the OLED gain memory 52*b* are updated per period of one frame.

In this embodiment, characteristics data is implemented using the data (the offset value, the gain value, and the degradation correction coefficient) obtained on the basis of the detection results in step S110, step S130, and step S150.

Incidentally, as described above, the magnitude of the current flowing through the organic EL element OLED is measured on the basis of the constant voltage during the light emission period Tc. The smaller the detected current obtained as a result of the measurement, the greater the level of degradation of the organic EL element OLED. Accordingly, the data in the OLED offset memory 51*b* and the data in the OLED gain memory 52*b* are updated so that the smaller the detected current is, the larger the offset value becomes and the larger the degradation correction coefficient becomes.

<1.3.3 Correction of Video Signal>

In this embodiment, a video signal sent from outside is corrected by using the correction data stored in the correction data storage unit 50 in order to compensate for the degradation of the drive transistor and the degradation of the organic EL element OLED. The correction of a video signal will be described hereinafter with reference to FIG. 17.

Figure 17:
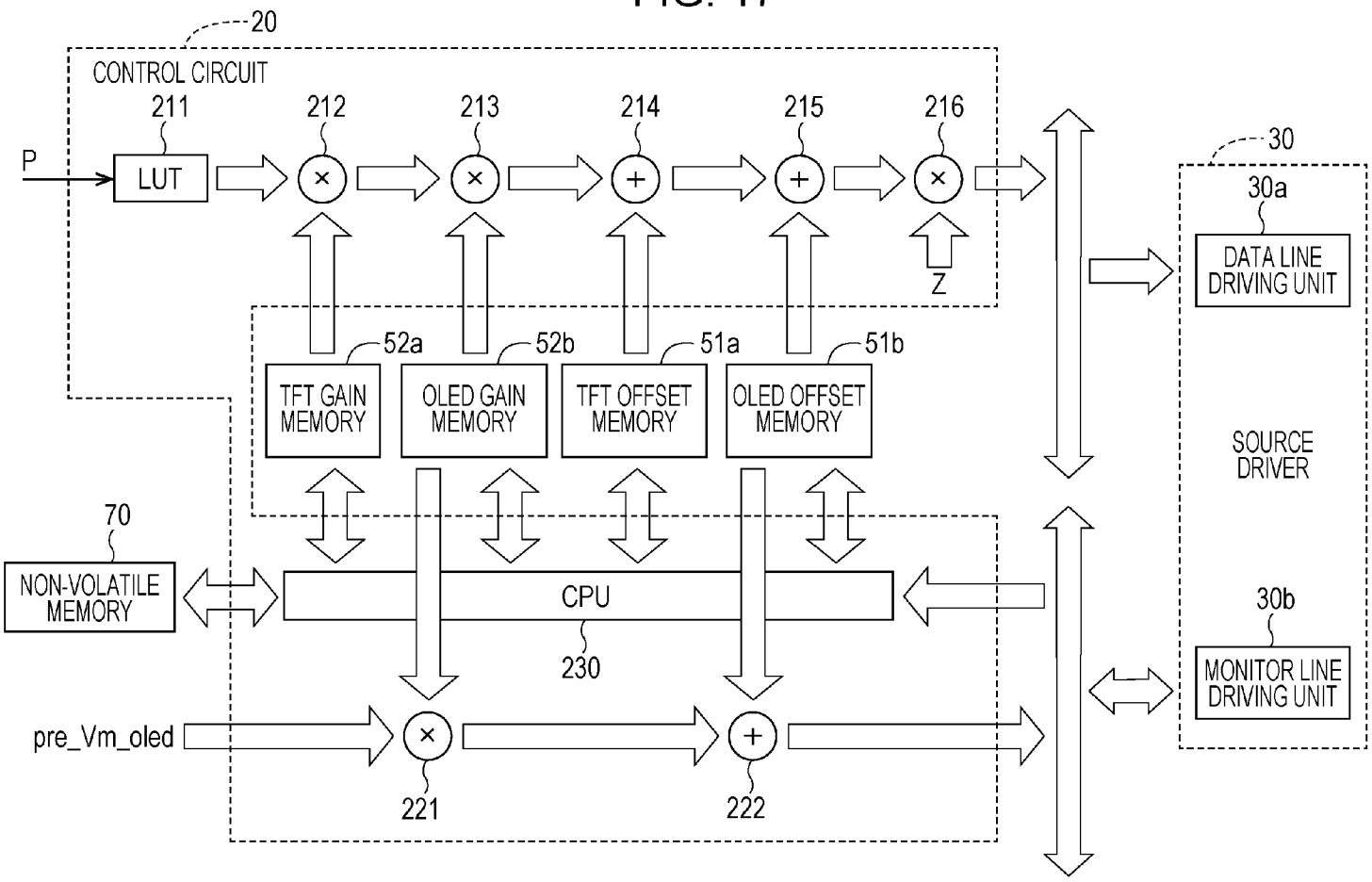
FIG. 17 is a diagram describing the correction of a video signal according to the first embodiment.

As illustrated in FIG. 17, the control circuit 20 includes, as constituent elements for correcting the video signal, a LUT 211, a multiplier unit 212, a multiplier unit 213, an adder unit 214, an adder unit 215, and a multiplier unit 216. The control circuit 20 further includes a multiplier unit 221 and an adder unit 222 as constituent elements for correcting the potential Vm_oled to be given to the monitor line M during the light emission period Tc. A CPU 230 in the control circuit 20 performs operations such as controlling the operation of the constituent elements described above, updating/reading the data in the respective memories (the TFT offset memory 51*a*, the TFT gain memory 52*a*, the OLED offset memory 51*b*, and the OLED gain memory 52*b*) in the correction data storage unit 50, updating/reading data in a non-volatile memory 70, and exchanging data with the data line driving circuit 30*a* or the monitor line driving circuit 30*b*. In this embodiment, the LUT 211, the multiplier unit 212, the multiplier unit 213, the adder unit 214, the adder unit 215, and the multiplier unit 216 implement a video signal correction unit.

In the configuration described above, a video signal sent from outside is corrected as follows. The video signal sent from outside is first subjected to gamma correction by using the LUT 211. That is, gradation P indicated by the video signal is converted into a control voltage Vc through gamma correction. The multiplier unit 212 receives the control voltage Vc and a gain value B1 read from the TFT gain memory 52*a*, and outputs a value "Vc·B1" obtained by multiplying them. The multiplier unit 213 receives the value "Vc·B1" output from the multiplier unit 212 and a degradation correction coefficient B2 read from the OLED gain memory 52*b*, and outputs a value "Vc·B1·B2" obtained by multiplying them. The adder unit 214 receives the value "Vc·B1·B2" output from the multiplier unit 213 and an offset value Vt1 read from the TFT offset memory 51*a*, and outputs a value "Vc·B1·B2+Vt1" obtained by adding them together. The adder unit 215 receives the value "Vc·B1·B2+Vt1" output from the adder unit 214 and an offset value Vt2 read from the OLED offset memory 51*b*, and outputs a value "Vc·B1·B2+Vt1+Vt2" obtained by adding them together. The multiplier unit 216 receives the value "Vc·B1·B2+Vt1+Vt2" output from the adder unit 215 and a coefficient Z for compensating for the attenuation of a data voltage caused by the parasitic capacitance of the pixel circuit 11, and outputs a value "Z(Vc·B1·B2+Vt1+Vt2)" obtained by multiplying them. The value "Z(Vc·B1·B2+Vt1+Vt2)" obtained in the way described above is sent from the control circuit 20 to the data line driving unit 30*a* in the source driver 30 as a data signal DA. The multiplier unit 216 that performs a process for multiplying the value output from the adder unit 215 by the coefficient Z for compensating for the attenuation of the data voltage may not necessarily be included.

Further, the potential Vm_oled to be given to the monitor line M during the light emission period Tc is corrected as follows. The multiplier unit 221 receives pre_Vm_oled (Vm_oled before correction) and the degradation correction coefficient B2 read from the OLED gain memory 52*b*, and outputs a value "pre_Vm_oled·B2" obtained by multiplying them. The adder unit 222 receives the value "pre_Vm_oled·B2" output from the multiplier unit 221 and the offset value Vt2 read from the OLED offset memory 51*b*, and outputs a value "pre_Vm_oled·B2+Vt2" obtained by adding them together. The value "pre_Vm_oled·B2+Vt2" obtained in the way described above is sent from the control circuit 20 to the monitor line driving unit 30*b* in the source driver 30 as data for specifying the potential Vm_oled of the monitor line M within the light emission period Tc.

<1.3.4 Summary of Drive Method>

Figure 1:
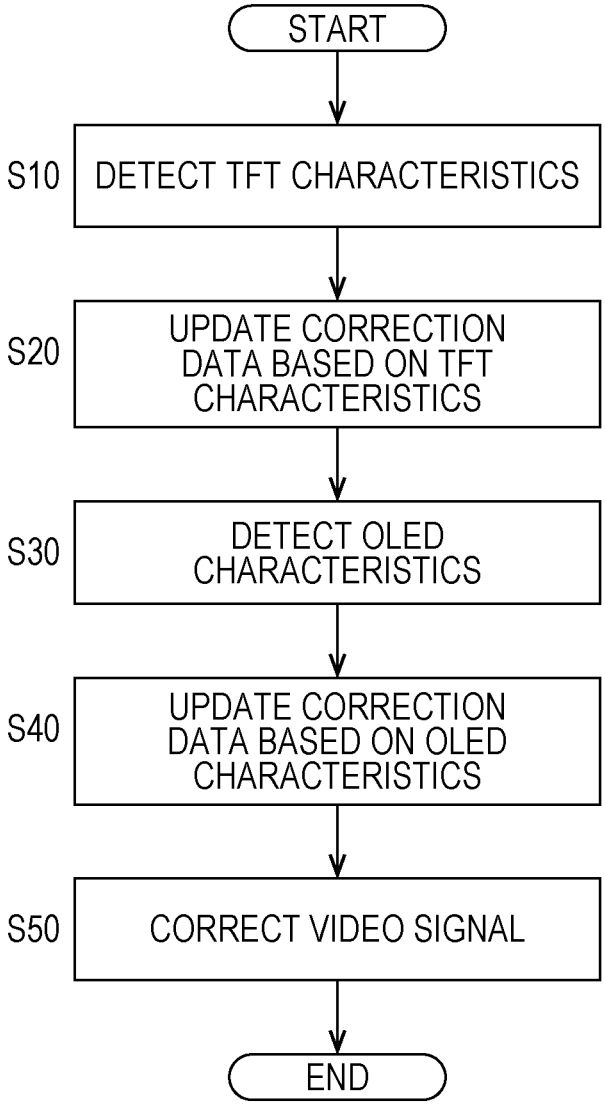
FIG. 1 is a flowchart describing an overview of an operation for the detection of TFT characteristics and OLED characteristics according to a first embodiment.

FIG. 1 is a flowchart describing an overview of an operation for the detection of TFT characteristics and OLED characteristics. First, the TFT characteristics for the monitored row are detected during the TFT characteristics detection period Ta (step S10). Then, the TFT offset memory 51*a* and the TFT gain memory 52*a* are updated by using the detection result in step S10 (step S20). Then, the OLED characteristics for the monitored row are detected during the light emission period Tc (step S30). Then, the OLED offset memory 51*b* and the OLED gain memory 52*b* are updated by using the detection result in step S30 (step S40). Thereafter, a video signal sent from outside is corrected by using the correction data stored in the TFT offset memory 51*a*, the TFT gain memory 52*a*, the OLED offset memory 51*b*, and the OLED gain memory 52*b* (step S50).

In this embodiment, step S10 implements a drive transistor characteristics detecting step, step S30 implements an electro-optical element characteristics detecting step, step S20 and step S40 implement a correction data storing step, and step S50 implements a video signal correcting step. Further, the process of step S10 implements a drive transistor characteristics detection process, and the process of step S30 implements an electro-optical element characteristics detection process.

1.4 Advantages

Figure 18:
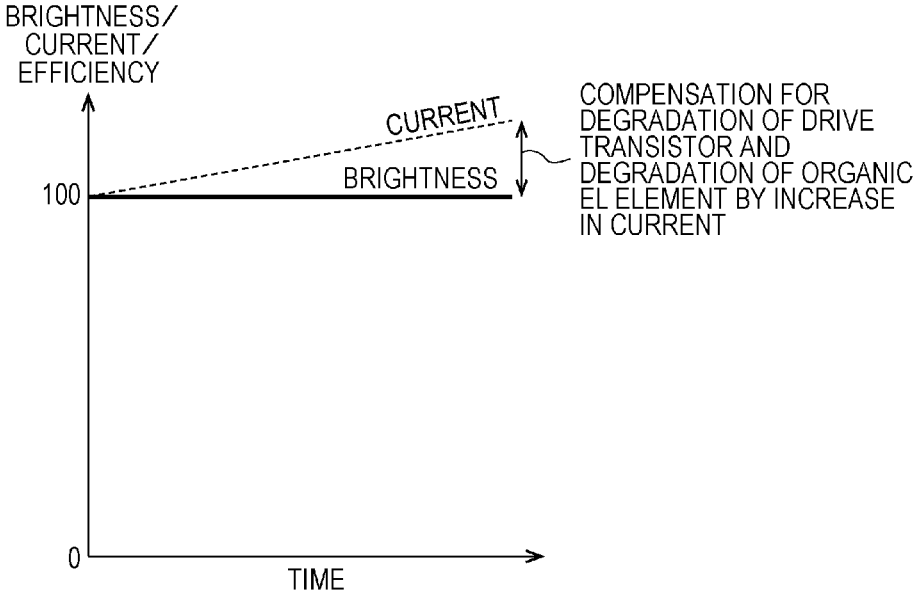
FIG. 18 is a diagram describing advantages achievable in the first embodiment.
Figure 19:
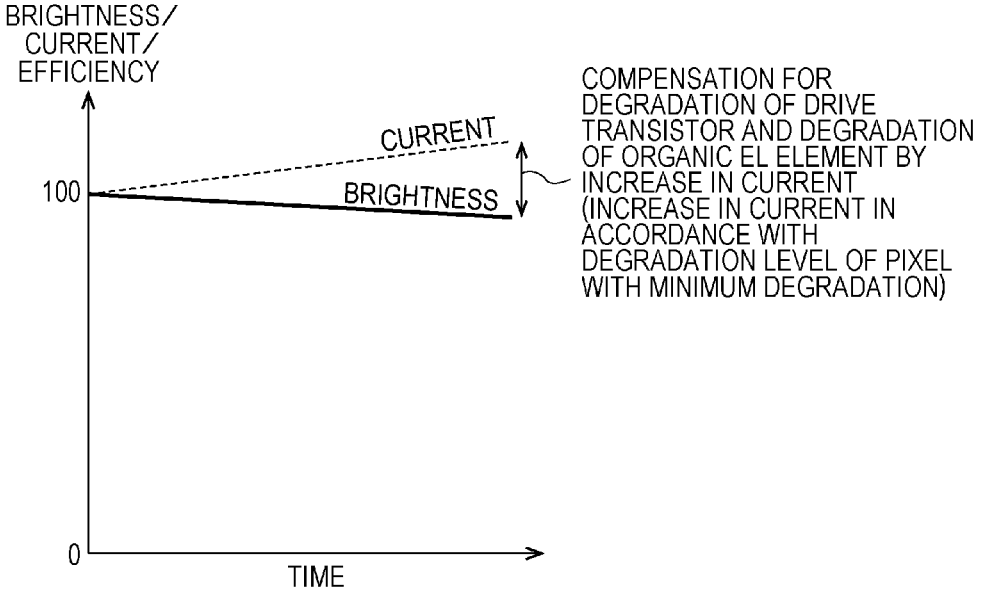
FIG. 19 is a diagram describing advantages achievable in the first embodiment.

According to this embodiment, TFT characteristics and OLED characteristics for one row within each frame are detected. When the focus is on the monitored row, in a period of one frame, the TFT characteristics are detected during the TFT characteristics detection period Ta including the selection period Tb, and the OLED characteristics are detected during the light emission period Tc. Then, a video signal sent from outside is corrected by using correction data determined by taking into account both the result of detection of the TFT characteristics and the result of detection of the OLED characteristics. A data voltage based on the video signal (the data signal DA) corrected in the way described above is applied to the data line S. Accordingly, when the organic EL element OLED in each of the pixel circuits 11 is to be caused to emit light, a drive current having a magnitude that allows the degradation of the drive transistor (the transistor T2) and the degradation of the organic EL element OLED to be compensated for is supplied to the organic EL element OLED (see FIG. 18). In addition, as illustrated in FIG. 19, an increase in current in accordance with the degradation level of a pixel with minimum degradation enables compensation for burn-in. Here, as described above, the OLED characteristics are detected during the light emission period Tc. Accordingly, the length of a light emission period is not shorter than the previous one in order to detect TFT characteristics or OLED characteristics.

According to this embodiment, furthermore, the on/off states of the transistors T2 are switched by changing the potential of the monitor line M. For this reason, there is no need to provide a period for changing the gate potential of a transistor T2 between the TFT characteristics detection period Ta and the light emission period Tc in order to switch the on/off state of the transistor T2. Furthermore, the length of the selection period Tb is equal for the monitored row and the unmonitored rows. Therefore, it is possible to ensure a sufficient length of a period for the detection of TFT characteristics and OLED characteristics without increasing the complexity of the configuration of the gate driver 40. This can increase the accuracy of detection of characteristics. As described above, an organic EL display device is provided which enables sufficient compensation for both the degradation of a drive transistor (a transistor T2) and the degradation of an organic EL element OLED while ensuring a sufficient amount of time for the detection of the characteristics of the drive transistor (the transistor T2) and the organic EL element OLED.

In this embodiment, furthermore, since the transistors T1 to T3 in the pixel circuits 11 each adopt an oxide TFT (specifically, a TFT having an In—Ga—Zn—O-based semiconductor layer), the advantage of ensuring a sufficient S/N ratio is achievable. This will be described hereinafter. A TFT having an In—Ga—Zn—O-based semiconductor layer is here referred to as an "In—Ga—Zn—O-TFT". Regarding comparison between an In—Ga—Zn—O-TFT and an LTPS (Low Temperature Poly silicon)-TFT, the In—Ga—Zn—O-TFT has a significantly lower off-current than the LTPS-TFT. For instance, when the transistors T3 in the pixel circuits 11 each employ an LIPS-TFT, the off-current has a maximum of approximately 1 pA. In contrast, when the transistors T3 in the pixel circuits 11 each employ an In—Ga—Zn—O-TFT, the off-current has a maximum of approximately 10 fA. Accordingly, for example, the off-current for 1000 rows has a maximum of approximately 1 nA when LIPS-TFTs are employed, and has a maximum of approximately 10 pA when In—Ga—Zn—O-TFTs are employed. The detected current is approximately 10 to 100 nA regardless of which type is employed. Incidentally, the monitor lines M are connected to the pixel circuits 11 in the monitored row and are also connected to the pixel circuits 11 in the unmonitored rows. Accordingly, the S/N ratio for the monitor lines M depends on the total leakage current in the transistors T3 in the unmonitored rows. Specifically, the S/N ratio for the monitor lines M is expressed by "detected current/(leakage current X the number of unmonitored rows)". Hence, for example, an organic EL display device having a "Landscape FHD" display unit 10 has an S/N ratio of approximately 10 when LIPS-TFTs are employed, and has an S/N ratio of approximately 1000 when In—Ga—Zn—O-TFTs are employed. Accordingly, this embodiment can ensure a sufficient S/N ratio for the detection of the current.

1.5 Modifications

Modifications of the first embodiment will be described hereinafter. In the following, only portions different from those of the first embodiment are described in detail while portions similar to those of the first embodiment are not described.

<1.5.1 First Modification>

Figure 20:
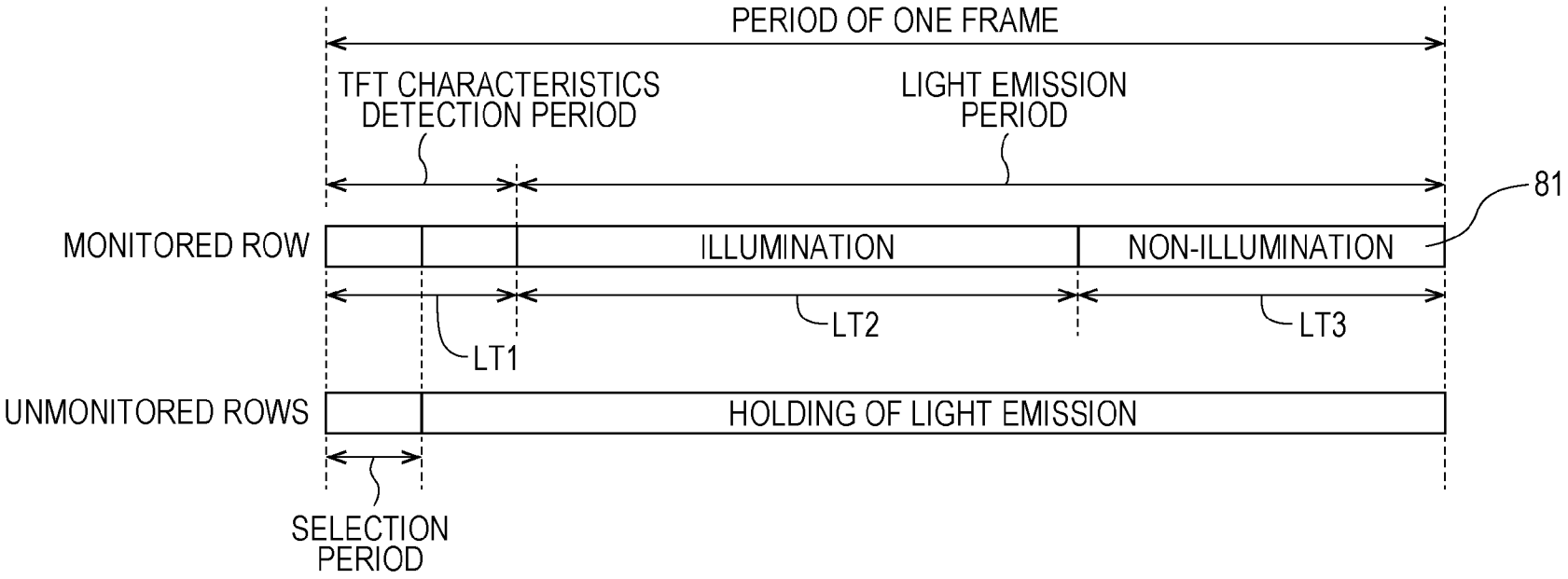
FIG. 20 is a diagram describing the switching of the state (illumination state/non-illumination state) of an organic EL element in a pixel to be displayed in intermediate gradation.

In the first embodiment, the detection of the OLED characteristics for the monitored row involves the switching of the states (illumination state/non-illumination state) of the organic EL elements OLED in a time-controlled manner. For this reason, for example, like a period indicated by symbol 81 in FIG. 20, a period during which the organic EL element OLED is in the non-illumination state is produced for a pixel to be displayed in intermediate gradation. In this modification, a period during which TFT characteristics are detected is lengthened by an amount equal to a period during which the organic EL element OLED is in the non-illumination state. In FIG. 20, the length of the original TFT characteristics detection period Ta is represented by symbol LT1, the length of a period during which the organic EL element OLED is in the illumination state within the light emission period Tc is represented by symbol LT2, and the length of a period during which the organic EL element OLED is in the non-illumination state within the light emission period Tc is represented by symbol LT3.

Figure 21:
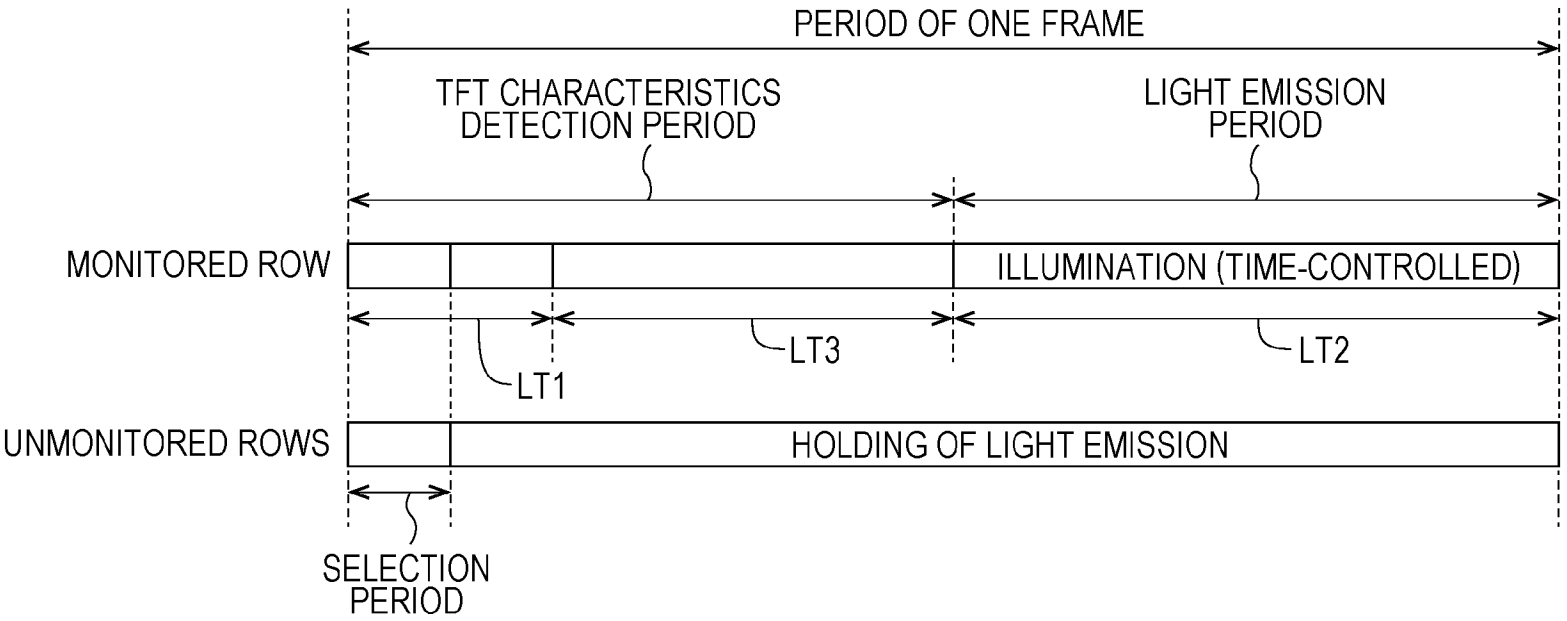
FIG. 21 is a diagram describing a period of one frame according to a first modification of the first embodiment.

FIG. 21 is a diagram describing a period of one frame according to this modification. In this modification, for the monitored row, the length of a light emission period is determined in accordance with the gradation of the pixels and a period excluding the light emission period within the period of one frame is used as a TFT characteristics detection period. The length of the TFT characteristics detection period according to this modification is equal to the sum of the length LT1 of the TFT characteristics detection period in FIG. 20 and the length LT3 of the period during which the organic EL element OLED is in the non-illumination state in FIG. 20.

As described above, according to this modification, it is possible to use a period during which an organic EL element OLED is in the non-illumination state as a period for detecting TFT characteristics. This makes it possible to measure current more times within the TFT characteristics detection period. Accordingly, the S/N ratio of the detected current is increased, resulting in an improvement in the accuracy of detection of TFT characteristics.

<1.5.2 Second Modification>

In the first embodiment, as illustrated in FIG. 7, the monitor line M is always electrically connected to the current measurement circuit 332. However, the present invention is not limited thereto, and a configuration (the configuration of this modification) that enables the monitor line M to be set to a high-impedance state can also be employed.

Figure 22:
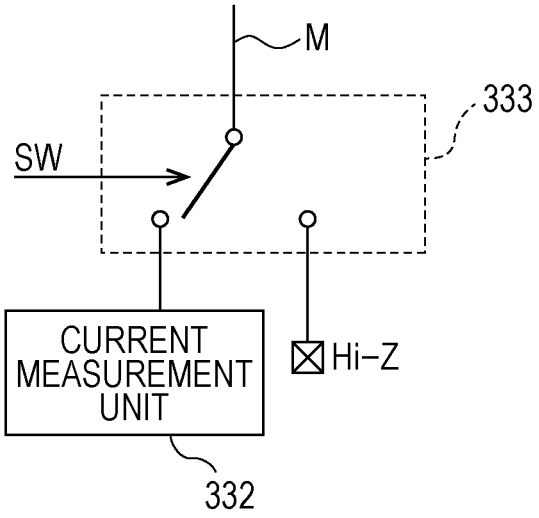
FIG. 22 is a diagram illustrating the configuration of a portion at or near an end of a monitor line according to a second modification of the first embodiment.

FIG. 22 is a diagram illustrating the configuration of a portion at or near an end of the monitor line M according to this modification. In this modification, as illustrated in FIG. 22, a switching unit 333 for switching the monitor line M between the state of being connected to the current measurement circuit 332 and the high-impedance state is included. The monitor line M is set to either the state of being connected to the current measurement circuit 332 or the high-impedance state in accordance with a switching control signal SW given to the switching unit 333.

Incidentally, in the first embodiment, as illustrated in FIG. 15, the state (illumination state/non-illumination state) of the organic EL element OLED is switched in a time-controlled manner. In this case, in order to bring the organic EL element OLED into the non-illumination state, a process for making the potential of the monitor line M equal to, for example, the potential of the low-level power supply voltage ELVSS is performed. In this modification, in contrast, the organic EL elements OLED can be brought into the non-illumination state by setting the monitor line M to the high-impedance state.

<1.5.3 Third Modification>

In the first embodiment, the description is based on the assumption that one current measurement circuit 332 is provided for each column. However, the present invention is not limited thereto, and a configuration (the configuration of this modification) can also be employed in which a single current measurement circuit 332 is shared by a plurality of columns.

Figure 23:
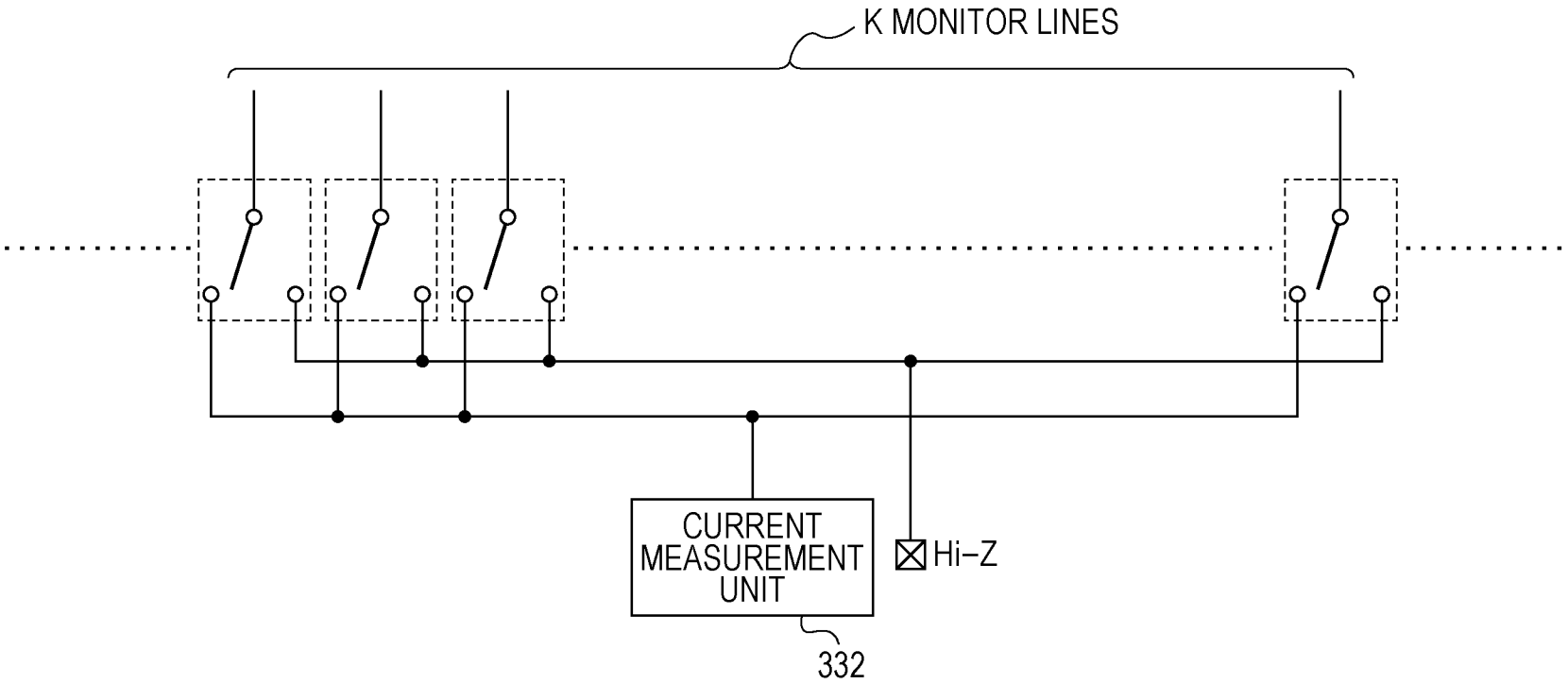
FIG. 23 is a diagram illustrating the configuration of a portion at or near either ends of monitor lines according to a third modification of the first embodiment.

In this modification, as in the second modification (see FIG. 22), the monitor line M is set to either the state of being connected to the current measurement circuit 332 or the high-impedance state. In this modification, furthermore, portions at or near either ends of the monitor lines M have a configuration illustrated in FIG. 23. That is, a single current measurement circuit 332 is provided for every K monitor lines M.

In the configuration described above, only one of K columns corresponding to K monitor lines M is used as a column (hereinafter referred to as the "characteristics detection target column") for which TFT characteristics and OLED characteristics are detected within each frame. In the characteristics detection operation for the monitored row, the monitor lines M other than the characteristics detection target column are maintained in the high-impedance state. In the characteristics detection operation for the monitored row, furthermore, a normal data voltage (the voltage corresponding to the target brightness), rather than the potential Vmg described above, is applied to the data lines D for the columns other than the characteristics detection target column. During the light emission period Tc, the transistors T3 in the monitored row are in the on state, while the monitor lines M for the columns other than the characteristics detection target column are in the high-impedance state. This prevents the current from flowing through the monitor lines M for the columns other than the characteristics detection target column while allowing the current to flow through the organic EL elements OLED, and the organic EL elements OLED emit light in a manner similar to that in the normal operation. The characteristics detection operation described above is performed for the characteristics detection target column in the monitored row.

For example, in an organic EL display device including a "Landscape FHD" display unit 10 and having a driving frequency of 60 Hz, the time period required for the monitoring of one column (the detection of the TFT characteristics and the OLED characteristics) is 18 seconds (=1080/60). Here, in order for an offset value and a gain value corresponding to each pixel to be updated every 30 minutes (1800 seconds), it may be sufficient to adopt a configuration in which a single current measurement circuit 332 is provided for every 100 monitor lines M.

Therefore, according to this modification, there is provided an organic EL display device with a suppressed increase in circuit area which enables sufficient compensation for both the degradation of a drive transistor (a transistor T2) and the degradation of an organic EL element OLED while ensuring a sufficient amount of time for the detection of the characteristics of the drive transistor (the transistor T2) and the organic EL element OLED.

<1.5.4 Fourth Modification>

Figure 24:
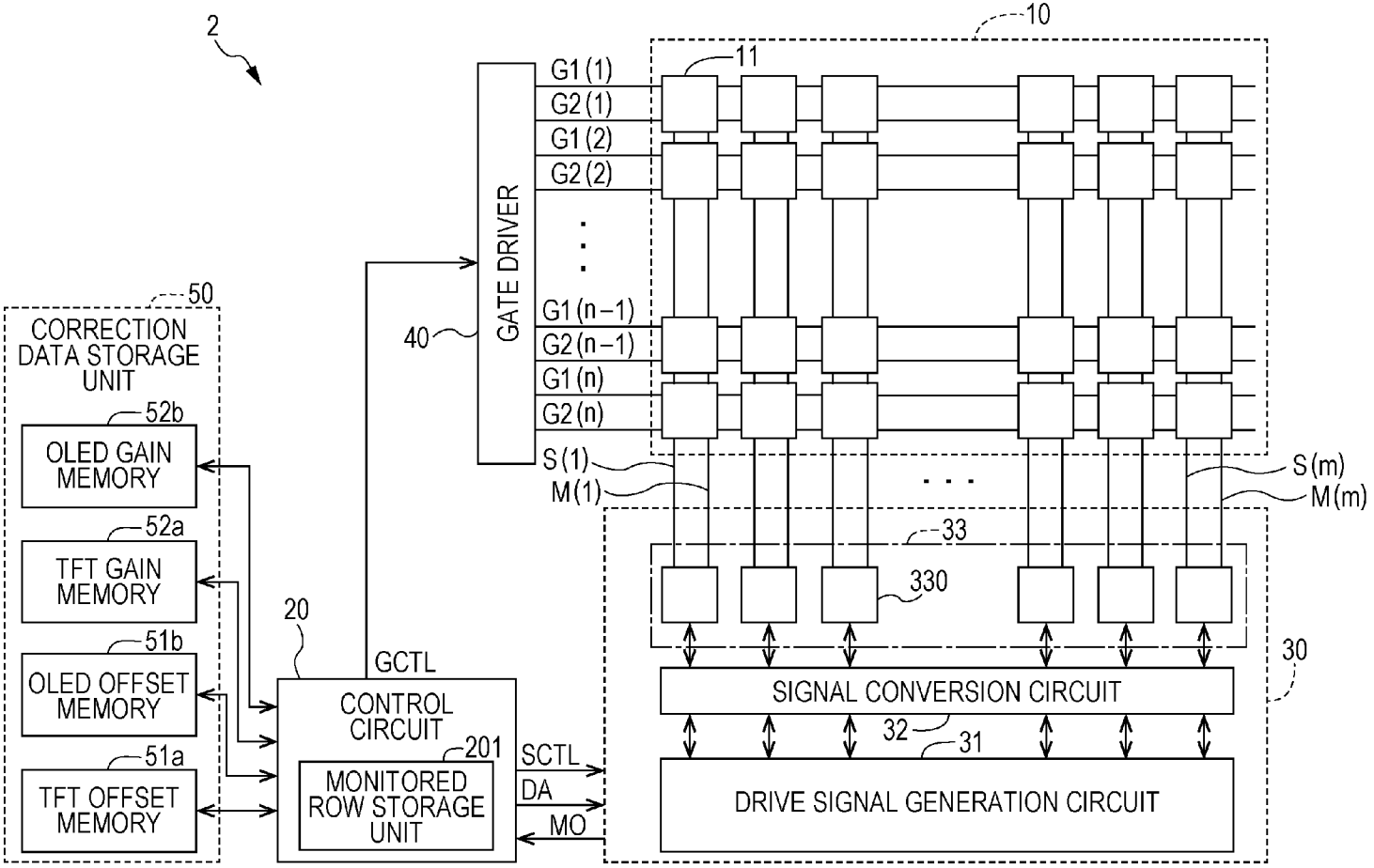
FIG. 24 is a block diagram illustrating the overall configuration of an organic EL display device according to a fourth modification of the first embodiment.

According to the first embodiment, if a short-term operation of the organic EL display device 1 is repeated, large differences in the number of times TFT characteristics and OLED characteristics are detected occur between an upper row on the display unit 10 and a lower row on the display unit 10. Accordingly, in an organic EL display device 2 according to this modification, as illustrated in FIG. 24, the control circuit 20 includes a monitored row storage unit 201 for storing the monitored row. In this configuration, information that identifies a row for which TFT characteristics and OLED characteristics were detected last when power was turned off is stored in the monitored row storage unit 201. This process implements a monitored region storing step. After power is turned on, TFT characteristics and OLED characteristics are detected, starting with a row subsequent to the row identified on the basis of the information stored in the monitored row storage unit 201. In this embodiment, the monitored row storage unit 201 implements a monitored region storage unit.

Therefore, according to this modification, a difference is prevented from occurring in the number of times TFT characteristics and OLED characteristics are detected between an upper row on the display unit 10 and a lower row on the display unit 10. This enables uniform compensation for the degradation of the drive transistors and the degradation of the organic EL elements OLED across the entire screen surface, and effectively prevents the occurrence of variations in brightness.

The row for which TFT characteristics and OLED characteristics are detected for the first time after power is turned on is not limited to a row subsequent to the row identified on the basis of the information stored in the monitored row storage unit 201, and may be a row at or near the row identified on the basis of the information stored in the monitored row storage unit 201. For example, there may be a row for which the characteristics detection operation is redundantly performed immediately before power is turned off and immediately after power is turned on.

Alternatively, information that identifies a row for which TFT characteristics and OLED characteristics were detected last may be stored, or information that identifies both a row and column for which TFT characteristics and OLED characteristics were detected last may be stored.

<1.5.5 Fifth Modification>

Figure 25:
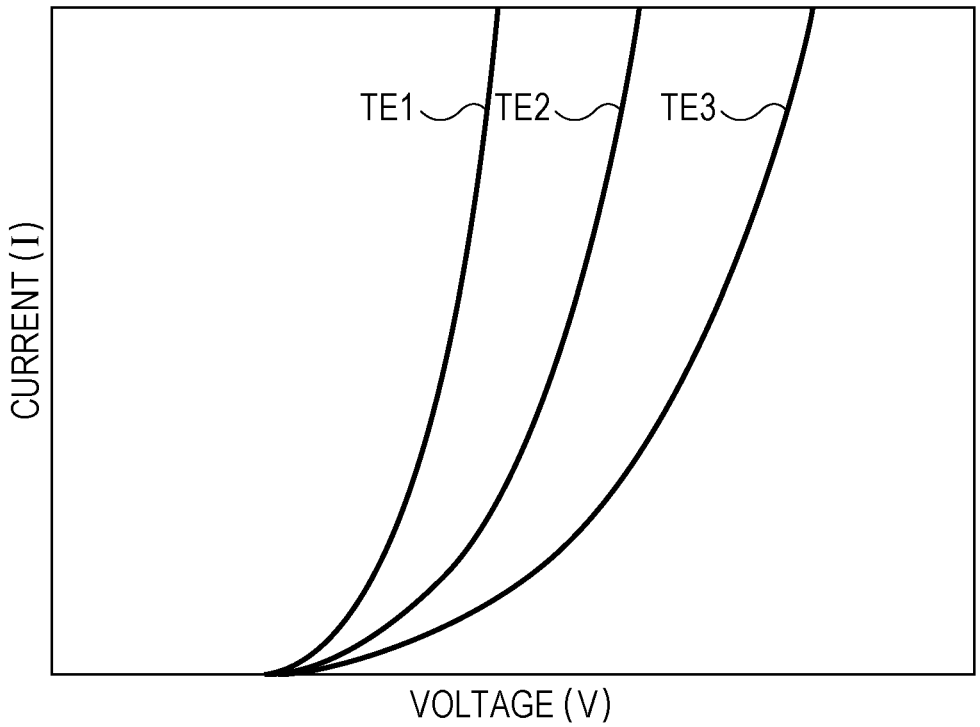
FIG. 25 is a diagram describing the temperature dependence of the current-voltage characteristics of an organic EL element.

FIG. 25 is a diagram describing the temperature dependence of the current-voltage characteristics of an organic EL element. In FIG. 25, the current-voltage characteristics of an organic EL element at a temperature TE1, the current-voltage characteristics of the organic EL element at a temperature TE2, and the current-voltage characteristics of the organic EL element at a temperature TE3 are illustrated, where "TE1>TE2>TE3". As can be seen from FIG. 25, in order to supply a predetermined current to an organic EL element, it is necessary to increase the voltage as the temperature decreases. In this manner, the current-voltage characteristics of an organic EL element largely depend on temperature. Accordingly, it is preferable to adopt a configuration (the configuration of this modification) that can compensate for a temperature change.

Figure 26:
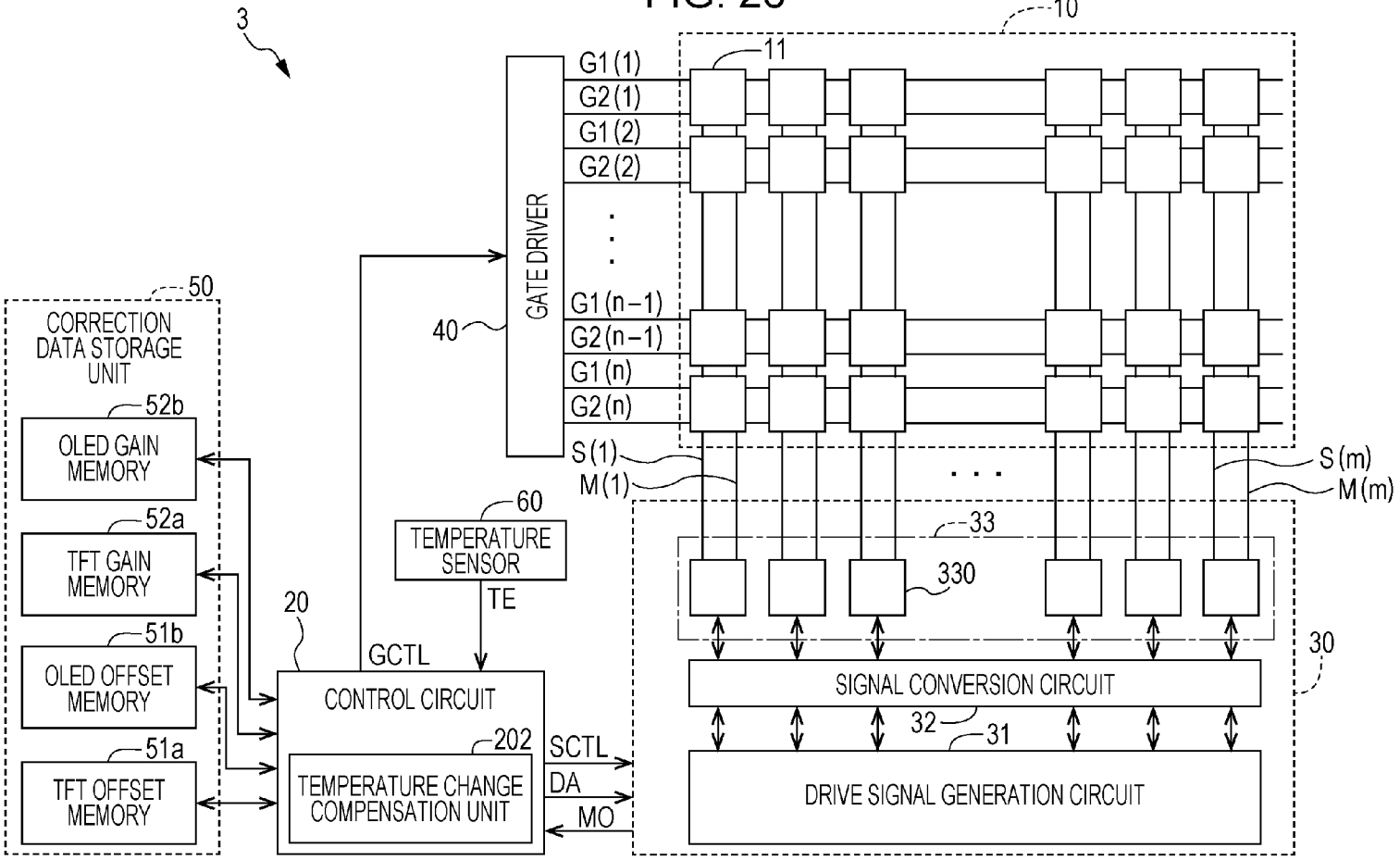
FIG. 26 is a block diagram illustrating the overall configuration of an organic EL display device according to a fifth modification of the first embodiment.

FIG. 26 is a block diagram illustrating the overall configuration of an organic EL display device 3 according to this modification. In this modification, a temperature sensor 60 is included in addition to the constituent elements according to the first embodiment. Further, the control circuit 20 includes a temperature change compensation unit 202. The temperature sensor 60 gives temperature information TE that is a result of the measurement of temperature to the control circuit 20, as needed. The temperature change compensation unit 202 performs correction on the monitor data MO given from the source driver 30, the correction being based on the temperature information TE. More specifically, the temperature change compensation unit 202 converts the value of the monitor data MO corresponding to the temperature at the detection time into a value corresponding to a certain standard temperature, and updates the offset values in the OLED offset memory 51*b* and the degradation correction coefficients in the OLED gain memory 52*b* on the basis of the value obtained as a result of the conversion.

The process of the temperature sensor 60 implements a temperature detecting step, and the process of the temperature change compensation unit 202 implements a temperature change compensating step.

Figure 27:
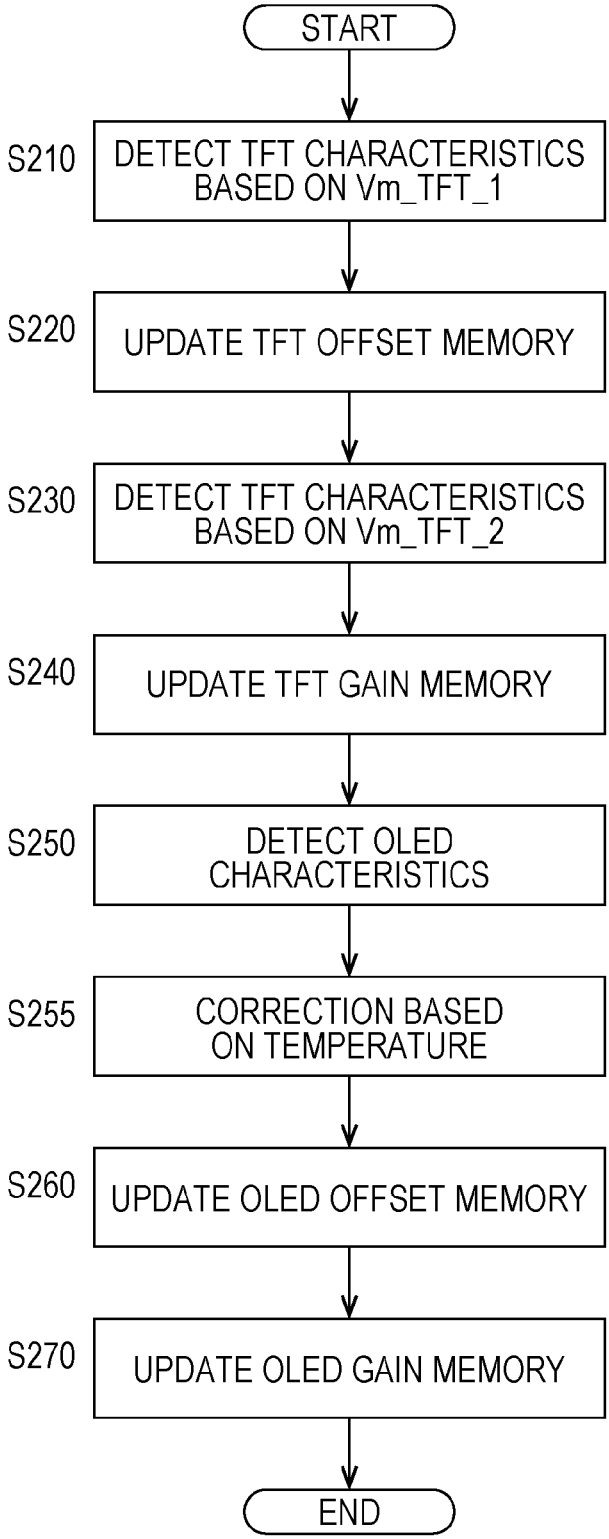
FIG. 27 is a flowchart describing a procedure for updating correction data in a correction data storage unit according to the fifth modification of the first embodiment.

FIG. 27 is a flowchart describing a procedure for updating the correction data in the correction data storage unit 50 (the offset values stored in the TFT offset memory 51*a*, the offset values stored in the OLED offset memory 51*b*, the gain values stored in the TFT gain memory 52*a*, and the degradation correction coefficients stored in the OLED gain memory 52*b*) according to this modification. Note that the processes of step S210 to step S250 in this modification (FIG. 27) are the same as the processes of step S110 to step S150 in the first embodiment (FIG. 16), and the processes of step S260 to step S270 in this modification (FIG. 27) are the same as the processes of step S160 to step S170 in the first embodiment (FIG. 16). In this modification, after the detection of OLED characteristics, the offset values and the degradation correction coefficients are corrected on the basis of the temperature information TE given by the temperature sensor 60 (step S255) before the offset values and the degradation correction coefficients are updated.

Therefore, according to this modification, a video signal sent from outside is corrected by using correction data that takes into account a temperature change. Accordingly, an organic EL display device is provided which enables simultaneous compensation for both the degradation of a drive transistor and the degradation of an organic EL element OLED regardless of a change in temperature.

<1.5.6 Sixth Modification>

<1.5.6.1 Overview>

In the first embodiment, for each frame, OLED characteristics are detected after TFT characteristics have been detected. However, the present invention is not limited thereto, and a configuration (the configuration of this modification) can also be employed in which TFT characteristics are detected after OLED characteristics have been detected.

Figure 28:
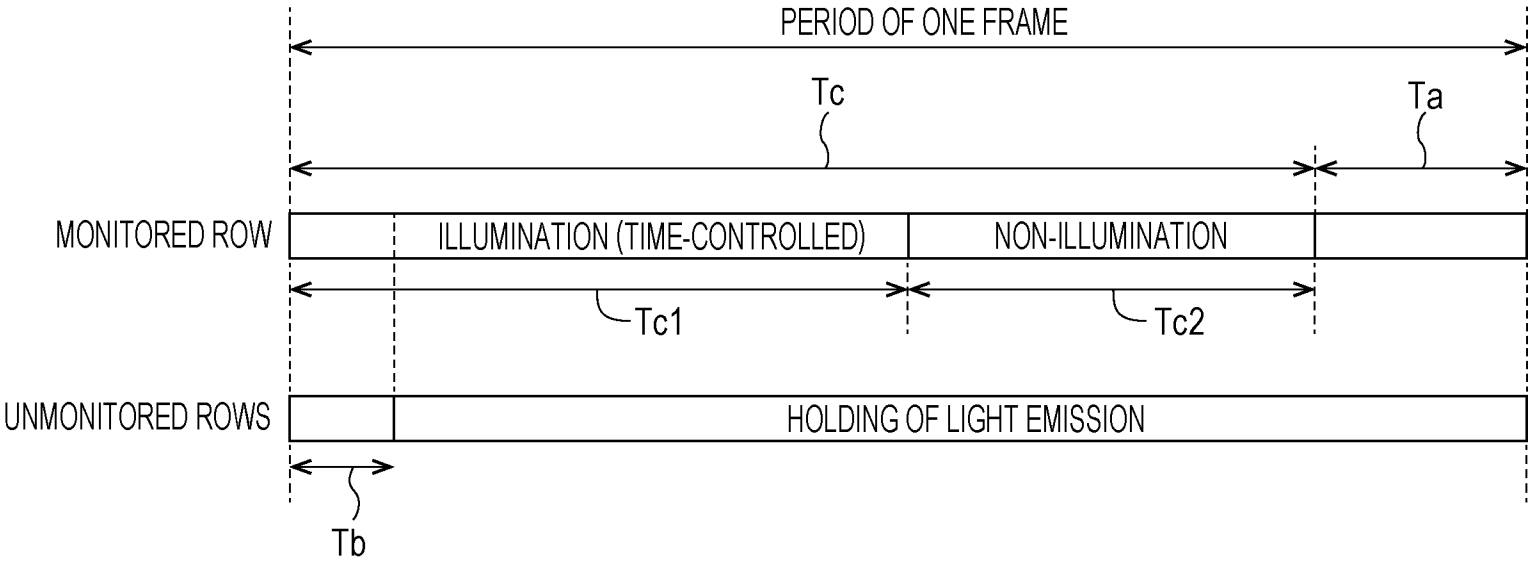
FIG. 28 is a diagram describing a period of one frame according to a sixth modification of the first embodiment.

FIG. 28 is a diagram describing a period of one frame according to this modification. When the focus is on the monitored row, a period of one frame is constituted by a light emission period Tc and a TFT characteristics detection period Ta, and the light emission period Tc precedes the TFT characteristics detection period Ta. A selection period Tb is at the beginning of the light emission period Tc. As can be seen from FIG. 28, the length of the selection period Tb is equal for the unmonitored rows and the monitored row. The light emission period Tc is constituted by a period Tc1 during which the organic EL elements OLED are actually in the illumination state, and a period Tc2 during which the organic EL elements OLED are in the non-illumination state. In this manner, also in this modification, the length of the time period during which an organic EL element OLED emits light is adjusted to achieve the desired gradation display.

<1.5.6.2 Characteristics Detection Operation for Monitored Row>

Figure 29:
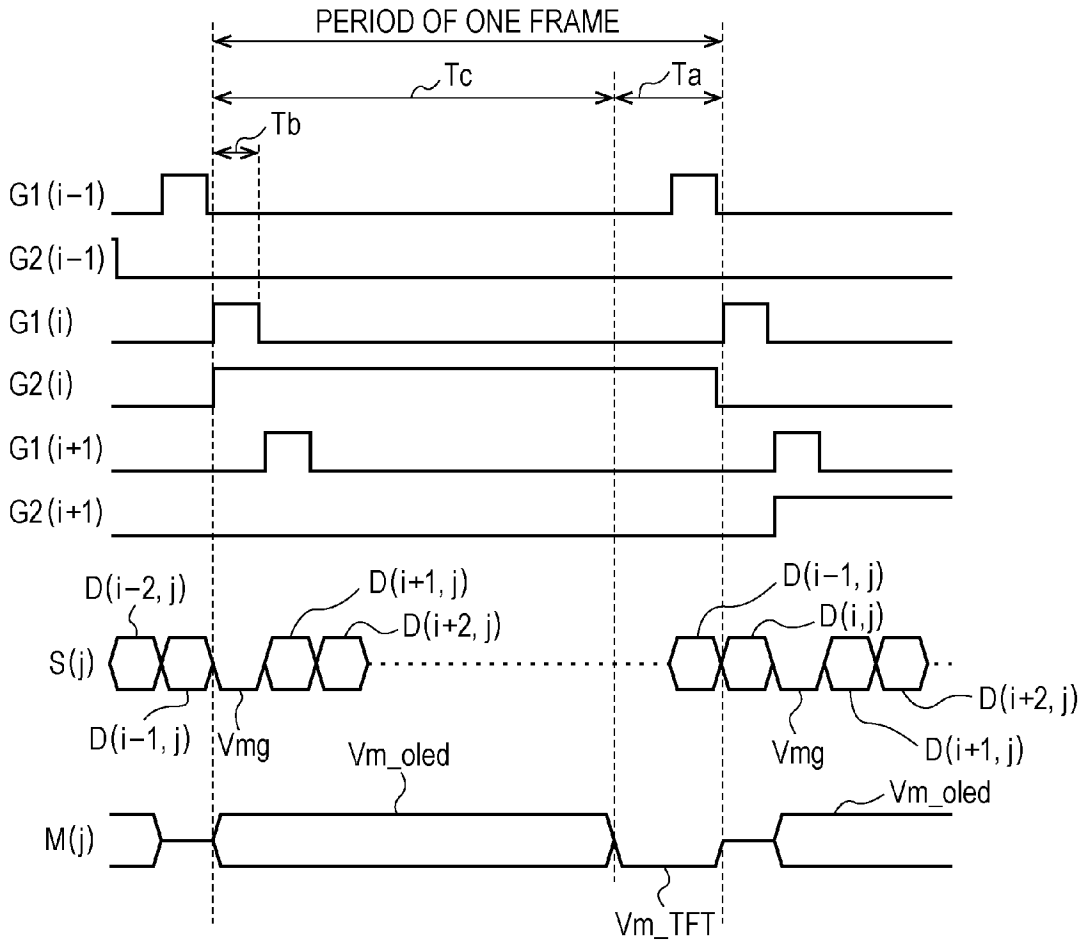
FIG. 29 is a timing chart describing the operation of a pixel circuit (a pixel circuit in the i-th row and j-th column) included in the monitored row according to the sixth modification of the first embodiment.

Next, a characteristics detection operation according to this modification will be described with reference to FIG. 29. FIG. 29 is a timing chart describing the operation of a pixel circuit 11 (assumed to be the pixel circuit 11 in the i-th row and j-th column) included in the monitored row according to this modification. In FIG. 29, the "period of one frame" is expressed using, as a reference, the point in time when the selection period for the i-th row begins within a frame in which the i-th row is the monitored row.

During the first one horizontal scanning period (the selection period Tb) within the light emission period Tc, the scanning line G1(*i*) and the monitor control line G2(*i*) are set to the active state. Accordingly, the transistor T1 and the transistor T3 are brought into the on state. During this period, furthermore, a potential Vmg is given to the data line S(j), and a potential Vm_oled is given to the monitor line M(j). A potential Vm_TFT is given to the monitor line M(j) during the TFT characteristics detection period Ta described below.

Here, if a threshold voltage of the transistor T2 determined based on the offset values stored in the TFT offset memory 51*a* is represented by Vth(T2), the value of the potential Vmg, the value of the potential Vm_TFT, and the value of the potential Vm_oled are set so that Expressions (1) and (2) above hold. In addition, if a light emission threshold voltage of the organic EL element OLED determined based on the offset values stored in the OLED offset memory 51*b* is represented by Vth(oled), the value of the potential Vm_oled is set so that Expression (5) above holds. Furthermore, if a breakdown voltage of the transistor T2 is represented by Vbr(T2), the value of the potential Vm_oled is set so that Expression (6) above holds.

As described above, in the first one horizontal scanning period (the selection period Tb) within the light emission period Tc, the potential Vmg satisfying Expressions (1) and (2) above is given to the data line S(j), and the potential Vm_oled satisfying Expressions (2), (5), and (6) above is given to the monitor line M(j). From Expressions (2) and (6) above, the transistor T2 is set to the off state during this period. Further, from Expression (5) above, a current flows through the organic EL element OLED during this period.

In a period other than the selection period Tb within the light emission period Tc, the scanning line G1(*i*) is set to the inactive state. Accordingly, the transistor T1 is brought into the off state. On the other hand, the transistor T2 is maintained in the on state since the capacitor Cst is charged during the selection period Tb. The transistor T3 is also maintained in the on state since the monitor control line G2(*i*) is maintained in the active state. The potential Vm_oled satisfying Expressions (2), (5), and (6) above is given to the monitor line M(j).

Therefore, during the light emission period Tc, the current flows from the monitor line M(j) to the organic EL element OLED as indicated by the arrow denoted by symbol 73 in FIG. 13, and the organic EL element OLED emits light. In this state, the current flowing through the monitor line M(j) is measured by the current measurement circuit 332. In the way described above, the magnitude of the current flowing through the organic EL element OLED is measured with the voltage between the anode (positive electrode) and cathode (negative electrode) of the organic EL element OLED being set to a predetermined magnitude (Vm_oled−ELVSS), and the OLED characteristics are detected.

During the TFT characteristics detection period Ta, the scanning line G1(*i*) is maintained in the inactive state and the monitor control line G2(*i*) is maintained in the active state. During this period, accordingly, the transistor T1 is maintained in the off state and the transistor T3 is maintained in the on state. In addition, as described above, the potential Vm_TFT is given to the monitor line M(j) during this period.

Here, the value of the potential Vm_TFT is set so that Expressions (1) and (3) above hold. Further, if a breakdown voltage of the organic EL element OLED is represented by Vbr(oled), the value of the potential Vm_TFT is set so that Expression (4) above holds.

As described above, during the TFT characteristics detection period Ta, the potential Vm_TFT satisfying Expressions (1), (3), and (4) above is given to the monitor line M(j). From Expression (1) above, the transistor T2 is set to the on state during this period. Further, from Expressions (3) and (4) above, no current flows through the organic EL element OLED during this period.

Therefore, during the TFT characteristics detection period Ta, the current flowing through the transistor T2 is output to the monitor line M(j) through the transistor T3 as indicated by the arrow denoted by symbol 72 in FIG. 11. Accordingly, the current (sink current) output to the monitor line M(j) is measured by the current measurement circuit 332. In the way described above, the TFT characteristics are detected.

In this modification, as in the first embodiment, two types of potentials (the first reference potential Vm_TFT_1 and the second reference potential Vm_TFT_2) are applied to the monitor line M(j) during the TFT characteristics detection period Ta. Accordingly, the TFT characteristics based on the first reference potential Vm_TFT_1 and the TFT characteristics based on the second reference potential Vm_TFT_2 are detected.

Incidentally, in this modification, the potential of the monitor line M changes from Vm_oled to Vm_TFT at the time of transition from the light emission period Tc to the TFT characteristics detection period Ta. In the first embodiment, the potential of the monitor line M changes from Vm_oled to Vm_TFT at the time of transition from the TFT characteristics detection period Ta to the light emission period Tc. In this regard, if the presence of the parasitic capacitance between the gate and source of the transistor T2 and so forth are taken into account, the gate potential of the transistor T2 also changes when the potential of the monitor line M changes. The influence of such a change in the gate potential of the transistor T2 is larger when the light emission period Tc precedes (this modification) than when the TFT characteristics detection period Ta precedes (the first embodiment). The reason for this is as follows. During the selection period Tb, the gate potential of the transistor T2 is equal to the potential Vmg satisfying Expression (1) above. However, when the light emission period Tc precedes, the gate potential of the transistor T2 decreases in accordance with a reduction in the potential of the monitor line M at the time of transition from the light emission period Tc to the TFT characteristics detection period Ta. Thus, depending on the level of reduction in the gate potential of the transistor T2, the transistor T2 may be brought into the off state during the TFT characteristics detection period Ta. Therefore, it is more preferable that, as in the first embodiment, the TFT characteristics detection period Ta precedes than that, as in this modification, the light emission period Tc precedes.

<1.5.6.3 Update of Correction Data in Correction Data Storage Unit>

Figure 30:
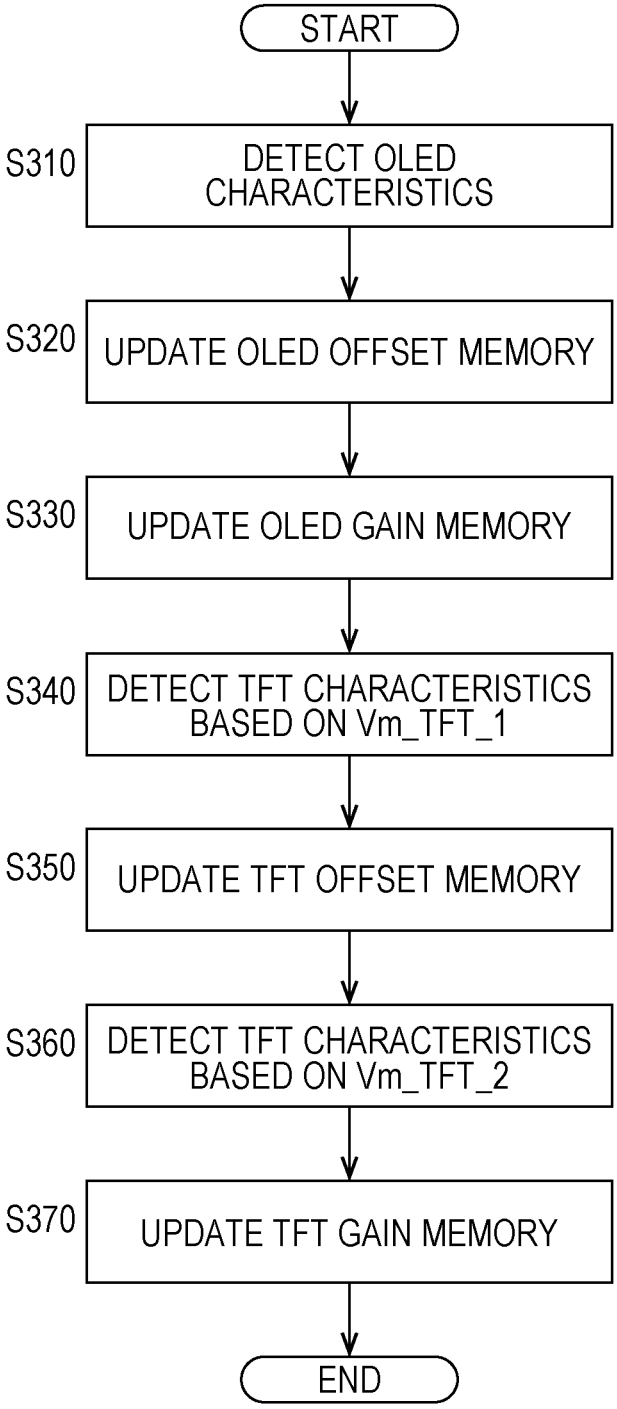
FIG. 30 is a flowchart describing a procedure for updating correction data in a correction data storage unit according to the sixth modification of the first embodiment.

Next, the update of correction data according to this modification will be described. FIG. 30 is a flowchart describing a procedure for updating the correction data in the correction data storage unit 50 (the offset values stored in the TFT offset memory 51*a*, the offset values stored in the OLED offset memory 51*b*, the gain values stored in the TFT gain memory 52*a*, and the degradation correction coefficients stored in the OLED gain memory 52*b*) according to this modification.

When the light emission period Tc is reached, OLED characteristics are detected (step S310). Through step S310, an offset value and a degradation correction coefficient for correcting a video signal are determined. Then, the offset value determined in step S310 is stored in the OLED offset memory 51*b* as a new offset value (step S320). Further, the degradation correction coefficient determined in step S310 is stored in the OLED gain memory 52*b* as a new degradation correction coefficient (step S330). Thereafter, when the TFT characteristics detection period Ta is reached, the TFT characteristics are detected with the first reference potential Vm_TFT 1 being given to the monitor line M (step S340). Through step S340, an offset value for correcting the video signal is determined. Then, the offset value determined in step S340 is stored in the TFT offset memory 51*a* as a new offset value (step S350). Thereafter, the TFT characteristics are detected with the second reference potential Vm_TFT 2 being given to the monitor line M (step S360). Through step S360, a gain value for correcting the video signal is determined. Then, the gain value determined in step S360 is stored in the TFT gain memory 52*a* as a new gain value (step S370). In the way described above, correction data corresponding to one pixel is updated.

In this modification, data (offset value, gain value, degradation correction coefficient) obtained on the basis of the detection results in step S310, step S340, and step S360 implements characteristics data.

<1.5.7 Seventh Modification>

In the first embodiment described above, the detection of TFT characteristics and the detection of OLED characteristics are performed for each frame. However, the present invention is not limited thereto. A configuration (the configuration of this modification) can also be employed in which the detection of only TFT characteristics is performed for each frame.

Figure 31:
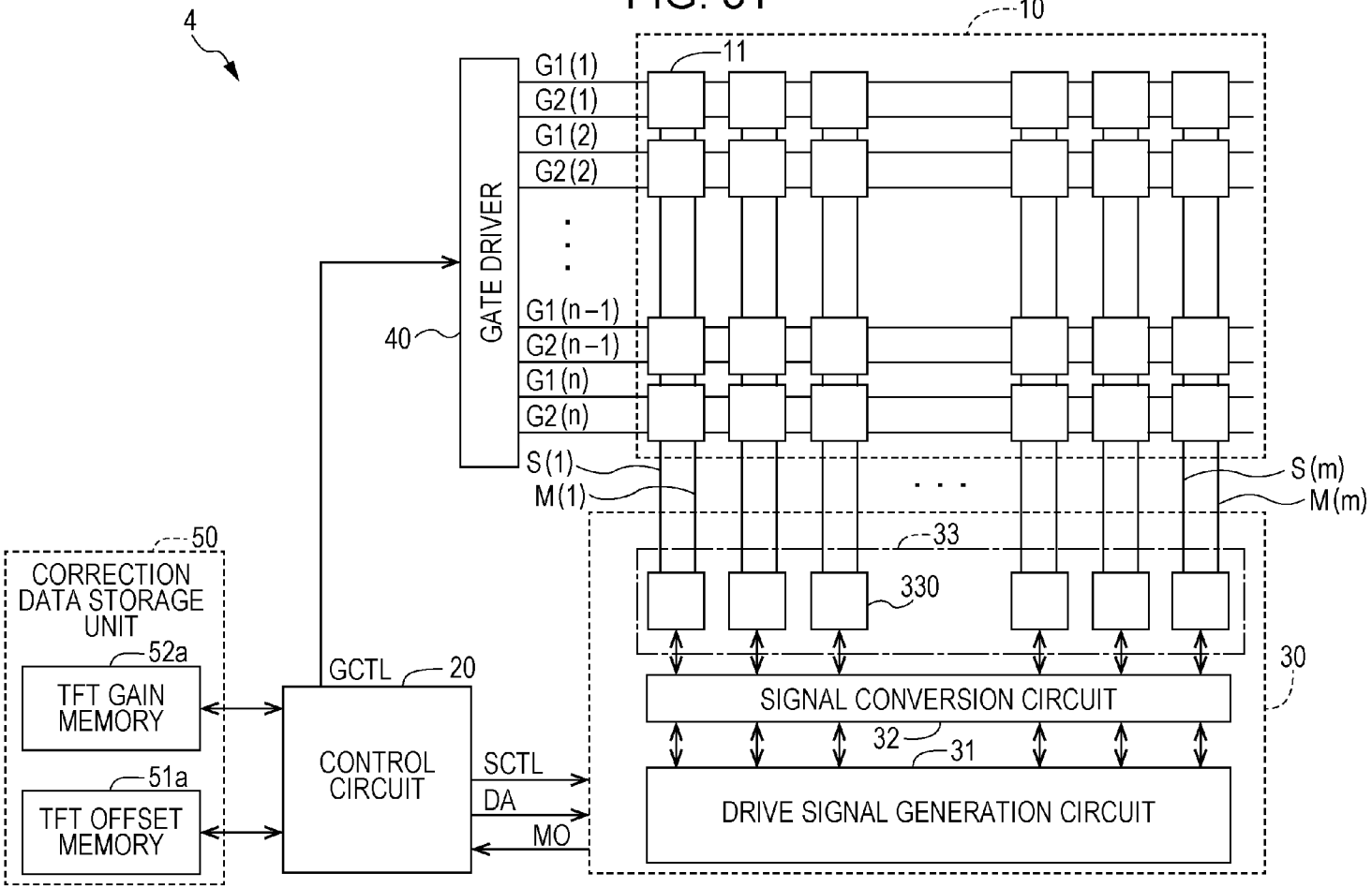
FIG. 31 is a block diagram illustrating the overall configuration of an organic EL display device according to a seventh modification of the first embodiment.

FIG. 31 is a block diagram illustrating the overall configuration of an organic EL display device 4 according to this modification. In this modification, the correction data storage unit 50 includes a TFT offset memory 51*a* and a TFT gain memory 52*a*. That is, the OLED offset memory 51*b* and the OLED gain memory 52*b* are not included in the correction data storage unit 50.

In this modification, the pixel circuits 11 are driven in a manner similar to that in the first embodiment. Accordingly, a current is supplied to the organic EL elements OLED for the monitored row on the basis of a constant voltage during the light emission period Tc. Further, the states (illumination state/non-illumination state) of the organic EL elements OLED are switched in a time-controlled manner so that the desired gradation display is achieved. Note that, in this modification, the current measurement circuit 332 does not measure the current flowing through the monitor line M(j) during the light emission period Tc.

Figure 32:
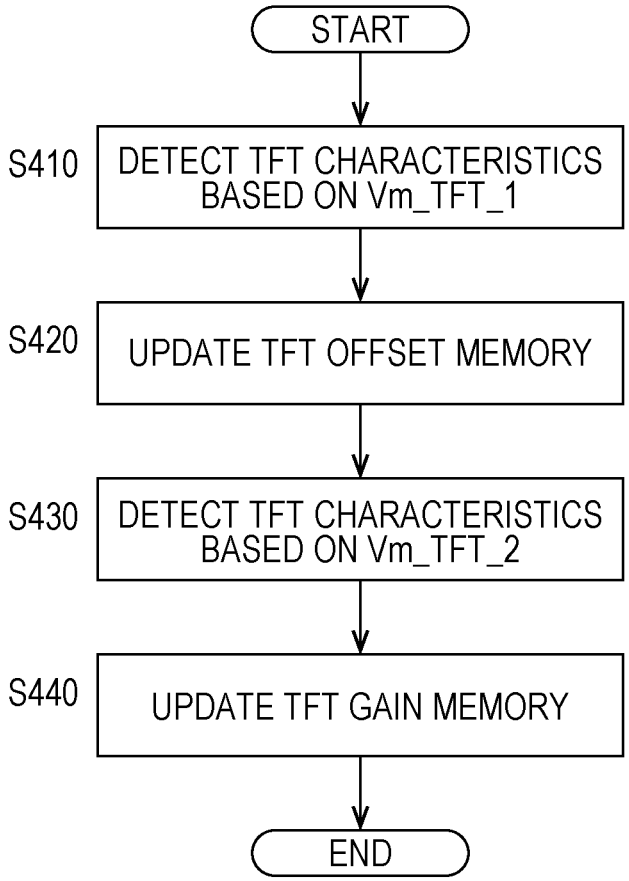
FIG. 32 is a flowchart describing a procedure for updating correction data in a correction data storage unit according to the seventh modification of the first embodiment.

Next, the update of correction data according to this modification will be described. FIG. 32 is a flowchart describing a procedure for updating the correction data in the correction data storage unit 50 (the offset values stored in the TFT offset memory 51*a* and the gain values stored in the TFT gain memory 52*a*) according to this modification. The processes of step S410 to step S440 in this modification (FIG. 32) are the same as the processes of step S110 to step S140 in the first embodiment (FIG. 16) described above. As can be seen from FIG. 32, in this modification, no OLED characteristics are detected. Thus, when step S440 is completed, the correction data update process ends.

According to this modification, the organic EL display device 4 enables sufficient compensation for the degradation of a drive transistor (the transistor T2) while ensuring a sufficient amount of time for the detection of the characteristics of the drive transistor (the transistor T2).

<2. Second Embodiment>

<2.1 Configuration Etc.>

A second embodiment of the present invention will be described. In the first embodiment, the current flowing through the monitor line M is measured with a certain constant voltage being supplied to the monitor line M, so that TFT characteristics and OLED characteristics are detected. In this embodiment, in contrast, while the current flowing through the monitor line M is measured with a certain constant voltage being supplied to the monitor line M for the detection of TFT characteristics, the voltages across the positive electrodes of the organic EL elements OLED are measured with a certain constant current being supplied to the monitor line M for the detection of OLED characteristics.

Figure 33:
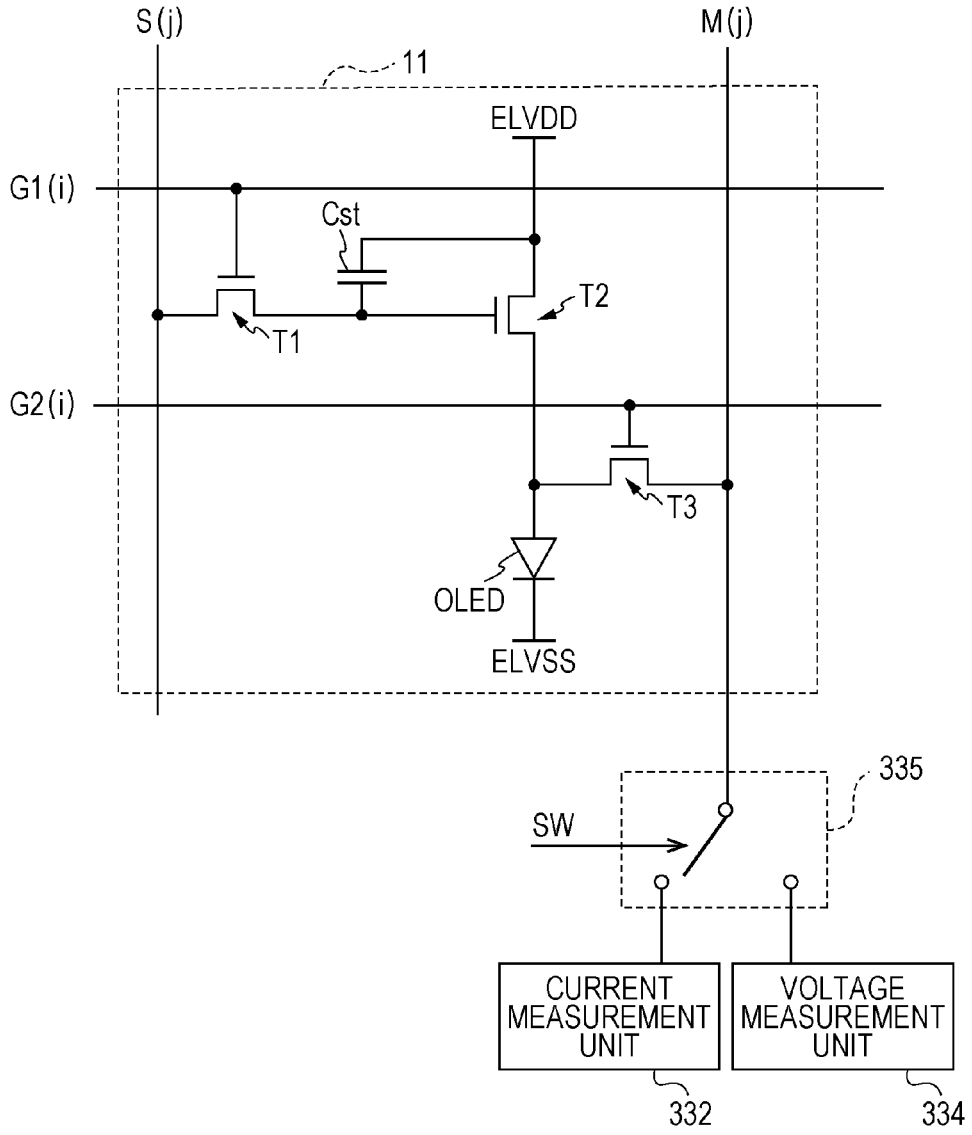
FIG. 33 is a diagram describing a configuration for obtaining monitor data according to a second embodiment.

The overall configuration is similar to that in the first embodiment, and is not described herein (see FIG. 2). In this embodiment, a voltage measurement circuit 334 is included, in addition to the current measurement circuit 332, as a constituent element for obtaining monitor data MO. The configuration of the current measurement circuit 332 is similar to the configuration according to the first embodiment (see FIG. 7). In this embodiment, furthermore, as illustrated in FIG. 33, a switching unit 335 for switching the monitor line M(j) between the state of being connected to the current measurement circuit 332 and the state of being connected to the voltage measurement circuit 334 is included. The monitor line M(j) is configured to be connected to either the current measurement circuit 332 or the voltage measurement circuit 334 in accordance with a switching control signal SW given to the switching unit 335 from the control circuit 20.

Figure 34:
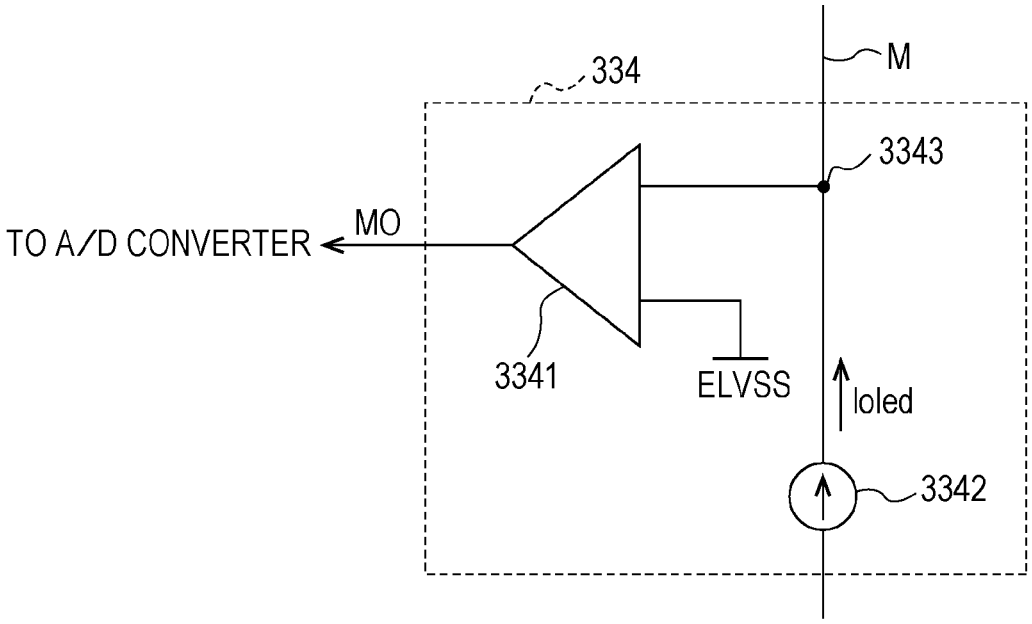
FIG. 34 is a diagram illustrating an example configuration of a voltage measurement circuit according to the second embodiment.

FIG. 34 is a diagram illustrating an example configuration of the voltage measurement circuit 334. As illustrated in FIG. 34, the voltage measurement circuit 334 includes an amplifier 3341 and a constant-current source 3342. In this configuration, a voltage between a node 3343 and the low-level power supply line ELVSS is amplified by the amplifier 3341 with a constant current being supplied to the monitor line M by the constant-current source 3342. The amplified voltage is sent to the A/D converter in the signal conversion circuit 32 as monitor data MO.

2.2 Characteristics Detection Operation for Monitored Row

Figure 35:
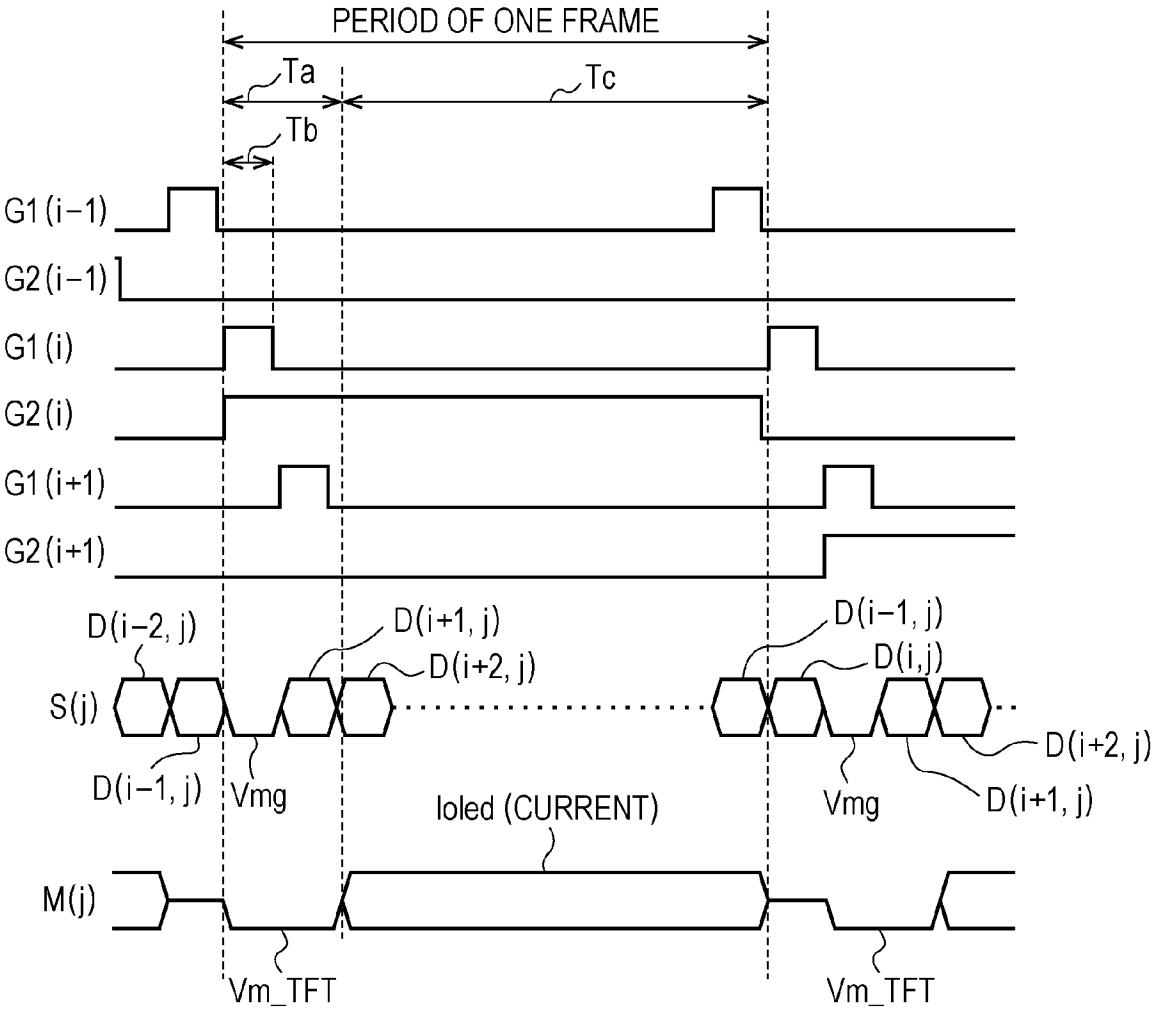
FIG. 35 is a timing chart describing the operation of a pixel circuit (a pixel circuit in the i-th row and j-th column) included in the monitored row according to the second embodiment.

Next, a characteristics detection operation according to this embodiment will be described with reference to FIG. 35. FIG. 35 is a timing chart describing the operation of a pixel circuit 11 (assumed to be the pixel circuit 11 in the i-th row and j-th column) included in the monitored row. In FIG. 35, the "period of one frame" is expressed using, as a reference, the point in time when the selection period for the i-th row begins within a frame in which the i-th row is the monitored row. In each frame period, the monitor line M(j) is connected to the current measurement circuit 332 during the TFT characteristics detection period Ta, and the monitor line M(j) is connected to the voltage measurement circuit 334 during the light emission period TC.

In the first half (the selection period Tb) of the TFT characteristics detection period Ta, the scanning line G1(*i*) and the monitor control line G2(*i*) are set to the active state. Accordingly, the transistor T1 and the transistor T3 are brought into the on state. During this period, furthermore, a potential Vmg is given to the data line S(j), and a potential Vm_TFT is given to the monitor line M(j). A constant current Ioled is given to the monitor line M(j) during the light emission period Tc described below.

Here, if a threshold voltage of the transistor T2 determined based on the offset values stored in the TFT offset memory 51*a* is represented by Vth(T2) and the potential of the monitor line M(j) when the constant current Ioled is given to the monitor line M(j) is represented by Vm_oled (Ioled), the value of the potential Vmg, the value of the potential Vm_TFT, and the value of the current Ioled are set so that Expression (1) above and Expression (7) below hold.

$$Vmg < Vm_\mathrm{oled}(I\mathrm{oled}) + V\mathrm{th}(T2) \quad (7)$$

In addition, if a light emission threshold voltage of the organic EL element OLED determined based on the offset values stored in the OLED offset memory 51*b* is represented by Vth(oled), the value of the potential Vm_TFT is set so that Expression (3) above holds. Furthermore, if a breakdown voltage of the organic EL element OLED is represented by Vbr(oled), the value of the potential Vm_TFT is set so that Expression (4) above holds.

As described above, in the first half (the selection period Tb) of the TFT characteristics detection period Ta, the potential Vmg satisfying Expressions (1) and (7) above is given to the data line S(j), and the potential Vm_TFT satisfying Expressions (1), (3), and (4) above is given to the monitor line M(j). From Expression (1) above, the transistor T2 is set to the on state during this period. Further, from Expressions (3) and (4) above, no current flows through the organic EL element OLED during this period.

In the second half of the TFT characteristics detection period Ta, the scanning line G1(*i*) is set to the inactive state. Accordingly, the transistor T1 is brought into the off state. On the other hand, the transistor T2 is maintained in the on state since the capacitor Cst is charged during the selection period Tb. The transistor T3 is also maintained in the on state since the monitor control line G2(*i*) is maintained in the active state. The potential Vm_TFT satisfying Expressions (1), (3), and (4) above is given to the monitor line M(j).

Therefore, during the TFT characteristics detection period Ta, the current flowing through the transistor T2 is output to the monitor line M(j) through the transistor T3. Here, the monitor line M(j) is in connection with the current measurement circuit 332 during the TFT characteristics detection period Ta. Accordingly, the current (sink current) output to the monitor line M(j) is measured by the current measurement circuit 332. In the way described above, the TFT characteristics are detected.

In this embodiment, as in the first embodiment, two types of potentials (the first reference potential Vm_TFT_1 and the second reference potential Vm_TFT_2) are applied to the monitor line M(j) during the TFT characteristics detection period Ta. Accordingly, the TFT characteristics based on the first reference potential Vm_TFT_1 and the TFT characteristics based on the second reference potential Vm_TFT_2 are detected.

During the light emission period Tc, the scanning line G1(*i*) is maintained in the inactive state and the monitor control line G2(*i*) is maintained in the active state. During this period, accordingly, the transistor T1 is maintained in the off state and the transistor T3 is maintained in the on state. In addition, as described above, the constant current Ioled is given to the monitor line M(j) during this period.

Here, the value of the constant current Ioled is set so that Expression (7) above and Expression (8) below hold.

$$ELVSS+Vth(oled)<Vm_oled(Ioled) \quad (8)$$

In addition, if a breakdown voltage of the transistor T2 is represented by Vbr(T2), the value of the constant current Ioled is set so that Expression (9) below holds.

$$Vm_oled(Ioled)<Vmg+Vbr(T2) \quad (9)$$

As described above, during the light emission period Tc, the constant current Ioled that satisfies Expressions (7), (8), and (9) above is given to the monitor line M(j). From Expressions (7) and (9) above, the transistor T2 is set to the off state during this period. Further, from Expression (8) above, a current flows through the organic EL element OLED during this period.

Therefore, during the light emission period Tc, the constant current flows from the monitor line M(j) to the organic EL element OLED, and the organic EL element OLED emits light. Here, the monitor line M(j) is in connection with the voltage measurement circuit 334 during the light emission period Tc. In this state, the voltage across the positive electrode of the organic EL element OLED is measured by the voltage measurement circuit 334. In the way described above, the OLED characteristics are detected.

Incidentally, also in this embodiment, the length of the time period during which the organic EL element OLED emits light is adjusted so that the integral value of light emission current within a period of one frame becomes equal to the value corresponding to the desired gradation. In other words, the length of the time period during which the constant current Ioled is given to the organic EL element OLED is adjusted in accordance with the target brightness. Note that the value of the current may be changed during the light emission period Tc so that properties at a plurality of operating points (current-voltage characteristics) are measured so long as the integral value of light emission current within a period of one frame becomes equal to the value corresponding to the desired gradation.

The update of the correction data in the correction data storage unit 50 and the correction of a video signal are similar to those in the first embodiment described above, and are not described herein.

<2.3 Advantages>

As in the first embodiment, according to this embodiment, an organic EL display device is also provided which enables sufficient compensation for both the degradation of a drive transistor (a transistor T2) and the degradation of an organic EL element OLED while ensuring a sufficient amount of time for the detection of the characteristics of the drive transistor (the transistor T2) and the organic EL element OLED.

<2.4 Modifications>

Figure 36:
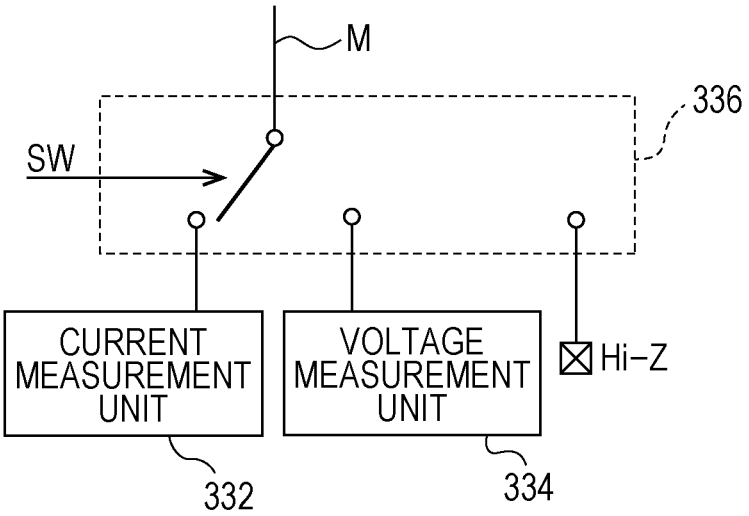
FIG. 36 is a diagram illustrating the configuration of a portion at or near an end of a monitor line according to a modification of the second embodiment.

As in the second modification of the first embodiment described above, a configuration can also be employed in which the monitor line M can be set to a high-impedance state. That is, a configuration may be employed in which, as illustrated in FIG. 36, a switching unit 336 for switching the monitor line M among the state of being connected to the current measurement circuit 332, the state of being connected to the voltage measurement circuit 334, and the high-impedance state.

Figure 37:
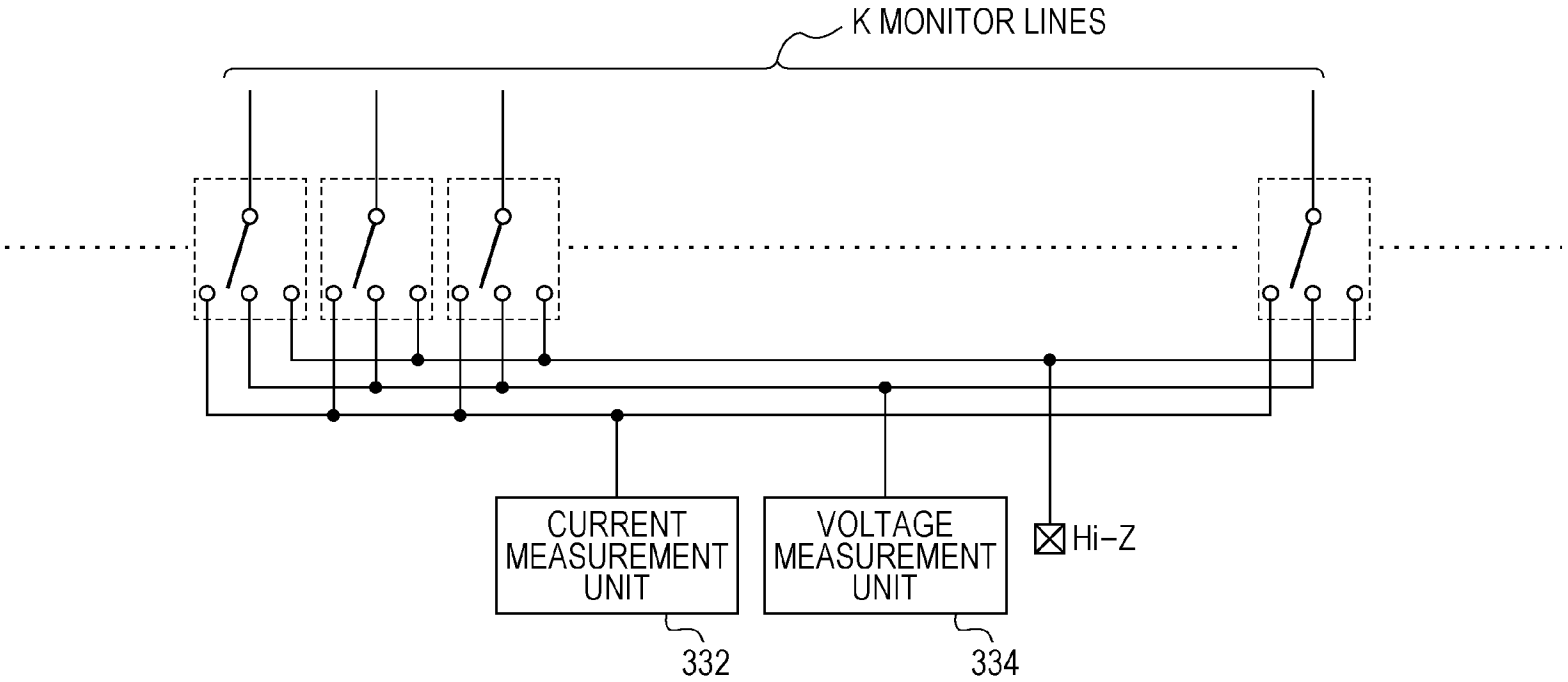
FIG. 37 is a diagram illustrating the configuration of a portion at or near either ends of monitor lines according to a modification of the second embodiment.

In addition, portions at or near either ends of the monitor lines M may have a configuration illustrated in FIG. 37, and a single current measurement circuit 332 and a single voltage measurement circuit 334 may be shared by a plurality of columns (see the third modification of the first embodiment).

<3. Others>

An organic EL display device to which the present invention is applicable is not limited to that including the pixel circuits 11 described by way of illustrative example in the respective embodiments and the respective modifications. Each of the pixel circuits may have any configuration other than the configurations described by way of illustrative example in the respective embodiments and the respective modifications so long as the pixel circuit at least includes an electro-optical element that is controlled with current (the organic EL element OLED), the transistors T1 to T3, and the capacitor Cst.

REFERENCE SIGNS LIST

1 to 4 organic EL display device
10 display unit
11 pixel circuit
20 control circuit
30 source driver
31 drive signal generation circuit
32 signal conversion circuit
33 output unit
40 gate driver
50 correction data storage unit
51*a* TFT offset memory
51*b* OLED offset memory
52*a* TFT gain memory
52*b* OLED gain memory
60 temperature sensor
201 monitored row storage unit
202 temperature change compensation unit
330 output circuit
331 video signal output unit
332 current measurement circuit
334 voltage measurement circuit
T1 to T3 transistor
Cst capacitor
G1(1) to G1(*n*) scanning line
G2(1) to G2(*n*) monitor control line
S(1) to S(m) data line
M(1) to M(m) monitor line
ELVDD high-level power supply voltage, high-level power supply line
ELVSS low-level power supply voltage, low-level power supply line
Ta TFT characteristics detection period
Tb selection period
Tc light emission period

The invention claimed is:

1. A drive method for a display device having a pixel matrix of n rows and m columns constituted by n×m (where n and m are integers greater than or equal to 2) pixel circuits, each including an electro-optical element whose brightness is controlled with current and a drive transistor for controlling a current to be supplied to the electro-optical element, the drive method comprising:

a drive transistor characteristics detecting step of detecting characteristics of the drive transistor;

a correction data storing step of causing a correction data storage unit prepared in advance to store, as correction data for correcting a video signal, characteristics data obtained on the basis of a detection result in the drive transistor characteristics detecting step; and a video signal correcting step of correcting the video signal on the basis of the correction data stored in the correction data storage unit, and generating a data signal to be supplied to the n×m pixel circuits, wherein the display device has, for each column in the pixel matrix, a monitor line electrically connectable with sources of the drive transistors and positive electrodes of the electro-optical elements, wherein processing of the drive transistor characteristics detecting step is performed for only one row in the pixel matrix per period of one frame, wherein, when a row for which the processing of the drive transistor characteristics detecting step is performed within each frame period is defined as a monitored row and a row other than the monitored row is defined as an unmonitored row, a period of one frame for the monitored row includes a drive transistor characteristics detection period during which the processing of the drive transistor characteristics detecting step is performed, and a light emission period during which the electro-optical elements are enabled to emit light, wherein, for the monitored row, the monitor line is electrically connected to the source of the drive transistor and the positive electrode of the electro-optical element throughout the drive transistor characteristics detection period and the light emission period, and wherein a potential given to the monitor line during the drive transistor characteristics detection period and a potential given to the monitor line during the light emission period are made different so that a current flows through only the drive transistor out of the drive transistor and the electro-optical element during the drive transistor characteristics detection period and so that a current flows through only the electro-optical element out of the drive transistor and the electro-optical element during the light emission period.

2. The drive method according to claim 1, further comprising an electro-optical element characteristics detecting step of detecting characteristics of the electro-optical element, wherein processing of the electro-optical element characteristics detecting step is performed during the light emission period, and wherein, in the correction data storing step, characteristics data obtained on the basis of a detection result in the electro-optical element characteristics detecting step is further stored in the correction data storage unit as the correction data.

3. The drive method according to claim 2, wherein, in the electro-optical element characteristics detecting step, a current flowing through the electro-optical element with a constant voltage being given to the electro-optical element is measured, so that the characteristics of the electro-optical element are detected.

4. The drive method according to claim 3, wherein, in the electro-optical element characteristics detecting step, a length of a time period during which the constant voltage is given to the electro-optical element is adjusted in accordance with target brightness.

5. The drive method according to claim 4, wherein, in the electro-optical element characteristics detecting step, the constant voltage, which has a plurality of levels within a range in which an integral value of light emission current for a period of one frame is equal to a value corresponding to target gradation, is given to the electro-optical element, so that a plurality of properties are detected as the characteristics of the electro-optical element.

6. The drive method according to claim 3, wherein the display device includes a current measurement circuit that measures a current of the monitor line, wherein, in the drive transistor characteristics detecting step, the current measurement circuit measures a current of the monitor line, so that characteristics of the drive transistor are detected, and wherein, in the electro-optical element characteristics detecting step, the current measurement circuit measures a current of the monitor line, so that characteristics of the electro-optical element are detected.

7. The drive method according to claim 2, wherein, in the electro-optical element characteristics detecting step, a voltage across the positive electrode of the electro-optical element is measured with a constant current being given to the electro-optical element, so that the characteristics of the electro-optical element are detected.

8. The drive method according to claim 7, wherein, in the electro-optical element characteristics detecting step, a length of a time period during which the constant current is given to the electro-optical element is adjusted in accordance with target brightness.

9. The drive method according to claim 8, wherein, in the electro-optical element characteristics detecting step, the constant current, which has a plurality of levels within a range in which an integral value of light emission current for a period of one frame is equal to a value corresponding to target gradation, is given to the electro-optical element, so that a plurality of properties are detected as the characteristics of the electro-optical element.

10. The drive method according to claim 7, wherein the display device includes a current measurement circuit that measures a current of the monitor line, and a voltage measurement circuit that measures a voltage across the monitor line, wherein, in the drive transistor characteristics detecting step, the current measurement circuit measures a current of the monitor line, so that characteristics of the drive transistor are detected, and wherein, in the electro-optical element characteristics detecting step, the voltage measurement circuit measures a voltage across the monitor line, so that characteristics of the electro-optical element are detected.

11. The drive method according to claim 2, wherein the processing of the electro-optical element characteristics detecting step is not performed on a pixel displayed in black or substantially in black within the pixel matrix of n rows and m columns.

12. The drive method according to claim 2, further comprising:

a temperature detecting step of detecting a temperature; and a temperature change compensating step of subjecting the characteristics data to correction based on the temperature detected in the temperature detecting step, wherein, in the correction data storing step, data obtained in processing of the temperature change compensating step is stored in the correction data storage unit as the correction data.

13. The drive method according to claim 1, wherein, in the drive transistor characteristics detecting step, a current flowing between a drain and source of the drive transistor is measured with a voltage between a gate and source of the drive transistor being set to a predetermined magnitude, so that the characteristics of the drive transistor are detected.

14. The drive method according to claim 13, wherein, in the drive transistor characteristics detecting step, a potential having a plurality of levels is given to the gate of the drive transistor, so that a plurality of properties are detected as the characteristics of the drive transistor.

15. The drive method according to claim 13, wherein the display device includes a current measurement circuit that measures a current of the monitor line, and wherein, in the drive transistor characteristics detecting step, the current measurement circuit measures a current of the monitor line, so that characteristics of the drive transistor are detected.

16. The drive method according to claim 15, wherein one current measurement circuit, which comprises the current measurement circuit, is disposed for every K monitor lines (K is an integer greater than or equal to 2 and less than or equal to m), and wherein, in each frame period, one of the K monitor lines is electrically connected to the current measurement circuit, and a monitor line not electrically connected to the current measurement circuit is brought into a high-impedance state.

17. The drive method according to claim 1, wherein each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and wherein, when the potential given to the gates of the drive transistors for the monitored row during the selection period is represented by Vmg, the potential given to the monitor line during the drive transistor characteristics detection period is represented by Vm_TFT, and the potential given to the monitor line during the light emission period is represented by Vm_oled, a value of Vmg is defined so as to satisfy the following expressions:

$$Vmg > Vm_TFT + Vth(T2), \text{ and}$$

$$Vmg < Vm_oled + Vth(T2),$$

where Vth(T2) is a threshold voltage of a leading drive transistor.

18. The drive method according to claim 1, wherein each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg and the potential given to the monitor line during the drive transistor characteristics detection period is represented by Vm_TFT, a value of Vm_TFT is defined so as to satisfy the following expressions:

$$Vm_TFT < Vmg - Vth(T2), \text{ and}$$

$$Vm_TFT < ELVSS + Vth(oled),$$

where Vth(T2) is a threshold voltage of the drive transistors, Vth(oled) is a light emission threshold voltage of the electro-optical element, and ELVSS is a potential at a negative electrode of the electro-optical element.

19. The drive method according to claim 1, wherein each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg and the potential given to the monitor line during the light emission period is represented by Vm_oled, a value of Vm_oled is defined so as to satisfy the following expressions:

$$Vm_oled > Vmg - Vth(T2), \text{ and}$$

$$Vm_oled > ELVSS + Vth(oled),$$

where Vth(T2) is a threshold voltage of the drive transistors, Vth(oled) is a light emission threshold voltage of the electro-optical element, and ELVSS is a potential at a negative electrode of the electro-optical element.

20. The drive method according to claim 1, wherein each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and when the potential given to the gates of the drive transistors for the monitored row during the selection period is represented by Vmg, the potential given to the monitor line during the drive transistor characteristics detection period is represented by Vm_TFT, and the potential given to the monitor line during the light emission period is represented by Vm_oled, values of Vmg, Vm_TFT, and Vm_oled are defined so as to satisfy the following relationships:

$$Vm_TFT < Vmg - Vth(T2),$$

$$Vm_TFT < ELVSS + Vth(oled),$$

$$Vm_oled > Vmg - Vth(T2), \text{ and}$$

$$Vm_oled > ELVSS + Vth(oled),$$

where Vth(T2) is a threshold voltage of the drive transistors, Vth(oled) is a light emission threshold voltage of the electro-optical element, and ELVSS is a potential at a negative electrode of the electro-optical element.

21. The drive method according to claim 1, wherein a length of the drive transistor characteristics detection period and a length of the light emission period are adjusted in accordance with target brightness.

22. The drive method according to claim 1, wherein, in each frame period, the drive transistor characteristics detection period precedes the light emission period.

23. The drive method according to claim 1, wherein each frame period includes a selection period, the selection period being a period during which a predetermined potential is given to gates of the drive transistors for the monitored row at the beginning of a period of one frame, and being a period during which a potential corresponding to target brightness is given to gates of the drive transistors for the unmonitored row at the beginning of the period of one frame, and wherein a length of the selection period is equal for the monitored row and the unmonitored row.

24. The drive method according to claim 1, further comprising a monitored region storing step of storing, in a monitored region storage unit prepared in advance, information that identifies a region in which the processing of the drive transistor characteristics detecting step was performed last when power to the display device was turned off, wherein the processing of the drive transistor characteristics detecting step is performed, starting with a region at or near the region obtained on the basis of the information stored in the monitored region storage unit, after power to the display device is turned on.

25. A display device having a pixel matrix of n rows and m columns constituted by n×m (where n and m are integers greater than or equal to 2) pixel circuits, each including an electro-optical element whose brightness is controlled with current and a drive transistor for controlling a current to be supplied to the electro-optical element, the display device comprising:

a pixel circuit driving unit that drives the n×m pixel circuits while performing a drive transistor characteristics detection process of detecting characteristics of the drive transistor;

a correction data storage unit that stores characteristics data obtained on the basis of a detection result in the drive transistor characteristics detection process, as correction data for correcting a video signal;

a video signal correction unit that corrects the video signal on the basis of the correction data stored in the correction data storage unit, and that generates a data signal to be supplied to the n×m pixel circuits; and a monitor line provided for each column in the pixel matrix, the monitor line being configured to be electrically connectable with sources of the drive transistors and positive electrodes of the electro-optical elements, wherein, when a row for which the drive transistor characteristics detection process is performed within each frame period is defined as a monitored row and a row other than the monitored row is defined as an unmonitored row, a period of one frame for the monitored row includes a drive transistor characteristics detection period during which the drive transistor characteristics detection process is performed, and a light emission period during which the electro-optical elements are enabled to emit light, and wherein the pixel circuit driving unit performs the drive transistor characteristics detection process for only one row in the pixel matrix per period of one frame, maintains a state where, for the monitored row, the monitor line is electrically connected to the source of the drive transistor and the positive electrode of the electro-optical element throughout the drive transistor characteristics detection period and the light emission period, and gives different potentials to the monitor line during the drive transistor characteristics detection period and during the light emission period so as to cause a current to flow through only the drive transistor out of the drive transistor and the electro-optical element during the drive transistor characteristics detection period and so as to cause a current to flow through only the electro-optical element out of the drive transistor and the electro-optical element during the light emission period.

* * * * *